US008673174B2

(12) United States Patent
Funatsu et al.

(10) Patent No.: US 8,673,174 B2
(45) Date of Patent: Mar. 18, 2014

(54) LIQUID CRYSTALLINE POLYESTER FIBER AND PROCESS FOR PRODUCTION OF THE SAME

(75) Inventors: Yoshitsugu Funatsu, Mishima (JP); Hiroo Katsuta, Mishima (JP); Yuhei Maeda, Mishima (JP)

(73) Assignee: Toray Industries, Inc., Tokyo (JP)

( * ) Notice: Subject to any disclaimer, the term of this patent is extended or adjusted under 35 U.S.C. 154(b) by 1238 days.

(21) Appl. No.: 12/528,980

(22) PCT Filed: Feb. 27, 2008

(86) PCT No.: PCT/JP2008/053359

§ 371 (c)(1),
(2), (4) Date: Aug. 27, 2009

(87) PCT Pub. No.: WO2008/105439

PCT Pub. Date: Sep. 4, 2008

(65) Prior Publication Data

US 2010/0104870 A1 Apr. 29, 2010

(30) Foreign Application Priority Data

Feb. 28, 2007 (JP) ..... 2007-048993
Mar. 1, 2007 (JP) ..... 2007-051646

(51) Int. Cl.
*C09K 19/38* (2006.01)
*D01F 6/62* (2006.01)
*D01F 6/84* (2006.01)

(52) U.S. Cl.
USPC ..... 252/299.01; 428/364; 428/401

(58) Field of Classification Search
CPC ..... C09K 19/3809
USPC ..... 252/299.01; 428/364, 401; 528/503; 264/236
See application file for complete search history.

(56) References Cited

U.S. PATENT DOCUMENTS

| | | | | |
|---|---|---|---|---|
| 3,975,487 | A | 8/1976 | Cottis et al. | |
| 7,914,699 | B2 * | 3/2011 | Tachikawa et al. | 252/299.01 |
| 2007/0243376 | A1 | 10/2007 | Tachikawa et al. | |
| 2011/0318982 | A1 * | 12/2011 | Funatsu et al. | 442/49 |

FOREIGN PATENT DOCUMENTS

| | | | |
|---|---|---|---|
| JP | 50-043223 | A | 4/1975 |
| JP | 60-231815 | A | 11/1985 |
| JP | 61-152810 | A | 7/1986 |
| JP | 61-170310 | A | 8/1986 |
| JP | 61-225312 | A | 10/1986 |
| JP | 01-229815 | A | 9/1989 |
| JP | 3-273024 | A | 12/1991 |
| JP | 04-333616 | A | 11/1992 |
| JP | 05-148707 | A | 6/1993 |
| JP | 7-278953 | A | 10/1995 |
| JP | 08-158151 | A | 6/1996 |
| JP | 11-269737 | A | 10/1999 |
| JP | 2003-239137 | A | 8/2003 |
| JP | 2006-89903 | A | 4/2006 |
| JP | 2007-119976 | A | 5/2007 |
| JP | 2007-119977 | A | 5/2007 |

* cited by examiner

*Primary Examiner* — Shean C Wu
(74) *Attorney, Agent, or Firm* — Birch, Stewart, Kolasch & Birch, LLP

(57) ABSTRACT

A liquid crystalline polyester fiber which exhibits a half width of endothermic peak (Tm1) of 15° C. or above as observed in differential calorimetry under heating from 50° C. at a temperature elevation rate of 20° C./min and a strength of 12.0 cN/dtex or more; and a process for production of the same. A liquid crystalline polyester fiber which is excellent in abrasion resistance and lengthwise uniformity and is improved in weavability and quality of fabric and which is characterized by a small single-fiber fineness can be efficiently produced without impairing the characteristics inherent in fabric made of liquid crystalline polyester fiber produced by solid phase polymerization, namely, high strength, high elastic modulus and excellent thermal resistance.

9 Claims, No Drawings

LIQUID CRYSTALLINE POLYESTER FIBER AND PROCESS FOR PRODUCTION OF THE SAME

TECHNICAL FIELD OF THE INVENTION

The present invention relates to a liquid crystalline polyester fiber which is high in strength and elastic modulus, excellent in thermal resistance, small in single-fiber fineness, excellent in lengthwise uniformity and excellent in abrasion resistance, and an efficient process for production of the same.

BACKGROUND ART OF THE INVENTION

It is known that a liquid crystalline polyester is a polymer comprising a rigid molecular chain, and highest strength and elastic modulus can be obtained among fibers prepared by melt spinning by highly orienting the molecular chain in the fiber axis direction in the melt spinning and further carrying out a heat treatment (solid phase polymerization). Further, it is also known that the liquid crystalline polyester can be improved in thermal resistance and dimensional stability by solid phase polymerization because the molecular weight increases and the melting point elevates by solid phase polymerization (for example, Non-Patent document 1). Thus, in a liquid crystalline polyester fiber, a high strength, a high elastic modulus, and excellent thermal resistance and thermal dimensional stability are exhibited by carrying out solid phase polymerization.

In the liquid crystalline polyester fiber, however, because the rigid molecular chain is highly oriented in the fiber axis direction and a dense crystal is produced, the interaction in a direction perpendicular to the fiber axis is low, fibril is liable to occur by friction, and there also be a defect that the fiber is poor in abrasion resistance.

Further, for the solid phase polymerization of liquid crystalline polyester fiber, a process for forming the fiber as a package and treating it is industrially employed from the points of simplifying the apparatus and improving the productivity, but, in this process, there is a problem that a fusion between single fibers is likely to occur in a temperature region where the solid phase polymerization can proceed and there occurs a defect due to a delamination of the fused portion when unwound from the package. Such a defect impairs the uniformity in the fiber lengthwise direction causing a reduction of strength, and in addition, causes a problem of fibrillation of the fiber proceeding from the defect as an origin.

Recently, particularly for a filter made of monofilaments and a gauze for screen printing, requirements of densification of weave density (making a mesh higher), decrease of thickness of the gauze and making an opening have a large area are increased for improving the performance, and in order to achieve this, making the single fiber have a small fineness and a high strength is strongly required, and at the same time, decreasing the defects of the openings is also required for providing a high performance. For decreasing the defects of the openings, because the aforementioned fibril is produced by fusion defect in the solid phase polymerization or friction in a higher-order processing, it is required to increase the strength and the uniformity of the fineness in the fiber lengthwise direction and to improve the abrasion resistance of the fiber.

Moreover, deterioration of a process passing-through property at a fiber higher-order processing process such as weaving is caused by engagement of fibril or fluctuation of tension due to accumulation of fibril onto a guide, and also from this point, it is required to increase the strength and the uniformity of the fineness in the fiber lengthwise direction and to improve the abrasion resistance of the fiber.

With respect to improvement of the abrasion resistance of liquid crystalline polyester fiber, a core-sheath type compound fiber in which the core component comprises a liquid crystalline polyester and the sheath component comprises a polyphenylene sulfide (Patent document 1) and a sea-island type compound fiber in which the island component comprises a liquid crystalline polyester and the sea component comprises a bendable thermoplastic polymer (Patent document 2) are proposed. In these technologies, although the abrasion resistance can be increased by the bendable polymer forming the fiber surface, there are problems that the strength of the fiber is poor because the percentage of components other than the liquid crystalline polyester is great, and that the fiber surfaces with a low melting point are fused with each other in the solid phase polymerization required for making the strength of the liquid crystalline polyester greater and defects are likely to occur. Further, in the core-sheath type compound spinning such as one in Patent document 1, each of the discharge amounts for core and sheath is little as compared with that for a single-component spinning, and when the discharge amount is further decreased in order to make the fiber fineness smaller, the melt viscosity changes by gelation or thermal decomposition accompanying with increase of residence time, irregularity in fineness or abnormal compounding occurs in the fiber lengthwise direction, and therefore, the uniformity in the lengthwise direction is impaired. Further, also in the blend spinning such as one in Patent document 2, when the discharge amount is decreased in order to make the fiber fineness smaller, an influence of blend irregularity in the lengthwise direction is actualized, and therefore, the uniformity in the lengthwise direction is impaired.

Further, a technology is proposed wherein the abrasion resistance is improved by heat treating a compound fiber comprising a liquid crystalline polyester and a bendable thermoplastic resin at a temperature of the melting point of the bendable thermoplastic resin plus 20° C. of higher (Patent documents 3 and 4). In this technology, however, because the abrasion resistance is improved by turning the bendable thermoplastic resin into an amorphous state, there is a problem that the obtained fiber is poor in thermal resistance. Further, because of compound fiber, as aforementioned, there is also a problem that the uniformity in the lengthwise direction is impaired.

These problems are ascribed to the means of compounding of a liquid crystalline polyester and the other component, and from this point, a technology has been desired for simultaneously achieving a small fineness, a high strength, a high uniformity in a lengthwise direction and a high abrasion resistance by a single component of liquid crystalline polyester.

With respect to improvement in abrasion resistance of a single-component yarn, in a polyamide, polyvinylidene fluoride or polypropylene monofilament for a fishline, a fishing net or a mower, a process is proposed wherein the abrasion resistance is improved by adding heat more than the melting point to a monofilament after stretching and accelerating the relax of orientation of the surface layer (Patent documents 5-9). However, this technology is a technology capable of being achieved by the condition where the polymer is a bendable polymer and therefore the time required for the relax of orientation (relax time) is short, and in case of rigid molecular chain such as that of a liquid crystalline polyester, the relax time becomes long, there is a problem that the inner layer is also molten within the relax time for the surface layer and the fiber is molten. Moreover, as the single-fiber fineness becomes smaller, the influence due to the heat treatment reaches a central portion of the fiber, and therefore, there is a problem that it is difficult to achieve both of sufficient strength and abrasion resistance.

Further, a technology is proposed wherein, after a liquid crystalline polyester fiber is heated and cured at a temperature lower than the melting point (solid phase polymerization), it is stretched at 10% to 400% within a range of 50° C. from the curing temperature to increase the strength and the elastic modulus (Patent document 10). However, this technology aims to further enhance the orientation of the molecular chain by stretching at a temperature capable of maintaining the crystallinity and to increase the strength and the elastic modulus, and because the fiber structure is high in degree of crystallization and high in orientation of molecular chain, the abrasion resistance cannot be improved. Where, in this technology, although the relationship between the stretching temperature and the melting point of the liquid crystalline polyester fiber served to the stretching is shown only in its Examples 3 and 4, the stretching temperature is lower than the melting point of the liquid crystalline polyester fiber, and an advantage by heating a solid phase polymerized liquid crystalline polyester fiber up to the melting point or higher is not suggested at all.

Furthermore, a process is proposed wherein, in order to increase the abrasion resistance of a liquid crystalline polyester fiber, polysiloxane and/or fluorine-group resin are adhered to the fiber surface and dried at 100° C.-300° C. or calcined by heating at 350° C. or higher (Patent document 11). In this technology, however, although a high-temperature treatment is carried out for drying or calcination, this is a treatment for making the adhered polysiloxane and/or fluorine-group resin hard to be left, there is no description on the relationship with the melting point of the liquid crystalline polyester fiber to be treated, and it is not a process for improving the abrasion resistance of the fiber itself by change of the structure.

On the other hand, with respect to giving a liquid crystalline polyester a small fineness, there are two problems of a problem originating from solid phase polymerization and a problem originating from spinning. The problem originating from solid phase polymerization means a problem that, because the specific surface area increases accompanying with making the single-fiber fineness smaller in the solid phase polymerization at a package condition, the contact points between single fibers increase, fusion is liable to occur, and defects increase. The problem originating from spinning means a problem of a poor fiber formation property or an abnormal fineness due to decomposition or deterioration accompanying with increase of residence time in a spinning machine when the discharge amount is decreased, or a problem of a poor fiber formation property or an abnormal fineness due to an instability of forming fiber when the spinning speed is increased.

With respect to suppressing fusion at solid phase polymerization, Patent document 12 proposes a process for heat treating a package wound at a winding density of 0.16-0.5 g/cc. By this, a fusion can be avoided to some extent, but in case of treating a fiber with a low total fineness, the affection due to the fusion cannot be solved. Further, although Patent document 13 describes to control the winding density at the time of solid phase polymerization of a liquid crystalline polyester monofilament with a total fineness of 50 denier (55.5 dtex) or more at 0.3 g/cc or more, it does not describe as to fusion at the time of solid phase polymerization though the reaction efficiency for the polymerization is described.

By the way, with respect to making a modified liquid crystalline polyester fiber, a technology is proposed wherein a liquid crystalline polyester with a specified composition is used, and a high strength can be achieved without solid phase polymerization by melt spinning using a nozzle whose introduction section is formed to be taper (Patent document 14). However, the fineness achieved in this technology is 19 dtex at smallest, and a small fineness for the liquid crystalline polyester with a specified composition cannot be achieved. Further, in this technology, although the strength is high, there is a problem that the thermal dimensional stability and the elastic modulus are poor because solid phase polymerization is not carried out. Further, because the flow line may become unstable by the taper nozzle used in the technology, the fiber formation stability is poor, and although a small amount of samples can be obtained, fiber formation for a long time is difficult, and in particular, when the spinning speed is increased that is important for making the fineness of the fiber smaller, the fiber formation property further deteriorates. Where, although an example having carried out solid phase polymerization is also disclosed in Patent document 12, the single-fiber fineness is 51 dtex and it is thick, and a technology for improving fusion in the solid phase polymerization when made the fiber fineness smaller is not suggested at all.

Non-Patent document 1: Edit by Technical Information Association, "Modification of Liquid Crystalline Polymer and Recent Applied Technology" 2006, pages 235-256

Patent document 1: JP-A-1-229815 (first page)
Patent document 2: JP-A-2003-239137 (first page)
Patent document 3: JP-A-2007-119976 (first page)
Patent document 4: JP-A-2007-119977 (first page)
Patent document 5: JP-A-60-231815 (first page)
Patent document 6: JP-A-61-152810 (first page)
Patent document 7: JP-A-61-170310 (first page)
Patent document 8: JP-A-5-148707 (first page)
Patent document 9: JP-A-8-158151 (first page)
Patent document 10: JP-A-50-43223 (second page)
Patent document 11: JP-A-11-269737 (third page)
Patent document 12: JP-A-61-225312 (first page)
Patent document 13: JP-A-4-333616 (fourth page)
Patent document 14: JP-A-2006-89903 (first page)

DISCLOSURE OF THE INVENTION

Problems to be Solved by the Invention

An object of the present invention is to improve weavability and quality of fabric without impairing the features of a fabric comprising a liquid crystalline polyester fiber carried out with solid phase polymerization that are high in strength and elastic modulus and excellent in thermal resistance, and for this, to provide a liquid crystalline polyester fiber excellent in abrasion resistance and uniformity in the lengthwise direction and small in single-fiber fineness, and an efficient process for production of the same.

Means for Solving the Problems

The inventors of the present invention have found to be able to solve the above-described problems and in particular to achieve an excellent abrasion resistance by applying a heat treatment at a specified condition to a liquid crystalline polyester fiber carried out with solid phase polymerization to reduce the crystallinity while maintaining the fiber orientation. Further, it has been found to be able to solve the above-described problems and in particular to achieve to make the single-fiber fineness smaller and to improve the uniformity in the lengthwise direction by improving the fiber formation condition such as a condition of solid phase polymerization. Namely, the present invention is summarized as follows.

In particular, the inventors of the present invention have found to be able to solve the above-described problems by using a liquid crystalline polyester with a specified composition, and after carrying out spinning and solid phase polymerization, further applying a heat treatment at a specified condition to reduce the crystallinity while maintaining the fiber orientation.

A first invention of the present invention is a liquid crystalline polyester fiber excellent particularly in abrasion resistance wherein a half width of endothermic peak (Tm1) observed when measured under a condition of heating from 50° C. at a temperature elevation rate of 20° C./min in differential calorimetry is 15° C. or above and a strength is 12.0 cN/dtex or more.

A second invention of the present invention is a process for producing a liquid crystalline polyester fiber excellent particularly in abrasion resistance characterized by heat treating a liquid crystalline polyester fiber at a temperature of endothermic peak (Tm1)+10° C. or more, the temperature of endothermic peak (Tm1) being observed when measured under a condition of heating from 50° C. at a temperature elevation rate of 20° C./min in differential calorimetry.

A third invention of the present invention is a liquid crystalline polyester fiber characterized in that the fiber comprises a liquid crystalline polyester comprising the following structural units (I), (II), (III), (IV) and (V), and satisfies the following conditions 1 to 4.

[Chemical formula 1]

(I)

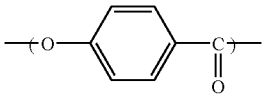

(II)

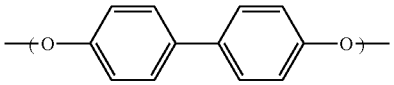

(III)

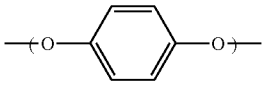

(IV)

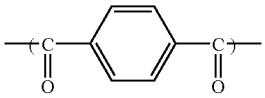

(V)

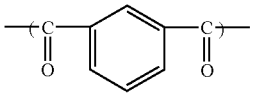

Condition 1: a weight average molecular weight of the liquid crystalline polyester fiber determined through a polystyrene-equivalent weight average molecular weight is in a range of 250,000 or more and 1,500,000 or less.

Condition 2: a heat of melting (ΔHm1), at an endothermic peak (Tm1) observed when measured under a condition of heating from 50° C. at a temperature elevation rate of 20° C./min in differential calorimetry, is 5.0 J/g or more.

Condition 3: a single-fiber fineness is 18.0 dtex or less.

Condition 4: a strength is 13.0 cN/dtex or more.

A fourth invention of the present invention is a process for producing a liquid crystalline polyester fiber characterized in that, after a liquid crystalline polyester melt spun fiber is prepared by melt spinning a liquid crystalline polyester, a liquid crystalline polyester melt spun fiber with a total fineness of 1 dtex or more and 500 dtex or less is formed on a bobbin as a fiber package with a winding density of 0.01 g/cc or more and 0.30 g/cc or less, and the package is heat treated.

Effect According to the Invention

In the liquid crystalline polyester fiber and the process for production of the same according to the present invention, since a liquid crystalline polyester fiber having features of the liquid crystalline polyester fiber carried out with solid phase polymerization that are high in strength and elastic modulus and excellent in thermal resistance, and being excellent in abrasion resistance and uniformity in the lengthwise direction and small in single-fiber fineness, can be obtained, the fiber can be used suitably for use required particularly with an abrasion resistance, and for other than this, because the fiber is excellent in process passing-through property at a fiber higher-order processing process such as weaving or knitting and it is possible to make the weave density higher, decrease the thickness of fabric and improve the weavability and the quality of fabric, particularly for uses of a filter and a screen gauze required with a high-mesh fabric, it can be achieved to make the weave density higher (to make the mesh higher), decrease the thickness of the gauze, make the opening have a large area, decrease the defects at openings and improve the weavability for improving the performance.

THE BEST MODE FOR CARRYING OUT THE INVENTION

Hereinafter, a liquid crystalline polyester fiber excellent particularly in abrasion resistance, that is a first invention of the present invention, will be explained in detail.

The liquid crystalline polyester used in the present invention means a polyester capable of forming an anisotropic melting phase (liquid crystallinity) when molten. This property can be recognized, for example, by placing a sample of a liquid crystalline polyester on a hot stage, heating it in a nitrogen atmosphere, and observing a transmitted light of the sample under a polarized radiation.

As the liquid crystalline polyester used in the present invention, although exemplified are a) a polymer of an aromatic oxycarboxylic acid, b) a polymer prepared from an aromatic dicarboxylic acid, an aromatic diol and an aliphatic diol, c) a copolymer of a) and b), etc., a wholly aromatic polyester, which does not use an aliphatic diol, is preferred for achieving high strength, high elastic modulus and high thermal resistance. Here, as the aromatic oxycarboxylic acid, hydroxy benzoic acid, hydroxy naphthoic acid, etc., or alkyl, alkoxy or halogen substitution product of the above-described aromatic oxycarboxylic acid can be exemplified. Further, as the aromatic dicarboxylic acid, terephthalic acid, isophthalic acid, diphenyl dicarboxylic acid, naphthalene dicarboxylic acid, diphenylether dicarboxylic acid, diphenoxyethane dicarboxylic acid, diphenylethane dicarboxylic acid, etc., or alkyl, alkoxy or halogen substitution product of the above-described aromatic dicarboxylic acid can be exemplified. Furthermore, as the aromatic diol, hydroquinone, resorcinol, dioxydiphenyl, naphthalene diol, etc., or alkyl, alkoxy or halogen substitution product of the above-described aromatic diol can be exemplified, and as the aliphatic diol, ethylene glycol, propylene glycol, butane diol, neopentyl glycol, etc. can be exemplified.

As a preferred liquid crystalline polyester used in the present invention, a copolymer of p-hydroxy benzoic acid component, 4,4'-dihydroxy biphenyl component, hydroquinone component, terephthalic acid component and/or isophthalic acid component, a copolymer of p-hydroxy benzoic acid component and 6-hydroxy 2-naphthoic acid component, a copolymer of p-hydroxy benzoic acid component, 6-hydroxy 2-naphthoic acid component, hydroquinone component and terephthalic acid component, etc. can be exemplified.

In the present invention, in particular, it is preferred that the liquid crystalline polyester comprises the following structural units (I), (II), (III), (IV) and (V).

[Chemical formula 2]

(I)

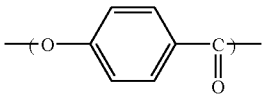

(II)

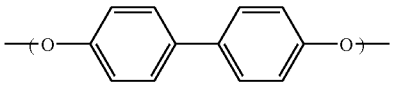

(III)

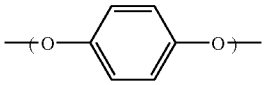

(IV)

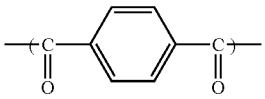

(V)

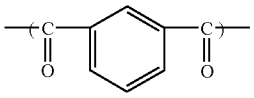

By this combination, the molecular chain has an adequate crystallinity and a non-linearity, namely, a melting point capable of being melt spun. Therefore, a good fiber formation property can be exhibited at a spinning temperature set between the melting point and the thermal decomposition temperature of the polymer, a fiber uniform in the lengthwise direction can be obtained, and because of an appropriate crystallinity, the strength and elastic modulus of the fiber can be increased.

Moreover, it is important to combine components of diols with a high linearity and a small bulk such as structural units (II) and (III), and by combining these components, the molecular chain in the fiber can have an orderly structure with less disorder and an interaction in a direction perpendicular to the fiber axis can be maintained because the crystallinity is not increased excessively. By this, in addition to obtain high strength and elastic modulus, a particularly excellent abrasion resistance can be obtained by carrying out a heat treatment.

Further, the above-described structural unit (I) is preferably present at 40 to 85 mol % relative to the sum of the structural units (I), (II) and (III), more preferably at 65 to 80 mol %, further preferably at 68 to 75 mol %. By control in such a range, the crystallinity can be controlled in an adequate range, high strength and elastic modulus can be obtained, and the melting point can be controlled in a range capable of performing a melt spinning.

The structural unit (II) is preferably present at 60 to 90 mol % relative to the sum of the structural units (II) and (III), more preferably at 60 to 80 mol %, further preferably at 65 to 75 mol %. By control in such a range, since the crystallinity does not increase excessively and the interaction in a direction perpendicular to the fiber axis can be maintained, an excellent abrasion resistance can be obtained, and the abrasion resistance can be further improved by carrying out a heat treatment.

The structural unit (IV) is preferably present at 40 to 95 mol % relative to the sum of the structural units (IV) and (V), more preferably at 50 to 90 mol %, further preferably at 60 to 85 mol %. By control in such a range, the melting point of the polymer can be controlled in an adequate range, a good fiber formation property can be exhibited at a spinning temperature set between the melting point and the thermal decomposition temperature of the polymer, a fiber small in single-fiber fineness and uniform in the lengthwise direction can be obtained.

Preferred ranges of the respective structural units of the liquid crystalline polyester used in the present invention are as follows. The liquid crystalline polyester fiber according to the present invention can be suitably obtained by controlling the composition in these ranges so as to satisfy the above-described condition.

Structural unit (I): 45-65 mol %
Structural unit (II): 12-18 mol %
Structural unit (III): 3-10 mol %
Structural unit (IV): 5-20 mol %
Structural unit (V): 2-15 mol %

Where, in the liquid crystalline polyester used in the present invention, except the above-described structural units, may be copolymerized aromatic dicarboxylic acid such as 3,3'-diphenyl dicarboxylic acid or 2,2'-diphenyl dicarboxylic acid, aliphatic dicarboxylic acid such as adipic acid, azelaic acid, sebacic acid or dodecanedionic acid, alicyclic dicarboxylic acid such as hexahydro terephthalic acid (1,4-cyclohexane dicarboxylic acid), aromatic diol such as chloro hydroquinone, 4,4'-dihydroxy phenylsulfone, 4,4'-dihydroxy diphenylsulfide or 4,4'-dihydroxy benzophenone, and p-aminophenol etc. in a range of about 5 mol % or less that does not impair the advantages according to the present invention.

Further, in a range of about 5 wt % or less that does not impair the advantages according to the present invention, another polymer may be added, such as a polyester, a vinyl-group polymer such as a polyolefine or a polystyrene, a polycarbonate, a polyamide, a polyimide, a polyphenylene sulfide, a polyphenylene oxide, a polysulfone, an aromatic polyketone, an aliphatic polyketone, a semi-aromatic polyester amide, a polyetheretherketone, or a fluoro resin, and as suitable examples, can be exemplified polyphenylene sulfide, polyetheretherketone, nylon 6, nylon 66, nylon 46, nylon 6T, nylon 9T, polyethylene terephthalate, polypropylene terephthalate, polybutylene terephthalate, polyethylene naphthalate, polycyclohexane dimethanol terephthalate, polyester 99M, etc. Where, in case where these polymers are added, the melting point thereof is preferably set within the melting point of the liquid crystalline polyester±30° C., in order not to impair the fiber formation property.

Furthermore, in a range that does not impair the advantages according to the present invention, a small amount of various additives may be contained, such as an inorganic substance such as various metal oxides, kaoline and silica, a colorant, a delustering agent, a flame retardant, an anti-oxidant, an ultraviolet ray absorbent, an infrared ray absorbent, a crystalline nucleus agent, a fluorescent whitening agent, an end group closing agent, a compatibility providing agent, etc.

It is preferred that the weight average molecular weight of the fiber according to the present invention determined through a polystyrene-equivalent weight average molecular weight (hereinafter, referred to as merely "a molecular weight") is in a range of 250,000 or more and 1,500,000 or less. By having a high molecular weight of 250,000 or more, high strength, elastic modulus, elongation and abrasion resistance are given. Because the strength, elastic modulus, elongation and abrasion resistance are increased as the molecular weight becomes higher, it is preferably 300,000 or more, and more preferably 350,000 or more. Although the upper limit of the molecular weight is not particularly limited, an upper limit capable of being achieved in the present invention is about 1,500,000. Where, the molecular weight called in the present invention means a value determined by the method described in the Example.

In the fiber according to the present invention, a half width of endothermic peak (Tm1) observed when measured under a condition of heating from 50° C. at a temperature elevation rate of 20° C./min in differential calorimetry is 15° C. or above, and preferably 20° C. or above. Tm1 in this determination method represents a melting point of fiber, and the wider the area of the peak shape is, that is, the greater the heat of melting (ΔHm1) is, the higher the degree of crystallization is, and the smaller the half width is, the higher the completion of crystallinity is. In the liquid crystalline polyester, by carrying out solid phase polymerization after spinning, Tm1 elevates, ΔHm1 increases and the half width decreases, and by increasing the degree of crystallization and the completion of crystallinity, the strength and elastic modulus of the fiber are increased and the thermal resistance thereof is improved. On the other hand, although the abrasion resistance deteriorates, this is considered because a difference in structure between the crystal part and the amorphous part becomes remarkable by increase of the completion of crystallinity and therefore a destruction occurs in the interface therebetween. Accordingly, in the present invention, the completion of crystallinity is decreased by increasing the half width of the peak up to a value of 15° C. such as one of a liquid crystalline polyester fiber which is not carried out with solid phase polymerization while maintaining a high Tm1 and high strength, elastic modulus and thermal resistance that are the features of a fiber carried out with solid phase polymerization, and the abrasion resistance can be improved by softening the whole of the fiber and decreasing the difference in structure between the crystal/amorphous parts which becomes a trigger of the destruction. Where, although the upper limit of the peak half width at Tm1 in the present invention is not particularly restricted, an upper limit capable of being achieved industrially is about 80° C.

Where, in the liquid crystalline polyester fiber according to the present invention, although the endothermic peak is one peak, depending upon the fiber structure such as a case of insufficient solid phase polymerization, there may be a case where two or more peaks are observed. In such a case, the half width of peak is determined as a value of the sum of the half widths of the respective peaks.

Further, in the fiber according to the present invention, it is preferred that an exothermic peak substantially is not observed when measured in differential calorimetry under a condition of heating from 50° C. at a temperature elevation rate of 20° C./min. The "an exothermic peak substantially is not observed" means a peak of an exothermic amount of 3.0 J/g or more, preferably 1.0 J/g or more, further preferably 0.5 J/g or more, is not observed, and a fine or mild fluctuation is not deemed to be a peak. Although an exothermic peak is observed in case where a crystalline polymer is contained in a fiber at an amorphous state, by non-observation of exothermic peak, the fiber can sufficiently exhibit the characteristics of a liquid crystalline polyester, and the fiber is excellent in strength, elastic modulus and thermal resistance and particularly in thermal dimensional stability.

The melting point (Tm1) of the fiber according to the present invention is preferably 290° C. or higher, more preferably 300° C. or higher, and further preferably 310° C. or higher. By having such a high melting point, the thermal resistance as the fiber is excellent. Although there is a process for forming a liquid crystalline polyester with a high melting point as a fiber, etc. in order to achieve a high melting point of fiber, especially in order to obtain a fiber high in strength and elastic modulus and further excellent in uniformity in the lengthwise direction, it is preferred to polymerize at solid phase a fiber melt spun. Where, although the upper limit of the melting point is not particularly limited, an upper limit capable of being achieved in the present invention is about 400° C.

Further, although the absolute value of the heat of melting ΔHm1 varies depending upon the composition of the structural unit of the liquid crystalline polyester, it is preferably 6.0 J/g or less. By decreasing the ΔHm1 down to 6.0 J/g or less, the degree of crystallization reduces, and the whole of the fiber is softened, and by softening the whole of the fiber and decreasing the difference in structure between the crystal/amorphous parts which becomes a trigger of the destruction, the abrasion resistance increases. Because the abrasion resistance increases as the ΔHm1 is lower, it is more preferably 5.0 J/g or less, and further preferably less than 5.0 J/g. Where, although the lower limit of the ΔHm1 is not particularly limited, it is preferably 0.5 J/g or more in order to obtain high strength and elastic modulus, more preferably 1.0 J/g or more, further preferably 2.0 J/g or more, and particularly preferably 3.0 J/g or more.

It is surprising that the ΔHm1 is low to be 6.0 J/g or less in spite of the high molecular weight of 250,000 or more. Because the liquid crystalline polyester with a molecular weight of 250,000 or more is remarkably high in viscosity and is not fluidized and is difficult in melt spinning even if it exceeds the melting point, a liquid crystalline polyester fiber with such a high molecular weight can be obtained by melt spinning a liquid crystalline polyester with a low molecular weight and serving this fiber to solid phase polymerization. When the liquid crystalline polyester fiber is served to solid phase polymerization, the molecular weight increases, the strength, elastic modulus and thermal resistance increase, and at the same time, the degree of crystallization also increases and the ΔHm1 increases. Although the strength, elastic modulus and thermal resistance further increase if the degree of crystallization increases, the difference in structure between the crystal part and the amorphous part becomes remarkable, the interface therebetween is liable to be destroyed, and the abrasion resistance decreases. On the other hand, in the present invention, the high strength, elastic modulus and thermal resistance can be maintained by having a high molecular weight that is a feature of a fiber carried out with solid phase polymerization, as well as the abrasion resistance can be increased by having a low degree of crystallization, that is, a low ΔHm1, such as that of a liquid crystalline polyester fiber which has not been carried out with solid phase polymerization.

As described in the item of conventional technologies, although it is well known that the abrasion resistance can be increased by combining a liquid crystalline polyester fiber and a bendable thermoplastic resin, there is a background that increase of an abrasion resistance of a liquid crystalline polyester itself has been difficult. In the present invention, however, there is a technical advance in the point having achieved that the fiber substantially comprising a liquid crystalline polyester only is improved in abrasion resistance by changing the structure, namely, decreasing the degree of crystallization.

Although the process for production thereof is not particularly limited as long as such a fiber structure can be achieved, in order to uniformize the structure and improve the productivity, it is preferred that a liquid crystalline polyester fiber carried out with solid phase polymerization as described later is heat treated at a temperature of Tm1 of the liquid crystalline polyester fiber plus 10° C. or higher while being run continuously.

In the fiber according to the present invention, it is preferred that, after an endothermic peak (Tm1) is observed when measured under a condition of heating from 50° C. at a temperature elevation rate of 20° C./min in differential calorimetry, a heat of crystallization (ΔHc) at an exothermic peak (Tc) observed when once cooled down to 50° C. under a condition of a temperature lowering rate of 20° C./min after maintained for five minutes at a temperature of Tm1+20° C. is 1.0 times or more relative to a heat of melting (ΔHm2) at an endothermic peak (Tm2) observed when measured under a condition of heating again at a temperature elevation rate of 20° C./min after cooled down to 50° C., and more preferably 2.0 times or more, further preferably 3.0 times or more. Although the ΔHc in this measurement exhibits a cold crystallization behavior after the fiber is molten, in particular, in a liquid crystalline polyester fiber carried out with solid phase polymerization, because the molecular weight has been increased and the crystallinity and the degree of crystallization have been increased, it is difficult that the molecular chain becomes completely random even after molten. Therefore, the fiber carried out with solid phase polymerization is likely to be crystallized in a cooling step, and the ΔHc becomes great. On the other hand, the ΔHm2 is a peak of melting at a highest temperature after the crystal produced in the cooling step is repeated with melting and re-crystallization, and if the composition is same, the influence due to the molecular weight, crystallinity and degree of crystallization is small. Therefore, in case where the ΔHc is great to be 1.0 times or more relative to the ΔHm2, the fiber is sufficiently great in molecular weight, and high in crystallinity and degree of crystallization, and high strength and elastic modulus can be exhibited. Where, if the ratio of the ΔHc to the ΔHm2 is excessively high, the crystallinity and degree of crystallization are increased too much, and because increase of abrasion resistance becomes difficult, it is preferably 5.0 times or less.

Although the Tc of the fiber according to the present invention varies depending upon the composition, in order to increase the thermal resistance, it is preferably 240° C. or higher and 400° C. or lower, more preferably 250° C. or higher and 400° C. or lower, further preferably 260° C. or higher and 300° C. or lower. If ΔHc is too low, the strength and elastic modulus decrease because of reduction of crystallinity and degree of crystallization, and if it is too high, the crystallinity becomes too high and it becomes difficult to improve the abrasion resistance, and therefore, it is preferably 2.0 J/g or more and 5.0 J/g or less, more preferably 3.0 J/g or more and 5.0 J/g or less. Where, in the liquid crystalline polyester fiber according to the present invention, although the exothermic peak at the time of cooling under the above-described measurement condition is one peak, there is a case where two or more peaks are observed depending upon the structural change due to the heat treatment after solid phase polymerization, etc. ΔHc in such a case is defined as a value of the sum of the ΔHc of the respective peaks.

Further, although Tm2 of the fiber according to the present invention varies depending upon the composition, in order to increase the thermal resistance, it is preferably 300° C. or higher, more preferably 310° C. or higher, further preferably 320° C. or higher. If ΔHm2 is excessively great, because the crystallinity becomes too high and it becomes difficult to increase the abrasion resistance, it is preferably 2.0 J/g or less, more preferably 1.5 J/g or less, and particularly preferably 1.0 J/g or less. Where, in the liquid crystalline polyester fiber according to the present invention, although the endothermic peak at the time of reheating after cooling under the above-described measurement condition is one peak, there is a case where two or more peaks are observed. ΔHm2 in such a case is defined as a value of the sum of the ΔHm2 of the respective peaks.

An important technology for further enhancing the advantages according to the present invention is to control the fiber structure so that the half width of the peak at Tm1 becomes 15° C. or higher and ΔHc becomes 1.0 times or more relative to Hm2. By controlling ΔHc at a value of 1.0 times or more relative to Hm2, strength, elastic modulus and thermal resistance similar to those in the fiber carried out with solid phase polymerization are provided, and by controlling the half width of the peak at Tm1 at 15° C. or higher, the completion of crystallization is reduced and the abrasion resistance can be improved.

The strength of the fiber according to the present invention is 12.0 cN/dtex or more, preferably 14.0 cN/dtex or more, more preferably 16.0 cN/dtex or more, and particularly preferably 18.0 cN/dtex or more. Although the upper limit of the strength is not particularly limited, an upper limit capable of being achieved in the present invention is about 30.0 cN/dtex. Where, the strength referred in the present invention indicates a tensile strength described in JISL1013:1999.

Further, the elastic modulus is preferably 500 cN/dtex or more, more preferably 600 cN/dtex or more, and further preferably 700 cN/dtex or more. Although the upper limit of the elastic modulus is not particularly limited, an upper limit of the elastic modulus capable of being achieved in the present invention is about 1200 cN/dtex. Where, the elastic modulus referred in the present invention indicates an initial tensile resistance degree described in JISL1013:1999.

The fiber according to the present invention can be suitably used in use for ropes, fibers for reinforcing members such as a tension member, meshes for screen printing, etc. because of the high strength and elastic modulus, and other than those, because a high tenacity can be exhibited even by a small fiber fineness, it can be achieved to make a fibrous material smaller in weight and thickness, and a yarn breakage in a high-order processing process such as weaving can also be suppressed. In the fiber according to the present invention, high strength and elastic modulus can be obtained by the condition where ΔHc is 1.0 times or more relative to ΔHm2.

It is preferred that the single-fiber fineness of the fiber according to the present invention is 18.0 dtex or less. By making the fiber thinner at a single-fiber fineness of 18.0 dtex or less, provided are advantages that the flexibility of the fiber increases and the processability of the fiber is improved, that the surface area increases and therefore the adhesion property thereof with chemicals such as an adhesive is improved, and in case of being formed as a gauze comprising monofilaments, that the thickness can be smallened, that the weave density can be increased, and that the opening (area of the opening portions) can be widened. The single-fiber fineness is more preferably 10.0 dtex or less, and further preferably 7.0 dtex or less. Where, although the lower limit of the single-fiber fineness is not particularly limited, a lower limit capable of being achieved in the present invention is about 1 dtex.

Further, the fluctuation rate of the fineness of the fiber according to the present invention is preferably 30% or less, more preferably 20% or less, further preferably 10% or less. The fluctuation rate of the fineness referred in the present invention indicates a value determined by the method described in the Example. By the fluctuation rate of the fineness at 30% or less, because the uniformity in the lengthwise direction is improved and the fluctuation of the tenacity of the fiber (product of strength and fineness) is also smallened, defects of a fiber product decrease, and in addition, because the fluctuation of the diameter also becomes smaller in case of monofilament, the uniformity of the opening (area of opening portion) when formed as a gauze is improved and the performance of the gauze can be improved.

Further, the fluctuation rate of the tenacity of the fiber according to the present invention is preferably 20% or less, more preferably 15% or less. The tenacity referred in the present invention indicates a strength at the time of breakage in the measurement of tensile strength described in JISL1013: 1999, and the fluctuation rate of the tenacity indicates a value determined by the method described in the Example. By the fluctuation rate of the tenacity at 20% or less, because the uniformity in the lengthwise direction is improved and the fluctuation of the tenacity of the fiber (product of strength and fineness) is also smallened, defects of a fiber product decrease, and in addition, because the fluctuation of the diameter also becomes smaller in case of monofilament, yarn breakage originating from a low strength portion in a high-order processing process can also be suppressed.

The elongation of the fiber according to the present invention is preferably 1.0% or more, more preferably 2.0% or more. By the elongation of 1.0% or more, the impact absorbability of the fiber is improved, the process passing-through property in a high-order processing process and the handling ability are excellent, and in addition, because the impact absorbability is improved, the abrasion resistance is also improved. Where, although the upper limit of the elongation is not particularly limited, an upper limit capable of being achieved in the present invention is about 10%.

The compression elastic modulus in a direction perpendicular to the fiber axis (hereinafter, referred to as "compression elastic modulus") of the fiber according to the present invention is preferably 0.30 GPa or less, more preferably 0.25 GPa or less. Although the liquid crystalline polyester fiber according to the present invention has high strength and elastic modulus in a tensile direction, by the low compression elastic modulus, when the fiber is pushed onto a guide or a reed in a high-order processing process or a weaving machine, an advantage for dispersing the load by enlarging the contact area can be exhibited. By this advantage, the pushing stress to the fiber is decreased, and the abrasion resistance is improved. Although the lower limit of the compression elastic modulus is not particularly limited, as long as it is 0.1 GPa or more, the fiber is not deformed by being pushed and the quality of the fiber is not impaired. Where, the compression elastic modulus referred in the present invention indicates a value determined by the method described in the Example.

The birefringence ($\Delta n$) of the fiber according to the present invention is preferably 0.250 or more and 0.450 or less, more preferably 0.300 or more and 0.400 or less. As long as the $\Delta n$ is in this range, the molecular orientation in the fiber axis direction is sufficiently high, and high strength and elastic modulus can be obtained.

In the fiber according to the present invention, a half width ($\Delta 2\theta$) of a peak observed in an equator line at $2\theta$=18 to 20° relative to the fiber axis in a wide angle X-ray diffraction is preferably 1.8° or more, more preferably 2.0° or more, and further preferably 2.2° or more. Although generally $\Delta 2\theta$ becomes greater accompanying with decrease of crystal size in a crystalline polymer, in a liquid crystalline polyester, because a stacking of phenylene ring gives a diffraction, it is considered that, if the contribution due to a disturbance of the stacking is great, the $\Delta 2\theta$ becomes greater. In a liquid crystalline polyester, the stacking structure is stabilized accompanying with solid phase polymerization and crystallization proceeds, and therefore, the $\Delta 2\theta$ decreases. By the great $\Delta 2\theta$ of 1.8° or more, the crystallinity is reduced and the whole of the fiber becomes flexible, and by reduction of the difference in structure between crystal/amorphous parts that becomes a trigger of breakage, the abrasion resistance is improved. Although the upper limit of the $\Delta 2\theta$ is not particularly limited, an upper limit capable of being achieved in the present invention is about 4.0°. Where, the $\Delta 2\theta$ referred in the present invention indicates a value determined by the method described in the Example.

It is preferred to apply an oil to adhere to the fiber obtained in the present invention in order to improve a flatness of surface and to improve a process passing-through property due to increase of the abrasion resistance, and the amount of oil adhesion is preferably 0.1 wt % or more relative to the weight of the fiber. Where, the amount of oil adhesion referred in the present invention indicates a value determined by the method described in the Example. The greater the oil is, the higher the advantage thereof is, and therefore, the amount is more preferably 0.5 wt % or more, further preferably 1.0 wt % or more. However, if the oil is too much, there occur problems such as a problem that the adhesive force between fibers increases and the running tension becomes unstable, and a problem that oil is accumulated on a guide and the like, the process passing-through property deteriorates and as the case may be, the oil is mixed in a product to cause defects, and therefore, the amount is preferably 10 wt % or less, more preferably 6 wt % or less, further preferably 4 wt % or less.

Further, although the kind of oil to adhere is not particularly restricted as long as it is generally used for a fiber, for a liquid crystalline polyester fiber, it is preferred to use at least a polysiloxane-group compound having both the advantages of fusion prevention in solid phase polymerization and improvement of surface flatness, and in particular, it is preferred to contain a polysiloxane-group compound with a liquid phase at a room temperature (so-called, silicone oil) which is easy to be applied to the fiber, particularly a polydimethylsiloxane-group compound suitable to water emulsification and low in environmental load. The determination whether the polysiloxane-group compound is contained is carried out in the present invention by the method described in the Example.

The abrasion resistance C of the fiber according to the present invention, that becomes an index of a strength relative to a scratch with a ceramic material, is preferably 10 times or more, more preferably 20 times or more. The abrasion resistance C referred in the present invention indicates a value determined by the method described in the Example. By the abrasion resistance C of 10 times or more, fibrillation of a liquid crystalline polyester fiber at a high-order processing process can be suppressed, and because accumulation of fibrils onto a guide and the like decreases, the cycle for cleaning or exchange can be lengthened, and in addition, in a gauze comprising monofilaments, can be suppressed a clogging of an opening due to fibrils being woven into the gauze.

Furthermore, in the fiber obtained in the present invention, the abrasion resistance M, that becomes an index of a strength against a scratch with a metal material, is preferably 10 seconds or more, more preferably 15 seconds or more, further preferably 20 seconds or more, and particularly preferably 30 seconds or more. The abrasion resistance M referred in the present invention indicates a value determined by the method described in the Example. By the abrasion resistance M of 10 seconds or more, fibrillation of a liquid crystalline polyester fiber at a high-order processing process, particularly, caused by a scratch with a reed, can be suppressed, the process passing-through property can be improved, and in addition, because accumulation of fibrils onto a metal guide and the like decreases, the cycle for cleaning or exchange can be lengthened.

The fiber according to the present invention can employ a broad number of filaments. Although the upper limit of the number of filaments is not particularly limited, for making a fiber product thinner or lighter in weight, the number of filaments is preferably 50 or less, more preferably 20 or less. In particular, because a monofilament, whose filament number is one, is a field strongly required with small fiber fineness and uniformity of single-fiber fineness, the fiber according to the present invention can be used particularly suitably.

The liquid crystalline polyester fiber according to the present invention is improved in abrasion resistance while having the features of high strength, high elastic modulus and high thermal resistance, and it can be used broadly in uses such as materials for general industry, materials for civil engineering and construction, materials for sports, clothing for protection, materials for reinforcement of rubbers, electric materials (in particular, as tension members), acoustic materials, general clothing, etc. As effective uses, can be exemplified screen gauzes, filters, ropes, nets, fishing nets, computer ribbons, base fabrics for printed boards, canvases for paper machines, air bags, airships, base fabrics for domes, etc., rider suits, fishlines, various lines (lines for yachts, paragliders, balloons, kite yarns, etc.), blind cords, support cords for screens, various cords in automobiles or air planes, power transmission cords for electric equipment or robots, etc., and as a particularly effective use, monofilaments used in fabrics and the like for industrial materials can be exemplified, and in particular, it is most suitable for a monofilament for screen gauze for which a high strength, a high elastic modulus and small fineness are required and which needs an abrasion resistance for improving the weavability and the quality of fabric.

Next, a process for producing a liquid crystalline polyester fiber excellent particularly in abrasion resistance, which is a second invention of the present invention, concretely, a process for heat treating the liquid crystalline polyester fiber, will be explained in detail.

The liquid crystalline polyester used in the present invention means a polymer exhibiting an optical anisotropy (liquid crystallinity) when molten by heating, and it is similar to the liquid crystalline polyester aforementioned. Further, copolymerization of other components, addition of different kinds of polymers and use of additives may be employed as long as within a small amount that does not impair the feature of the present invention, as aforementioned.

It is preferred that the weight average molecular weight of the liquid crystalline polyester fiber served to the heat treatment according to the present invention, determined through a polystyrene-equivalent weight average molecular weight, is in a range of 250,000 or more and 1,500,000 or less. By having a high molecular weight of 250,000 or more, high strength, elongation and melting point are given, the running stability at the heat treatment is improved, yarn breakage can be suppressed, and in addition, even after the heat treatment, high strength, elastic modulus, elongation and abrasion resistance are maintained. Because the running stability at the heat treatment and the strength, elastic modulus, elongation and abrasion resistance after the heat treatment are increased as the molecular weight becomes higher, it is preferably 300,000 or more, and more preferably 350,000 or more. Although the upper limit of the molecular weight is not particularly limited, an upper limit capable of being achieved in the present invention is about 1,500,000. Where, the molecular weight called in the present invention means a value determined by the method described in the Example.

In the liquid crystalline polyester fiber served to the heat treatment, the endothermic peak (Tm1) observed when measured under a condition of heating from 50° C. at a temperature elevation rate of 20° C./min in differential calorimetry is preferably 300° C. or higher, more preferably 320° C. or higher. By having such a high melting point, even if the temperature of the heat treatment is elevated, an stable treatment becomes possible and the productivity can be improved, and in addition, the thermal resistance after the heat treatment is also improved. Where, if the melting point is too high, because the advantage due to the heat treatment becomes hard to be exhibited, it is preferably 400° C. or lower, more preferably 350° C. or lower.

Further, the heat of melting ΔHm1 at Tm1 is preferably 5.0 J/g or more, more preferably 6.0 J/g or more, and further preferably 7.0 J/g or more. Further, the half width of the peak at Tm1 is preferably less than 15° C. The crystallinity and the degree of crystallization are higher as the ΔHm1 is greater, and because the completion of crystallinity is higher and the strength and elastic modulus are higher as the half width of the peak at Tm1 is smaller, the tension at the heat treatment can be increased, the running stability is improved, and in addition, even in the fiber after the heat treatment, high strength and elastic modulus can be maintained. Where, although the upper limit of ΔHm1 is not particularly limited, an upper limit capable of being served to the present invention is about 20 J/g, and although the lower limit of the half width of the peak is not particularly limited, a lower limit capable of being served to the present invention is about 3° C.

Furthermore, the single-fiber fineness of the liquid crystalline polyester fiber served to the heat treatment is preferably 18.0 dtex or less. By the thin single-fiber fineness of 18.0 dtex or less, a more uniform heat treatment becomes possible in the cross section of the fiber, the structure in section can be uniformed and the fiber properties can be more enhanced, and in addition, various advantages can be obtained, such as that the flexibility of the fiber is increased and the processability of the fiber is improved, that the adhesive property with chemicals is increased because the surface area increases, and in addition to these features as fiber, in case where the fiber is made as a gauze comprising monofilaments, advantages can be obtained, such as that the thickness of the gauze can be made thinner, and that the weave density can be increased. The single-fiber fineness is more preferably 10.0 dtex or less, and further preferably 7.0 dtex or less. Where, although the lower limit is not particularly limited, a lower limit capable of being served to the present invention is about 1 dtex. As to the number of filaments, in order to enhance the uniformity of the treatment between filaments, it is preferably 50 or less, more preferably 20 or less. In particular, a monofilament, whose number of filaments is one, enables a uniform treatment, and the present invention can be applied thereto particularly suitably.

The strength of the liquid crystalline polyester fiber served to the heat treatment is preferably 14.0 cN/dtex or more, more preferably 18.0 cN/dtex or more, and further preferably 20.0 cN/dtex or more. Further, the elastic modulus is preferably 600 cN/dtex or more, more preferably 700 cN/dtex or more, and further preferably 800 cN/dtex or more. Where, the strength referred herein indicates a tensile strength described in JISL1013:1999 and the elastic modulus referred herein indicates an initial tensile resistance degree described therein. By such high strength and elastic modulus, the tension in the heat treatment can be increased and the running ability can be improved, and in addition, even in the fiber after heat treatment, high strength and elastic modulus can be maintained. Although the upper limits of the strength and elastic modulus are not particularly limited, upper limits capable of being served to the present invention are about 30 cN/dtex in strength and about 1200 cN/dtex in elastic modulus.

Further, the fluctuation rate of the fineness of the liquid crystalline polyester fiber served to the heat treatment is preferably 30% or less, more preferably 20% or less, further preferably 10% or less. Further, the fluctuation rate of the tenacity of the fiber is preferably 20% or less, more preferably 15% or less. Where, the tenacity referred herein indicates a strength at the time of breakage in the measurement of tensile strength described in JISL1013:1999, and the fluctuation rate of the fineness and the fluctuation rate of the tenacity indicate values determined by the methods described in the Example. By using the fiber with such small fluctuation rate of fineness and fluctuation rate of tenacity, irregularity of treatment and breakage by melting are reduced, and the temperature for the treatment can be elevated.

The compression elastic modulus in a direction perpendicular to the fiber axis of the fiber served to the heat treatment (hereinafter, referred to as "compression elastic modulus") is preferably 1.00 GPa or less, more preferably 0.50 GPa or less, and further preferably 0.35 GPa or less. Because the abrasion resistance is improved by a low compression elastic modulus, it is preferred that the compression elastic modulus of the fiber served to the heat treatment is low. Although the lower limit of the compression elastic modulus is not particularly limited, as long as it is 0.1 GPa or more, the fiber is not deformed by being pushed and the quality of the fiber is not impaired. Where, the compression elastic modulus referred in the present invention indicates a value determined by the method described in the Example.

The birefringence ($\Delta n$) of the fiber served to the heat treatment is preferably 0.250 or more and 0.450 or less, more preferably 0.300 or more and 0.400 or less. As long as the $\Delta n$ is in this range, the molecular orientation in the fiber axis direction is sufficiently high, and high strength and elastic modulus can be obtained.

In the fiber served to the heat treatment, a half width ($\Delta 2\theta$) of a peak observed in an equator line at $2\theta$=18 to 22° relative to the fiber axis in a wide angle X-ray diffraction is preferably less than 1.8°, more preferably 1.6° or less. Since the crystallinity is high and the strength and the elastic modulus are high by such a small $\Delta 2\theta$ of less than 1.8°, the process passing-through property and the running stability at the heat treatment are improved, and in addition, even in the fiber after the heat treatment, high strength and elastic modulus can be maintained, Although the upper limit of the $\Delta 2\theta$ is not particularly limited, a lower limit is about 0.8°. Where, the $\Delta 2\theta$ referred in the present invention indicates a value determined by the method described in the Example.

It is preferred to apply an oil to adhere to the fiber served to the heat treatment in order to improve a flatness of surface and to improve a process passing-through property due to increase of the abrasion resistance, and the amount of oil adhesion is preferably 0.1 wt % or more relative to the weight of the fiber. Where, the amount of oil adhesion referred in the present invention indicates a value determined by the method described in the Example. The greater the oil is, the higher the advantage thereof is, and therefore, the amount is more preferably 0.5 wt % or more, further preferably 1.0 wt % or more. However, if the oil is too much, there occur problems such as a problem that the adhesive force between fibers increases and the running tension becomes unstable and it causes breakage by melting, and a problem that oil is accumulated on a guide and the like and it causes a deterioration of process passing-through property, a deterioration of productivity by smoke generation during the heat treatment, etc., and therefore, the amount is preferably 10 wt % or less, more preferably 6 wt % or less, further preferably 4 wt % or less.

Further, although the kind of oil being adhered is not particularly restricted as long as it is generally used for a fiber, for a liquid crystalline polyester fiber, it is preferred to use at least a polysiloxane-group compound having both the advantages of fusion prevention in solid phase polymerization and improvement of surface flatness, and in particular, it is preferred to contain a polysiloxane-group compound with a liquid phase at a room temperature (so-called, silicone oil) which is easy to be applied to the fiber, particularly a polydimethylsiloxane-group compound suitable to water emulsification and low in environmental load. The determination whether the polysiloxane-group compound is contained is carried out in the present invention by the method described in the Example.

Although the process for producing a liquid crystalline polyester fiber to be served to the heat treatment is not particularly limited, in order to uniformize the structure and the properties in the lengthwise direction of the fiber (in particular, decrease of defects) and improve the productivity, it is preferred that, after melt spinning a liquid crystalline polyester described later, a fiber package with a low winding density is formed, and it is carried out with solid phase polymerization to produce the fiber.

In the present invention, with such a liquid crystalline polyester fiber, a heat treatment is carried out at a temperature of endothermic peak (Tm1)+10° C. or more, the temperature of endothermic peak (Tm1) being observed when measured under a condition of heating from 50° C. at a temperature elevation rate of 20° C./min in differential calorimetry. Where, the Tm1 referred herein indicates a value determined by the determination method described in the Example. Although the Tm1 is a melting point of the fiber, by carrying out the heat treatment to the liquid crystalline polyester fiber at a high temperature of the melting point+10° C. or higher, the abrasion resistance is greatly improved, and in case of a small single-fiber fineness, the advantage becomes remarkable.

As described in the item of background, in case of rigid molecular chain such as that of a liquid crystalline polyester, the relax time is long, within the relax time for the surface layer the inner layer is also molten, and the fiber is molten. Accordingly, as the result of investigating a technology for improving an abrasion resistance suitable for a liquid crystalline polyester, in case of liquid crystalline polyester, it has been found to be able to improve its abrasion resistance not by relaxing the molecular chain but by decreasing the degree of crystallization and the completion of crystallinity of the whole of the fiber by heating.

Furthermore, although it is necessary to heat the fiber up to a temperature of the melting point or higher in order to decrease the crystallinity, in case of a thermoplastic synthetic fiber, at such a high temperature, in particular, in case of a small single-fiber fineness, the strength and the elastic modulus decrease, and further, the fiber is thermally deformed and molten. Although such a behaviour is seen even in a liquid crystalline polyester, the inventors of the present invention have found that, in the liquid crystalline polyester fiber carried out with solid phase polymerization, because the relax time becomes very long by increase of the molecular weight, the molecular motility is low, and even if a heat treatment at a high temperature of the melting point or higher is carried out, if it is a short time, the degree of crystallization can be decreased while the molecular orientation is maintained, and decreases of the strength and the elastic modulus are small.

From these, as the result of investigating conditions of heat treatment particularly for a liquid crystalline polyester fiber with a small single-fiber fineness, it has been found that the abrasion resistance of the liquid crystalline polyester fiber can be improved without greatly impairing the strength, the elastic modulus and the thermal resistance by carrying out a heat treatment at Tm1+10° C. or higher in a short period of time.

By controlling the temperature for the heat treatment at a temperature of Tm1+10° C. or higher, the abrasion resistance of the fiber is improved. Because the abrasion resistance increases as the temperature of the heat treatment is higher, the treatment temperature is preferably Tm1+40° C. or higher, more preferably Tm1+60° C. or higher, further preferably Tm1+80° C. or higher. The upper limit of the treatment temperature is a temperature causing a melt breakage of the fiber, and although it depends upon tension, speed, single-fiber fineness and treatment length, it is about Tm1+300° C.

Where, although there is a case for carrying out a heat treatment for a liquid crystalline polyester fiber even in a conventional technology, it is generally carried out at a temperature lower than a melting point because the liquid crystalline polyester is thermally deformed (fluidized) by stress even at a temperature lower than the melting point. As the point of heat treatment, although there is a solid phase polymerization of a liquid crystalline polyester fiber, even in this case, if the treatment temperature is not set at a temperature lower than the melting point of the fiber, the fiber is fused and broken by being molten. In case of solid phase polymerization, although a final temperature of the solid phase polymerization may elevates up to a temperature higher than the melting point of the fiber before the treatment because the melting point of the fiber elevates accompanying with the treatment, even in such a case, the treatment temperature is lower than the melting point of the fiber being treated, that is, the melting point of the fiber after the heat treatment.

The heat treatment in the present invention increases the abrasion resistance by decreasing a structural difference between a dense crystal portion formed by a solid phase polymerization and an amorphous portion, namely, decreasing the degree of crystallization, without carrying out a solid phase polymerization. Therefore, even if Tm1 varies by the heat treatment, the temperature of the heat treatment is set preferably at a temperature of Tm1 of the fiber after being varied+10° C. or higher, more preferably at a temperature of the Tm1+40° C. or higher, further preferably at a temperature of the Tm1+60° C. or higher, and particularly preferably at a temperature of the Tm1+80° C. or higher.

Further, as another heat treatment, there is a heat stretching of a liquid crystalline polyester fiber, but the heat stretching is a process tensing the fiber at a high temperature, the orientation of molecular chain in the fiber structure becomes high, the strength and the elastic modulus increase, and the degree of crystallization and the completion of crystallinity are maintained as they are, namely, ΔHm1 is maintained to be high and the half width of the peak Tm1 is maintained to be small. Therefore, it becomes a fiber structure poor in abrasion resistance, and the treatment is different from the heat treatment in the present invention that aims to increase the abrasion resistance by decreasing the degree of crystallization (decreasing ΔHm1) and decreasing the completion of crystallinity (increasing the half width of the peak). Where, in the heat treatment in the present invention, because the degree of crystallization decreases, the strength and the elastic modulus are not increased.

As the heating method, although there are a method for heating the atmosphere and heating the fiber by heat transfer, a method for heating the fiber by radiation using a laser or an infrared ray, etc., heating by a slit heater using a plate heater is preferred because it has both advantages of atmosphere heating and radiation heating and it can enhance the stability for the treatment.

It is preferred to carry out the heat treatment while running the fiber continuously because fusion between fibers can be prevented and the uniformity of the treatment can be improved. At that time, in order to prevent occurrence of fibril and to perform a uniform treatment, a non-contact heat treatment is preferred. In case of using a liquid crystalline polyester fiber carried out with solid phase polymerization, the treatment may be carried out continuously while unwinding the fiber from a package, and in such a case, in order to prevent breakage of the form of the solid phase polymerized package due to unwinding, and further in order to suppress fibrillation at the time of delamination of a little fusion, it is preferred to unwind the yarn in a direction perpendicular to a rotation axis (fiber rounding direction) by so-called lateral unwinding, and further, the solid phase polymerized package is preferably rotated not by free rotation system but by positive driving because the tension of the yarn away from the package can be decreased and the fibrillation can be more suppressed. Where, the heat treatment may be carried out, after the fiber unwound is once wound, while unwinding the fiber again.

If the treatment time is short, the abrasion resistance is not improved, and therefore, it is preferably 0.01 second or longer, more preferably 0.1 second or longer. The upper limit of the treatment time is preferably 5.0 seconds or less, more preferably 2.0 seconds or less, in order to smallen the load to an apparatus, and further, because the molecular chain is relaxed and the strength and the elastic modulus decrease if the treatment time is too long.

If the tension of the fiber continuously treated is excessively high, a melt breakage due to heat is likely to occur, and in case where the heat treatment is carried out at a condition applied with an excessive tension, because the decrease of the degree of crystallization is small and the advantage for improving the abrasion resistance becomes low, it is preferred to control the tension as low as possible. In this point, it is explicitly different from a heat stretching. However, if the tension is low, the running of the fiber becomes unstable and the treatment becomes nonuniform, and therefore, it is preferably 0.001 cN/dtex or more and 1.0 cN/dtex or less, more preferably 0.01 cN/dtex or more and 0.5 cN/dtex or less, and further preferably 0.1 cN/dtex or more and 0.3 cN/dtex or less.

Further, in case of continuous heat treatment, although the tension is preferably as low as possible, stress and relax may be appropriately added. However, if the tension is too low, the running of the fiber becomes unstable and the treatment becomes nonuniform, and therefore, the relax is preferably 2% or less. Further, if the tension is too high, a melt breakage due to heat is likely to occur, and in case where the heat treatment is carried out at a condition applied with an excessive tension, because the decrease of the degree of crystallization is small and the advantage for improving the abrasion resistance becomes low, the stretching rate is preferably less than 10%, although it depends upon the temperature of the heat treatment. It is more preferably less than 5%, further preferably less than 3%.

As the treatment speed becomes greater, a high-temperature short-time treatment becomes possible and the advantage for improving the abrasion resistance increases, though depending upon the treatment length, and therefore, it is preferably 10 m/min or more, more preferably 50 m/min or more, further preferably 100 m/min or more. The upper limit of the treatment speed is about 1000 m/min from the viewpoint of running stability of the fiber.

With respect to the treatment length, though depending upon the heating method, in case of non-contact heating using a block and a plate heater, in order to carry out a uniform treatment, it is preferably 10 mm or more, more preferably 100 mm or more, further preferably 500 mm or more. Further, if the treatment length is excessively great, because a treatment irregularity and melt breakage of fiber occur ascribed to yarn swinging in the heater, it is preferably 3000 mm or less, more preferably 2000 mm or less, and further preferably 1000 mm or less.

It is a desirable embodiment that a process oil is added after carrying out the heat treatment. In the heat treatment, as aforementioned, because adhesion of excessive oil is not preferred, it is preferred to apply an oil to adhere the fiber served to the heat treatment at an amount corresponding to about a lower limit of necessary amount, and after the heat treatment, to apply an oil to the fiber at an amount for improving the process passing-through property for the following processes and further for improving the weavability in a weaving machine, form the viewpoint of improvement of productivity.

The characteristics of the fiber obtained by the heat treatment according to the present invention are similar to those in the liquid crystalline polyester fiber excellent particularly in abrasion resistance that is the first invention. Here, with respect to the fiber structural change due to the heat treatment according to the present invention will be described from the point of a difference between characteristics of fibers before and after heat treatment.

The heat treatment is a short-time heat treatment performed at a high temperature of the melting point of the fiber or higher, and by the treatment, the degree of crystallization decreases but the orientation is not relaxed. This is shown in the structural change wherein, by the heat treatment, ΔHm1 decreases and the half width at Tm1 increases, but Δn almost does not change. Further, because the treatment time is short, the molecular weight does not change. The decrease of the degree of crystallization generally causes a great reduction of mechanical properties, and even in the heat treatment of the present invention, although the strength and the elastic modulus decrease without increasing, because the high molecular weight and orientation are maintained in the process according to the present invention, high strength and elastic modulus are maintained, and a high melting point (Tm1), that is, a high thermal resistance, can be maintained. Further, the compression property decreases by the heat treatment. Although the increase of the abrasion resistance is caused by the state where the whole of the fiber is softened by the decrease of the crystallinity and the structural difference between crystal/amorphous parts, which becomes a trigger of breakage, decreases, by a load dispersion effect due to the decrease of the compression property, the abrasion resistance is further increased.

Therefore, in the heat treatment of the present invention, it is preferred not to increase the strength and the elastic modulus between before and after the heat treatment. In case where such a heat treatment for increasing the strength and the elastic modulus is carried out, it causes a fiber structure wherein the degree of crystallization increases or reduction thereof is small, or a rigid molecular chain is further oriented in the fiber axis direction, and it is weak in a direction perpendicular to the fiber axis and it easily causes a fibrillation, and therefore, the strength and the elastic modulus preferably are not increased.

Furthermore, in the liquid crystalline polyester fiber according to the present invention, a reduction rate of heat of melting, that is calculated from the ΔHm1 of the fiber before being served to the heat treatment and the ΔHm1 of the fiber obtained by the heat treatment, is preferably 30% or more, more preferably 35% or more, further preferably 40% or more, and particularly preferably 50% or more. Where, the reduction rate of heat of melting referred herein indicates a value determined by the method described in the Example.

Next, the liquid crystalline polyester fiber, that is the third invention of the present invention and excellent in strength, elastic modulus, thermal resistance, uniformity in the lengthwise direction and abrasion resistance, and in particular, whose fineness is small, concretely, the liquid crystalline polyester fiber carried with solid phase polymerization, will be explained in detail.

The liquid crystalline polyester used for the fiber according to the present invention is a polyester capable of forming anisotropic melting phase at the time of being molten, and comprises the following structural units (I), (II), (III), (IV) and (V). Where, the structural unit referred in the present invention indicates a unit capable of forming a repeated structure in a main chain of a polymer.

[Chemical formula 3]

(I)

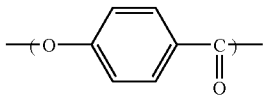

(II)

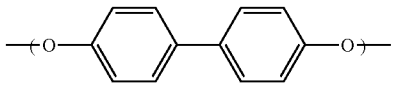

(III)

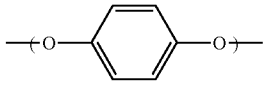

(IV)

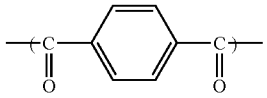

(V)

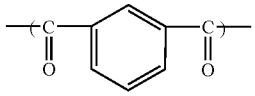

The important technology in the present invention is combination of these 5 components. As described in the first invention, by combining these 5 components, the molecular chain in the fiber can have an orderly structure with less disorder and an interaction in a direction perpendicular to the fiber axis can be maintained because the crystallinity is not increased excessively. By this, in addition to obtain high strength and elastic modulus, an excellent abrasion resistance can also be obtained. Where, preferable rates of the respective structural units are as aforementioned. Further, copolymerization of other components, addition of other kinds of polymers and use of additives are also as aforementioned, and they may be added at a small amount as long as the object of the present invention is not impaired.

The weight average molecular weight of the liquid crystalline polyester fiber according to the present invention determined through a polystyrene-equivalent weight average molecular weight (hereinafter, referred to as merely "a molecular weight") is 250,000 or more and 1,500,000 or less. By having a high molecular weight of 250,000 or more, high strength, elongation and elastic modulus are given, and the performance of a fabric is improved, and in addition, particularly when made at a small fineness, the impact absorption property increases and yarn breakage at a high-order process can be suppressed, and the abrasion resistance is also improved. Because these properties are increased as the molecular weight becomes higher, it is preferably 300,000 or more, and more preferably 350,000 or more. Although the upper limit of the molecular weight is not particularly limited, an upper limit capable of being achieved in the present invention is about 1,500,000. Where, the molecular weight referred in the present invention means a value determined by the method described in the Example.

In the fiber according to the present invention, the heat of melting (ΔHm1) at the endothermic peak (Tm1) observed when measured under a condition of heating from 50° C. at a temperature elevation rate of 20° C./min in differential calorimetry is 5.0 J/g or more, preferably 6.0 J/g or more, and more preferably 7.0 J/g or more. The ΔHm1 represents the degree of crystallization of the fiber, and the greater the ΔHm1 is, the higher the degree of crystallization is, the strength and elastic modulus of the fiber are increased and the thermal resistance is improved, and therefore, the mechanical properties and the thermal resistance when made as a product such as a fabric can be increased, and in particular, the process passing-through property when made in small fiber fineness can be improved. Although the upper limit of ΔHm1 is not particularly limited, an upper limit capable of being achieved in the present invention is about 20 J/g.

In the fiber according to the present invention, the peak half width at Tm1 is preferably 15° C. or less, more preferably 13° C. or less. The peak half width in this measurement represents completion of crystallinity, and the smaller the half width is, the higher the completion of crystallinity is. By the high completion of crystallinity, the strength and elastic modulus of the fiber are increased and the thermal resistance is improved, the mechanical properties and the thermal resistance when made as a product such as a fabric can be increased, and in particular, the process passing-through property when made in small fiber fineness can be improved. Although the lower limit of the peak half width also is not particularly limited, a lower limit capable of being achieved in the present invention is about 3° C.

In the fiber according to the present invention, it is preferred that the heat of melting (ΔHm1) at the endothermic peak (Tm1) observed when measured under a condition of heating from 50° C. at a temperature elevation rate of 20° C./min in differential calorimetry is 3.0 times or more relative to a heat of melting (ΔHm2) at an endothermic peak (Tm2) observed when measured under a condition of heating again at a temperature elevation rate of 20° C./min after once cooled down to 50° C. under a condition of a temperature lowering rate of 20° C./min after maintained for five minutes at a temperature of Tm1+20° C. after observation of Tm1, and more preferably 4.0 times or more, further preferably 6.0 times or more.

In this measurement, the ΔHm1 represents a degree of crystallization of the fiber, and the ΔHm2 represents a degree of crystallization at a re-temperature elevation step after the liquid crystalline polyester forming the fiber is once molten and thereafter solidified by cooling. By the condition where the ΔHm1 is 3.0 times or more relative to the ΔHm2, the degree of crystallization of the fiber becomes sufficiently high, and high strength and elastic modulus can be obtained, However, if the degree of crystallization is excessively high, because the toughness of the fiber is impaired and the processability is deteriorated, the ΔHm1 is preferably 15.0 times or less relative to the ΔHm2. Where, in the liquid crystalline polyester fiber according to the present invention, although the endothermic peak at each of the times of temperature elevation and temperature re-elevation is one, depending upon the structural change due to the condition of solid phase polymerization, etc., there is a case where two or more peaks are observed. In this case, the ΔHm1 is referred as a value of the sum of heat of melting of all endothermic peaks at the temperature elevation step, and the ΔHm2 is referred as a value of the sum of heat of melting of all endothermic peaks at the temperature re-elevation step. In order to control the ΔHm1 in the above-described range, it is preferred to solid phase polymerize the fiber melt spun from the viewpoint of productivity, and further, in order to improve the productivity, it is more preferred to solid phase polymerize the fiber at a package condition.

Further, the melting point (Tm1) of the fiber according to the present invention is preferably 300° C. or higher, more preferably 310° C. or higher, and further preferably 320° C. or higher. By having such a high melting point, the thermal resistance and the thermal dimensional stability are excellent. In order to achieve the high melting point of the fiber, although there is a method for forming a liquid crystalline polyester polymer with a high melting point as a fiber, in order to obtain a fiber having particularly high strength and elastic modulus and excellent in uniformity in the lengthwise direction, it is preferred to serve the fiber melt spun to solid phase polymerization.

Further, although the Tm2 tends to become higher as the orientation or the degree of crystallization of the fiber becomes higher, thereto the melting point of the liquid crystalline polyester polymer is strongly reflected. Therefore, the higher the Tm2 is, the higher the thermal resistance is, and in the fiber according to the present invention, the Tm2 is preferably 290° C. or higher, more preferably 310° C. or higher. Where, although the upper limit of the Tm1 or the Tm2 is not particularly limited, an upper limit capable of being achieved in the present invention is about 400° C.

The single-fiber fineness of the fiber according to the present invention is 18.0 dtex or less. By making the fiber thinner at a single-fiber fineness of 18.0 dtex or less, provided are advantages that the flexibility of the fiber increases and the processability of the fiber is improved, that the surface area increases and therefore the adhesion property thereof with chemicals such as an adhesive is improved, and in case of being formed as a gauze comprising monofilaments, that the thickness can be smallened, that the weave density can be increased, and that the opening (area of the opening portions) can be widened. The single-fiber fineness is more preferably 10.0 dtex or less, and further preferably 7.0 dtex or less.

Where, although the lower limit of the single-fiber fineness is not particularly limited, a lower limit capable of being achieved in the present invention is about 1 dtex.

The strength of the fiber according to the present invention is 13.0 cN/dtex or more, more preferably 18.0 cN/dtex or more, and further preferably 20.0 cN/dtex or more. Further, the elastic modulus is preferably 600 cN/dtex or more, more preferably 700 cN/dtex or more, and further preferably 800 cN/dtex or more. Where, the strength referred herein indicates a tensile strength described in JISL1013:1999 and the elastic modulus referred herein indicates an initial tensile resistance degree described therein. By such high strength and elastic modulus, the mechanical properties when made as a product such as a fabric can be increased, and in particular, the process passing-through property when formed in a small fiber fineness can be improved. Although the upper limits of the strength and elastic modulus are not particularly limited, upper limits capable of being achieved in the present invention are about 30 cN/dtex in strength and about 1200 cN/dtex in elastic modulus.

The fluctuation rate of the fineness of the liquid crystalline polyester fiber according to the present invention is preferably 30% or less, more preferably 20% or less, further preferably 10% or less. Further, the fluctuation rate of the tenacity of the fiber is preferably 20% or less, more preferably 15% or less. Where, the tenacity referred herein indicates a strength at the time of breakage in the measurement of tensile strength described in JISL1013:1999, and the fluctuation rate of the fineness and the fluctuation rate of the tenacity indicate values determined by the methods described in the Example. By using the fiber with such small fluctuation rate of fineness and fluctuation rate of tenacity, because the fiber becomes less in defects and uniform in the lengthwise direction, the process passing-through property is improved, and defects when formed as a fabric are also reduced.

The abrasion resistance M, that becomes an index of a strength against a scratch of the fiber according to the present invention with a metal material, is preferably 3 seconds or more, more preferably 5 seconds or more, further preferably 10 seconds or more. The abrasion resistance M referred in the present invention indicates a value determined by the method described in the Example. By the abrasion resistance M of 3 seconds or more, fibrillation of a liquid crystalline polyester fiber at a high-order processing process can be suppressed, and the process passing-through property can be improved. Because accumulation of fibrils onto a guide and the like decreases, there is an advantage that the cycle for cleaning or exchange can be lengthened, etc.

Where, preferable ranges of the compression elastic modulus in a direction perpendicular to the fiber axis, the birefringence ($\Delta n$), the half width ($\Delta 2\theta$) of a peak observed in an equator line at $2\theta=18$ to 20° relative to the fiber axis in a wide angle X-ray diffraction, the amount of oil adhesion and the kind of oil are similar to those for "the fiber served to the heat treatment" described in the second invention of the present invention.

The fiber according to the present invention can employ a broad number of filaments. Although the upper limit of the number of filaments is not particularly limited, for making a fiber product thinner or lighter in weight, the number of filaments is preferably 50 or less, more preferably 20 or less.

The fiber according to the present invention is particularly suitable for a monofilament. For making a filter or a screen gauze for printing comprising a monofilament high-performance, particularly increase of weave density and increase of opening area are required, and for this, small fiber fineness and high strength for ensuring a weavability are strongly required. However, if only the small fiber fineness and the high strength are required, a liquid crystalline polyester fiber formed in a small fineness can be obtained by solid phase polymerization, but in a conventional liquid crystalline polyester, the abrasion resistance was poor, and further, because defects were generated by increase of fusion at the solid phase polymerization accompanying with forming as the small fiber fineness, the uniformity in the lengthwise direction and the process passing-through property were poor. The fiber according to the present invention has an abrasion resistance capable of bearing weaving by the properties of the polymer, and by the excellent uniformity in the lengthwise direction, the process passing-through property can also be improved.

Hereinafter, examples of production of the liquid crystalline polyester fiber according to the present invention will be explained in detail.

As the process for producing a liquid crystalline polyester used in the present invention, a process based on a known process can be employed, and for example, the following production process is preferably exemplified, and in this case, it is necessary to adjust the amounts for use of the respective monomers so that the aforementioned structural units (I) to (V) satisfy the conditions.

(1) A process for producing a liquid crystalline polyester by deacetic condensation polymerization from a diacetylate of an acetoxy carboxylic acid such as p-acetoxy benzoic acid and an aromatic dihydroxy compound such as 4,4'-diacetoxy biphenyl or diacetoxy benzene and an aromatic dicarboxylic acid such as terephthalic acid or isophthalic acid.

(2) A process for producing a liquid crystalline polyester by deacetic condensation polymerization, after acylating a phenolic hydroxyl group by reaction of acetic anhydride to a hydroxy carboxylic acid such as p-hydroxy benzoic acid and an aromatic dihydroxy compound such as 4,4'-dihydroxy biphenyl or hydroquinone and an aromatic dicarboxylic acid such as terephthalic acid or isophthalic acid.

(3) A process for producing a liquid crystalline polyester by dephenolic condensation polymerization from a diphenyl ester of a phenyl ester of a hydroxy carboxylic acid such as p-hydroxy benzoic acid and an aromatic dihydroxy compound such as 4,4'-dihydroxy biphenyl or hydroquinone and an aromatic dicarboxylic acid such as terephthalic acid or isophthalic acid.

(4) A process for producing a liquid crystalline polyester by dephenolic condensation polymerization, after reacting a predetermined amount of diphenyl carbonate to a hydroxy carboxylic acid such as p-hydroxy benzoic acid and an aromatic dicarboxylic acid such as terephthalic acid or isophthalic acid, forming respective diphenyl esters, and adding an aromatic dihydroxy compound such as 4,4'-dihydroxy biphenyl or hydroquinone.

Among these processes, preferred is the process for producing a liquid crystalline polyester by deacetic condensation polymerization, after acylating a phenolic hydroxyl group by reaction of acetic anhydride to a hydroxy carboxylic acid such as p-hydroxy benzoic acid and an aromatic dihydroxy compound such as 4,4'-dihydroxy biphenyl or hydroquinone and an aromatic dicarboxylic acid such as terephthalic acid or isophthalic acid. Further, the amount of the sum of the used aromatic dihydroxy compound such as 4,4'-dihydroxy biphenyl or hydroquinone and the amount of the sum of the used aromatic dicarboxylic acid such as terephthalic acid or isophthalic acid are substantially same mol. The amount of the used acetic anhydride is preferably 1.12 equivalent of the sum of the phenolic hydroxyl group of 4,4'-dihydroxy biphenyl or hydroquinone or less, more preferably 1.10 equivalent or less, and the lower limit is preferably 1.0 equivalent or more.

When the liquid crystalline polyester used in the present invention is produced by deacetic condensation polymerization, a melt polymerization process is preferred wherein the reaction is carried out under a pressure reduced condition at a temperature which causes melting of a liquid crystalline polyester and the condensation polymerization is completed. For example, a process is exemplified wherein predetermined amounts of hydroxy carboxylic acid such as p-hydroxy benzoic acid, aromatic dihydroxy compound such as 4,4'-dihydroxy biphenyl or hydroquinone, aromatic dicarboxylic acid such as terephthalic acid or isophthalic acid and acetic anhydride are charged into a reaction vessel with an agitator and a fraction tube and with a discharge port at a lower part, and heated to acetylate the hydroxylic group while agitated in a nitrogen atmosphere, and thereafter, heated up to a melting temperature of the liquid crystalline resin, and it is condensation polymerized by reducing pressure to complete the reaction. As to the acetylation condition, it is reacted usually in a range of 130 to 300° C., preferably in a range of 135 to 200° C., usually for 1 to 6 hours, preferably in a range of 140 to 180° C. for 2 to 4 hours. The temperature for the condensation polymerization is a melting temperature of a liquid crystalline polyester, for example, in a range of 250 to 350° C., preferably the melting point of the liquid crystalline polyester polymer+10° C. or higher. The degree of the pressure reduction at the time of condensation polymerization is usually 13.3 to 2660 Pa, preferably 1330 Pa or lower, more preferably 665 Pa or lower. Where, although the acetylation and the condensation polymerization may be carried out continuously in a same reaction vessel, they may be carried out in reaction vessels different from each other.

The obtained polymer can be discharged in a strand shape from the discharge port provided at a lower part of the reaction vessel by pressurizing the inside of the reaction vessel at a temperature for melting it, for example, at about 0.1±0.05 MPa. The melt polymerization process is a process advantageous for producing a uniform polymer, and it is preferred because an excellent polymer less in gas generation amount can be obtained.

When the liquid crystalline polyester used in the present invention is produced, it is also possible to complete the condensation polymerization by solid phase polymerization. For example, a process is exemplified wherein a liquid crystalline polyester polymer or oligomer is ground by a grinder, it is heated in a nitrogen gas flow or under a pressure reduced condition at a temperature in a range of the melting point (Tm) of the liquid crystalline polyester−5° C. to the melting point (Tm)−50° C. (for example, 200 to 300° C.) for 1 to 50 hours, and it is condensation polymerized up to a desired polymerization degree to complete the reaction.

In a spinning, however, if the liquid crystalline polymer produced by solid phase polymerization is used as it is, a high crystallized part produced by the solid phase polymerization remains at a condition unmolten, because there is a possibility that it causes an elevation of s spinning pack pressure or a foreign matter in a yarn, it is preferred to once blend it by a twin-screw extruder and the like (re-pelletize) to completely melt the high crystallized part.

Although the above-described condensation polymerization of the liquid crystalline polyester proceeds even with no catalyst, a metal compound can also be used such as stannous acetate, tetrabutyltitanate, potassium acetate and sodium acetate, antimony trioxide or metal magnesium.

The melting point of the liquid crystalline polyester polymer used in the present invention is preferably 200 to 380° C. in order to widen the temperature range capable of melt spinning, more preferably 250 to 350° C., further preferably 290 to 340° C. Where, the melting point of the liquid crystalline polyester polymer indicates a value determined by the method described in the Example.

The melt viscosity of the liquid crystalline polyester polymer used in the present invention is preferably 0.5 to 200 Pa·s, particularly preferably 1 to 100 Pa·s, and from the point of spinning ability, it is more preferably 10 to 50 Pa·s. Where, this melt viscosity is a value measured by a drop type flow tester at conditions of a temperature of melting point (Tm)+10° C. and a shear velocity of 1,000 (1/s).

It is preferred that the weight average molecular weight of the liquid crystalline polyester used in the present invention determined through a polystyrene-equivalent weight average molecular weight (hereinafter, referred to as merely "a molecular weight") is preferably 30,000 or more, more preferably 50,000 or more. By having a molecular weight of 50,000 or more, at a spinning temperature an adequate viscosity can be provided and the fiber forming property can be improved, and as the molecular weight is higher, the strength, elongation and elastic modulus of the fiber can be increased. Further, if the molecular weight is too high, the viscosity becomes high and the flowability deteriorates, and ultimately it becomes impossible to flow, and therefore, the molecular weight is preferably 250,000 or less, more preferably 150,000 or less.

In the melt spinning, although a known method can be employed for melt extrusion of liquid crystalline polyester, in order to prevent a systematic structure from being produced at the time of polymerization, an extruder-type extruding machine is preferably used. The extruded polymer is metered by a known metering device such as a gear pump through a tube, and after passing through a filter for removing foreign matters, it is introduced into a die. At that time, the temperature from the polymer tube to the die (spinning temperature) is controlled preferably at a temperature of the melting point of the liquid crystalline polyester or higher and 500° C. or lower, more preferably at a temperature of the melting point of the liquid crystalline polyester+10° C. or higher and 400° C. or lower, and further preferably at a temperature of the melting point of the liquid crystalline polyester+20° C. or higher and 370° C. or lower. Where, it is also possible to adjust the respective temperatures from the polymer tube to the die independently. In this case, the discharge can be stabilized by controlling the temperature of a portion near the die higher than the temperature of an upstream portion thereof.

In order to obtain the liquid crystalline polyester fiber according to the present invention, it is important to use the liquid crystalline polyester polymer comprising the aforementioned structural units and, in particular, to optimize the spinning condition for obtaining a fiber with a low fiber fineness fluctuation rate when made in a small fineness. The liquid crystalline polyester polymer comprising the aforementioned structural units can be spun at a temperature in a broad range because the temperature difference between the melting point and the thermal decomposition temperature is great, the fiber forming property is good because the thermal stability at the spinning temperature is high, and further, because the flowability is high and the divergent behaviour of the polymer after being discharged is stable, the fiber fineness fluctuation is little, and therefore, it is favorable for obtaining a fiber with a small fiber fineness and a low fineness fluctuation rate. However, in order to obtain a fiber with a small fineness of a single-fiber fineness of 18 dtex or less uniformly, the stability at the time of discharge and the stability of the divergent behaviour should be further improved, and in an industrial melt spinning, because many die holes are opened in a single die for reducing the energy cost and for improving the productivity, it is necessary to stabilize the discharge and the divergent behaviour in the respective holes.

In order to achieve this, it is important to make the hole diameter of the die small and to increase the land length (a length of a straight part having the same length of the hole diameter of the die). However, if the hole diameter is excessively small, because a clogging of a hole is liable to occur, the diameter is preferably 0.03 mm or more and 0.30 mm or less, more preferably 0.05 mm or more and 0.25 mm or less, and further preferably 0.08 mm or more and 0.20 mm or less. If the land length is excessively great, because the pressure loss becomes high, L/D defined as a quotient calculated by dividing the land length with the hole diameter is preferably 0.5 or more and 3.0 or less, more preferably 0.8 or more and 2.5 or less, and further preferably 1.0 or more and 2.0 or less. Further, in order to keep the uniformity, the number of holes in a single die is preferably 50 holes or less, more preferably 40 holes or less, and further preferably 20 holes or less. Where, the introduction hole positioned immediately above the die holes is preferably a straight hole having a diameter 5 times or more to the diameter of the die hole, from the point of preventing increase of the pressure loss. Although the connecting portion between the introduction hole and the die holes is preferably formed in a taper shape from the viewpoint of suppressing an abnormal staying, the length of the taper part is preferably set to be two times or less relative to the land length, from the viewpoint of preventing increase of the pressure loss and stabilizing the flow lines.

The polymer discharged from the die holes passes through heat insulating and cooling regions and is solidified, and thereafter, is drawn by a roller (a godet roller) rotating at a constant speed. If the heat insulating region is excessively long, because the fiber forming property deteriorates, it is preferably 200 mm or less from the die surface, more preferably 100 mm or less. For the heat insulating region, it is possible to elevate the atmosphere temperature using a heating means, and its temperature range is preferably 100° C. or higher and 500° C. or lower, more preferably 200° C. or higher and 400° C. or lower. Although inert gas, air, steam, etc. can be used for the cooling, it is preferred to use an air flow blown in parallel or annularly, from the viewpoint of lowering the environment load.

The draw speed is preferably 50 m/min or more for improving the productivity and decreasing the single-fiber fineness, more preferably 300 m/min or more, and further preferably 500 m/min or more. Since the liquid crystalline polyester used in the present invention has a good yarn drawing property at a spinning temperature, the draw speed can be set high. Although the upper limit thereof is not particularly limited, it is about 2000 m/min in the liquid crystalline polyester used in the present invention from the viewpoint of yarn drawing property.

The spinning draft defined as a quotient calculated by dividing the discharge linear velocity with the draw speed is preferably 1 or more and 500 or less, more preferably 5 or more and 200 or less, further preferably 12 or more and 100 or less, for enhancing the molecular orientation and making the single-fiber fineness small. Since the liquid crystalline polyester used in the present invention has a good yarn drawing property, the draft can be increased, and it is advantageous for achieving a small fiber fineness.

In the melt spinning, it is preferred to apply an oil at a position between the cooling and solidifying of the polymer and the winding, from the viewpoint of improving the handling property of the fiber. Although a known oil can be used, it is preferred to use an oil whose main constituent is polysiloxane group silicone oil and the like which can bear a solid phase polymerization at a high temperature.

Although the winding can be carried out by using a known winding machine and forming a package such as a pirn, a cheese, a cone, etc., a pirn winding, in which a roller does not come into contact with a package surface at the time of winding, is preferable, from the viewpoint of not giving a friction to the fiber and not fibrillating it.

Next, the fiber obtained by melt spinning is preferably carried out with solid phase polymerization. In the solid phase polymerization, when the endothermic peak of the melt spun fiber is represented as Tm1 (° C.), treatment is carried out at a temperature so that the maximum reaching temperature becomes Tm1−60 (° C.) or higher, and by this, the solid phase polymerization of the fiber progresses quickly, and the strength of the fiber can be increased. Where, Tm1 referred herein indicates a value determined by the determination method described in the Example. The maximum reaching temperature is preferably lower than Tm1 (° C.) for preventing fusion. Further, because the melting point of the liquid crystalline polyester fiber elevates accompanying with the progress of the solid phase polymerization, it is more preferred to elevate the temperature of the solid phase polymerization steppedly or continuously relative to the treatment time, for preventing fusion and improving the time efficiency of the solid phase polymerization. Also in this case, however, the maximum reaching temperature is preferably controlled at Tm1 of the fiber after heat treatment−60 (° C.) or higher and lower than Tm1 (° C.) from the viewpoint of increasing the speed of the solid phase polymerization and preventing fusion.

The solid phase polymerization can be carried out at a state of a package, a hank or a tow (for example, carried out on a metal net and the like), or can be carried out at a yarn state continuously between rollers, and it is preferably carried out at a package state from the viewpoint of simplifying the apparatus and improving the productivity.

With respect to the time for solid phase polymerization, although it depends upon the temperature of solid phase polymerization, in order to sufficiently increase the strength, elastic modulus and melting point of the fiber, the time at a maximum reaching temperature is preferably 5 hours or more, more preferably 10 hours or more. Although the upper limit is not particularly restricted, because the effect for increasing the strength, elastic modulus and melting point of the fiber is saturated as the time passes, the time of about 100 hours is enough, and in order to improve the productivity, a short time is preferred, and therefore, the time of about 50 hours is enough.

In case where the solid phase polymerization is carried out at a package state, a technology for preventing fusion, that becomes remarkable when the single-fiber fineness is made small, becomes important. When such a solid phase polymerization is carried out, from the viewpoint of productivity for apparatus and efficiency of production, it is preferred to form the melt spun liquid crystalline polyester fiber as a fiber package with a winding density of 0.01 g/cc or more and less than 0.30 g/cc on a bobbin and to solid phase polymerize this. Here, the winding density means a value calculated by Wf/Vf from a weight of fiber Wf (g) and an occupation volume of the package Vf (cc) which is determined from the outer dimension of the package and the dimension of the bobbin becoming a core material. Where, the occupation volume Vf is a value determined by measuring the package outer dimension by actual measurement or by taking a photograph and calculating it based on assuming the package as a rotation symmetry, and the Wf is a value calculated from the fiber fineness and the winding length or a value actually measured as a weight difference before and after winding. The winding density is preferably 0.15 g/cc or less because the adhesion strength between fibers in the package is weakened and fusion can be suppressed as the winding density is smaller, and if the winding density is excessively small, because the winding form of the package collapses, it is preferably 0.03 g/cc or more. Therefore, the preferable range is 0.03 g/cc or more and 0.15 g/cc or less. Further, it is preferred to use a fiber having a total fiber fineness of 1 dtex or more, capable of being handled, and a total fiber fineness of 500 dtex or less, great in bad influence due to fusion.

Formation by winding in melt spinning of the package with such a small winding density is desirable because the productivity for apparatus and the efficiency of production can be improved, and on the other hand, formation by rewinding from the package wound in melt spinning is preferable because the winding tension can be made small and the winding density can be made smaller. In the rewinding, the winding density can be made smaller as the winding tension is made smaller, the winding tension is preferably 0.15 cN/dtex or less, more preferably 0.10 cN/dtex or less, and further preferably 0.05 cN/dtex or less. In order to make the winding density low, it is also effective, without using a contact roller and the like which is usually used for regulating the package form and stabilizing the winding tension, to wind the package at a non-contact state to the fiber package surface, or to wind the package by a winding machine controlled in speed directly from a package wound in melt spinning without intervention of a speed adjusting roller. In these cases, in order to regulate the package form, a method is preferably employed wherein a distance (a free length) from a contact point between a traverse guide and a fiber to a fiber package is set within 10 mm. Furthermore, it is also effective to control the rewinding speed at 500 m/min or less, particularly, 300 m/min or less, for lowering the winding density. On the other hand, the rewinding speed is advantageous as it is higher from the viewpoint of productivity, and it is preferably 50 m/min or more, in particular, 100 m/min or more.

Further, in order to form a stable package even in a low-tension winding and in order to to avoid fusion at an end surface and form a stable package, the winding formation is preferably a taper end winding provided with tapers at both ends. In this case, the taper angle is preferably 60° or less, more preferably 45° or less. Further, in case where the taper angle is too small, the fiber package cannot be made large, and in case of requiring a long fiber, the taper angle is preferably 1° or more, more preferably 5° or more. Where, the taper angle referred in the present invention is defined by the following equation. Further, in winding, a package excellent in handling ability and unwinding property can be obtained by periodically oscillating the width for traverse relative to time.

$$\theta=\tan^{-1}\{2d/(l_i-l_o)\} \quad \text{[Equation 1]}$$

θ: taper angle (°), d: winding thickness (mm), $l_i$: stroke of innermost layer mm), $l_o$: stroke of outermost layer mm)

Moreover, the winding number is also important for forming a package. The winding number referred herein means times of rotation of a spindle during half reciprocation of a traverse, it is defined as a product of a time for the half reciprocation of a traverse (minute) and the rotational speed of a spindle (rpm), and that the winding number is high indicates that the traverse angle is small. Although a smaller winding number is advantageous for avoiding fusion because the contact area between fibers becomes smaller, under a condition of a low tension, none of contact roller, etc., which becomes a preferable condition in the present invention, it is possible to decrease a traverse failure, a swelling of package, etc. and to make a package form better as the winding number becomes higher. From these points, the winding number is preferably 2 or more and 20 or less, more preferably 5 or more and 15 or less.

The bobbin used for forming the fiber package may be any type bobbin as long as it has a cylindrical shape, and when wound as a fiber package, it is attached to a winding machine, and by rotating it, the fiber is wound to form a package. In solid phase polymerization, although the fiber package can be treated integrally with the bobbin, the treatment can also be carried out at a condition where only the bobbin is taken out from the fiber package. In case where the treatment is carried out at a condition where the fiber is wound on the bobbin, it is necessary that the bobbin can resist the temperature of the solid phase polymerization, and therefore, it is preferably made from a metal such as aluminum, brass, iron or stainless steel. Further, in this case, it is preferred that many holes are opened on the bobbin because a by-product of polymerization can be quickly removed and the solid phase polymerization can be carried out efficiently. Further, in case where the treatment is carried out at a condition where the bobbin is taken out from the fiber package, it is preferred to attach an outer skin onto the outer layer of the bobbin. Further, in any of both cases, it is preferred to wind a cushion material onto the outer layer of the bobbin and thereonto wind the liquid crystalline polyester melt spun fiber. The kind of the cushion material is preferably a felt made of a organic fiber or a metal fiber, and the thickness thereof is preferably 0.1 mm or more and 20 mm or less. The above-mentioned outer skin can also be formed by the cushion material.

Although the fiber weight of the fiber package may be any weight as long as the winding density is within the range according to the present invention, a preferable range is 0.01 kg or more and 10 kg or less in consideration of productivity. Where, a preferable range of yarn length is 10,000 m or more and 2,000,000 m or less.

Adhesion of oil onto the fiber surface is exemplified as a preferred embodiment in order to prevent fusion at the time of solid phase polymerization. Although adhesion of such a component may be carried out between melt spinning and winding, in order to increase the adhesion efficiency, preferably it is carried out at rewinding, or a small amount of oil is provided at melt spinning and oil is further added at rewinding.

Although the method for oil adhesion may be a method for supplying oil by a guide, in order to apply oil to uniformly adhere to a fiber with a small total fineness, adhesion by a kiss roller (an oiling roller) made of a metal or a ceramic is preferred. The oil component high in thermal resistance is better because it is not vaporized at a high-temperature heat treatment in solid phase polymerization, and as the oil component, a salt, an inorganic substance such as talc or smectite, a fluorine group compound, a siloxane group compound (dimethyl polysiloxane, diphenyl polysiloxane, methylphenyl polysiloxane, etc.), and a mixture thereof, are preferred. Among these, a siloxane group compound is particularly preferred because it exhibits an advantage for preventing fusion in solid phase polymerization as well as an advantage for easy slipping property.

Although these components may be either provided at a solid substance adhesion condition or provided at a direct oil application condition, in order to apply uniformly while correcting the amount of adhesion, an emulsion application is preferred, and water emulsion is particularly preferred from the viewpoint of safety. Therefore, the component is preferably water-soluble or easy to form water emulsion, and an oil mixture, whose main constituent is water emulsion of dimethyl polysiloxane and to which a salt or a water-swelling smectite is added, is most preferable.

It is preferred that the amount of oil adhered to the fiber is greater in order to suppress fusion, and it is preferably 0.5 wt % or more, more preferably 1.0 wt % or more. On the other hand, if too much, because the fiber becomes sticky and it causes deterioration of handling and in addition it deteriorates a process passing-through property in a post process, the amount is preferably 10.0 wt % or less, more preferably 8.0 wt % or less, and particularly preferably 6.0 wt % or less. Where, the amount of oil adhered to the fiber indicates a value determined by the method described in the Example.

Although it is possible to perform solid phase polymerization in an inert gas atmosphere, in an activating gas atmosphere containing oxygen such as air, or under a pressure reduced condition, it is preferably carried out in a nitrogen atmosphere from the viewpoint of simplifying the apparatus and preventing oxidation of fiber or adhered substances. In this case, the atmosphere for the solid phase polymerization is preferably a low-temperature gas having a dew point of −40° C. or lower.

Although the package after solid phase polymerization can be served as a product as it is, in order to increase the efficiency for product transportation, it is preferred to increase the winding density by rewinding again the package after solid phase polymerization. In the rewinding after solid phase polymerization, its unwinding is important, in order to prevent a collapse of a package carried out with solid phase polymerization and further suppress a fibrillation when a slight fusion is delaminated, a so-called lateral unwinding is preferred wherein a yarn is unwound in a direction perpendicular to a rotational axis (fiber circulating direction) while rotating the package carried out with solid phase polymerization, and further, the rotation of the package carried out with solid phase polymerization is preferably not a free rotation but a rotation performed by a positive driving.

It is a preferable embodiment to remove oil component from the fiber carried out with solid phase polymerization. For suppressing fusion in solid phase polymerization, as the adhesion amount of oil component such as inorganic substance, fluorine group compound or siloxane group compound becomes greater, the effect becomes higher, but if the oil component is too much in a process after solid phase polymerization or in a weaving process, it causes a deterioration of process passing-through property due to accumulation on a reed, generation of defects due to entering of the accumulated substances into a product, etc., and therefore, the adhesion amount of oil component is preferably lowered down to a necessary minimum amount. Therefore, by removing the oil component adhered before solid phase polymerization at a stage after the solid phase polymerization, suppression of fusion, improvement of uniformity in the lengthwise direction and improvement of process passing-through property can be achieved.

Although the method for removing the oil is not particularly restricted and a method for removing by a cloth or a paper while running the fiber continuously, etc., can be exemplified, from the viewpoint of not giving a mechanical load to the fiber and increasing the efficiency of removal, a method for dipping the fiber in a liquid capable of dissolving or dispersing the oil is preferred. At that time, the fiber may be dipped in the liquid while being run continuously, or may be dipped in the liquid at a package condition. In the method for removing the oil while running the fiber continuously, a uniform removal in the fiber lengthwise direction can be achieved, and in addition, the apparatus can be simplified. In the method for removing the oil at a package condition, because the treatment amount per unit time increases, the productivity is excellent.

The liquid used for the removal is preferably water in order to reduce environmental load. The higher the temperature of the liquid is, the higher the efficiency of the removal is, and it is preferably 40° C. or higher, more preferably 60° C. or higher. However, if the temperature is too high, because evaporation of the liquid becomes remarkable, it is preferably the boiling point of the liquid−10° C. or lower, more preferably the boiling point−20° C. or lower. Furthermore, addition of surfactant, provision of bubbles of the liquid, ultrasonic wave vibration or liquid flow, giving a vibration to the fiber dipped in the liquid, etc. are particularly preferred to increase the speed for decomposition or dispersion of the oil in the liquid.

Although the degree of the oil removal is appropriately adjusted depending upon the purpose, it is preferred to leave oil to some extent for improving the process passing-through property of the fiber in a high-order processing process or a weaving process, in order to simplify the process. Further, it is also a preferable embodiment to provide a different kind of oil after removing most of oil.

Final oil adhesion amount to the fiber is preferably 0.1 wt % or more relative to the weight of the fiber. Where, the oil adhesion amount referred in the present invention indicates a value determined by the method described in the Example. Because the advantage for improvement of process passing-through property and increase of abrasion resistance can be increased as the amount of oil becomes greater, the amount is preferably 0.5 wt % or more, more preferably 1.0 wt % or more. However, if the oil is too much, problems are caused such as that the adhesion force between fibers becomes high and the running tension becomes unstable, or that the oil is accumulated on a guide and the like and the process passing-through property deteriorates, and as the case may be, it enters into a product and causes a defect, and therefore, it is preferably 10 wt % or less, more preferably 6 wt % or less, and further preferably 4 wt % or less. At that time, it is particularly preferred to contain a polydimethyl siloxane group compound in the oil for improving the process passing-through property and increasing the abrasion resistance. The determination that the polysiloxane group compound is contained in the adhered oil is carried out in the present invention by the method described in the Example.

The liquid crystalline polyester fiber according to the present invention is reduced in single-fiber fineness and improved in abrasion resistance while the features of high strength, high elastic modulus, high thermal resistance and high thermal dimensional stability can be kept, and it can be used broadly in uses such as materials for general industry, materials for civil engineering and construction, materials for sports, clothing for protection, materials for reinforcement of rubbers, electric materials (in particular, as tension members), acoustic materials, general clothing, etc. As effective uses, can be exemplified screen gauzes, filters, ropes, nets, fishing nets, computer ribbons, base fabrics for printed boards, canvases for paper machines, air bags, air ships, base fabrics for domes, etc., rider suits, fishlines, various lines (lines for yachts, paragliders, balloons, kite yarns, etc.), blind cords, support cords for screens, various cords in automobiles or air planes, power transmission cords for electric equipment or robots, etc., and as a particularly effective use, fabrics for industrial materials comprising monofilaments, in particular, filters and screen gauzes for printing can be exemplified.

Next, a process for producing a liquid crystalline polyester fiber excellent in strength, elastic modulus, thermal resistance, uniformity in the lengthwise direction and abrasion resistance and particularly having a small fiber fineness, which is a fourth invention of the present invention, concretely, a process for solid phase polymerization of the liquid crystalline polyester fiber, will be explained in detail.

The liquid crystalline polyester used in the present invention means a polymer exhibiting an optical anisotropy (liquid crystallinity) when molten by heating, and it is similar to the liquid crystalline polyester mentioned in the first invention. Further, copolymerization of other components, addition of different kinds of polymers and use of additives may be employed as long as within a small amount that does not impair the feature of the present invention, as mentioned in the first invention.

In the present invention, a liquid crystalline polyester fiber is obtained by melt spinning this polyester. Preferred embodiments for producing the fiber are as described in the production embodiments for the liquid crystalline polyester fiber according to the third invention.

The total fineness of the fiber used in the present invention is 1 dtex or more and 500 dtex or less. By controlling the total fineness in such a range of small fineness, an advantage for making the thickness as a fabric small can be obtained, and in addition, in a gauze fabric for screen printing, it becomes possible to make it a high-mesh and high-opening area condition and the accuracy of printing can be increased. This advantage is greater as the total fineness is smaller, and therefore, it is preferably 100 dtex or less, more preferably 50 dtex or less.

The fiber used in the present invention can employ a broad number of filaments. Although the upper limit of the number of filaments is not particularly limited, for performing a stable spinning while reducing the total fineness, the number of filaments is preferably 100 or less, more preferably 50 or less, and further preferably 20 or less. In particular, because a monofilament whose number of filaments is one is used for a field strongly requiring a small fineness and a uniformity of tenacity, the process of the present invention can be used therefor particularly suitably. Therefore, the most suitable example of the process of the present invention is a monofilament of 50 dtex or less, more preferably a monofilament of 18 dtex or less.

Next, although the fiber obtained by melt spinning in the present invention is carried out with solid phase polymerization, the preferred embodiments are as described in the embodiments for production of the liquid crystalline polyester fiber of the third invention.

In such a solid phase polymerization, in the present invention, from the viewpoint of productivity for apparatus and efficiency of production, it is preferred to form the melt spun liquid crystalline polyester fiber as a fiber package with a winding density of 0.01 g/cc or more and less than 0.30 g/cc on a bobbin and to solid phase polymerize this. Because the contact force between fibers in the package is weakened and fusion can be suppressed as the winding density is smaller, it is preferably 0.15 g/cc or less, and if the winding density is too small, because the winding form of the package is collapsed, it is preferably 0.03 g/cc or more. Therefore, the preferable range is 0.03 g/cc or more and 0.15 g/cc or less. Further, the present invention is applied to a fiber whose total fineness is 1 dtex or more capable of being handled and whose total fineness is 500 dtex or less which has a great bad influence due to fusion. The preferable production process for such a fiber package is also as described in the embodiment for producing the liquid crystalline polyester fiber of the third invention.

Further, also in the present invention, oil adhesion for suppressing fusion, unwinding of the fiber from the package after solid phase polymerization, and further, removal of oil for improving the process passing-through property, etc. can be appropriately carried out, and the preferred process is also as described in the embodiment for producing the liquid crystalline polyester fiber of the third invention.

EXAMPLES

Hereinafter, although the present invention will be explained in detail based on Examples, the present invention is not limited thereto at all. Where, determinations of the respective properties in the present invention have been carried out by the following methods.

(1) Weight Average Molecular Weight Converted from Polystyrene (Molecular Weight):

Using a mixed solvent of pentafluoro phenol/chloroform=35/65 (weight ratio) as the solvent, a sample for GPC measurement was prepared by dissolution so that the concentration of liquid crystalline polyester became 0.04 to 0.08 weight/volume %. Where, in case where there is an insoluble substance even after left at a room temperature for 24 hours, the sample was left further for 24 hours, and then, a supernatant was taken as the sample. This was measured using a GPC measurement apparatus produced by Waters Corporation, and the weight average molecular weight (Mw) was determined through a polystyrene-equivalent weight average molecular weight.

Column: Shodex K-806M; two pieces, K-802; one piece
Detector: Differential refractive index detector RI (2414 type)
Temperature: 23±2° C.
Flow rate: 0.8 mL/min
Injection amount: 200 μL (2) Tm1 of Liquid Crystalline Polyester Fiber, Half Width of Peak at Tm1, ΔHm1, Tc, ΔHc, Tm2, ΔHm2, Reduction Rate of Heat of Melting, Melting Point of Liquid Crystalline Polyester Polymer:

Differential calorimetry was carried out by DSC 2920 produced by TA Instruments Corporation, a temperature of endothermic peak observed when measured under a condition of heating from 50° C. at a temperature elevation rate of 20° C./min was referred to as Tm1 (° C.), and the half width of the peak (° C.) and the heat of melting (ΔHm1) (J/g) at Tm1 were measured. Succeedingly, a temperature of an exothermic peak, observed when cooled down under a condition of a temperature lowering rate of 20° C./min after maintained for five minutes at a temperature of Tm1+20° C. after observation of Tm1, was referred to as Tc (° C.), and a heat of crystallization (ΔHc) (J/g) at Tc was measured. Succeedingly, cooling was carried out down to 50° C., and an endothermic peak observed when heated again under a condition of a temperature elevation rate of 20° C./min was referred to as Tm2, and a heat of melting (ΔHm2) (J/g) at Tm2 was measured.

Further, present/none condition of exothermic peak was observed in the first temperature elevation measurement from 50° C. to Tm1+20° C. at a temperature elevation rate of 20° C./min, and in case where the peak was observed, the exothermic heat was measured.

Reduction rate of heat of melting was calculated by the following equation, using ΔHm1 of the fiber before being served to heat treatment and ΔHm1 of the fiber obtained by the heat treatment.

Reduction rate of heat of melting (%)=(difference between the values of ΔHm1 of the fiber before and after heat treatment/ΔHm1 of the fiber before heat treatment)×100

Where, as to the liquid crystalline polyester polymer shown in Reference Examples, an endothermic peak observed when once cooled down to 50° C. under a condition of a temperature lowering rate of 20° C./min after maintained for five minutes at a temperature of Tm1+20° C. after observation of Tm1 was referred to as Tm2, and this Tm2 was referred to as the melting point of the polymer.

(3) Fineness of Single Fiber and Fluctuation Rate of Fineness:

The fiber was taken by 10 m using a hank by a sizing reel, the weight (g) thereof was multiplied at 1,000 times, 10 measurements per 1 sample were carried out, and the average value was defined as a fiber fineness (dtex). A quotient calculated by dividing this with a number of filaments was defined as a fineness of single fiber (dtex). A fluctuation rate of fineness was calculated by the following equation using a greater value among absolute values of a difference between the average value of the 10 times measurement of the fineness and the maximum value or the minimum value.

$$\text{Fluctuation rate of fineness (\%)}=\{(|\text{maximum or minimum value}-\text{average value}|/\text{average value})\times 100$$

(4) Strength, Elongation, Elastic Modulus and Fluctuation Rate of Tenacity:

Based on the method described in JIS L1013:1999, at a condition of a sample length of 100 mm and a tensile speed of 50 mm/min, 10 times measurement per one sample was carried out using Tensilon UCT-100 produced by Orientech Corporation, and the average values were determined as a strength (cN), an elongation (%) and elastic modulus (cN/dtex). A fluctuation rate of tenacity was calculated by the following equation using a greater value among absolute values of a difference between the average value of the 10 times measurement of the fineness and the maximum value or the minimum value.

$$\text{Fluctuation rate of tenacity (\%)}=\{(|\text{maximum or minimum value}-\text{average value}|/\text{average value})\times 100$$

(5) Coefficient of Thermal Expansion:

A treatment load of 0.03 cN/dtex was applied to a sample in a fiber axis direction using TMA-50 produced by Shimadzu Seisakusyo Corporation, it was calculated by the following equation using a sample length L0 at 50° C. when heated from 40° C. to 250° C. at a temperature elevation rate of 5° C./min and a sample length L1 at 100° C. during the temperature elevation.

$$\text{Coefficient of thermal expansion (ppm/° C.)}=\{(L0-L1)/(L0\times 50)\}\times 10^6$$

(6) Compression Elastic Modulus in a Direction Perpendicular to Fiber Axis (Compression Elastic Modulus):

One single fiber was placed on a stage high in rigidity such as ceramic stage, at a state where a side of an indentator was set in parallel to the fiber, a compression load was applied at a constant test speed using the indentator in the diameter direction under the following condition, and after a load-displacement curve was obtained, a compression elastic modulus in a direction perpendicular to fiber axis was calculated from the following equation.

In the measurement, in order to amend an amount of deformation in a device system, a load-displacement curve was obtained at a state where the sample was not placed, by closely resembling this with a straight line the amount of deformation in the device relative to a load was calculated, and then, the sample was placed, a deformation of sample itself was determined by subtracting the deformation amount of the device relative to a load from the respective data points when measured with load-displacement curve, and this was used for the following calculation.

For the calculation, a compression elastic modulus was calculated using the load and the displacement at two points where a linearity in the load-displacement curve can be satisfied. Because there is a possibility that the indentator does not come into contact with the entire surface of the sample at an initial stage applied with the load, a point of load of about 30 mN was employed as the point of the lower load side. However, in case where the lower load-side point defined here was in a non-linear region, a point of a minimum load, which can achieve an aberration between the straight line and the displacement within 0.1 μm, was employed. Further, a point of load of about 100 mN was employed as the point of the higher load side. Where, in case where the higher load-side point exceeded a load of a yield point, a straight line was depicted toward the higher load side along the load-displacement curve so as to pass through the lower load-side point, and a point of a maximum load, which can achieve an aberration between the straight line and the displacement within 0.1 pin, was employed as the higher load-side point. In the following equation, the calculation was carried out at a condition where "1" was referred to as 500 μm, as to the radius of single fiber, the diameter of the sample was measured ten times before the test using an optical microscope, and the radius was employed as a value by determining an average value of the diameters measured above and calculating a half of the average diameter. Further, the load-displacement curve was measured five times per one sample, the compression elastic modulus was also calculated five times, and the average value was employed as a compression elastic modulus.

$$d=\{4P/(\pi l E_1)\}\{0.19+\sin h^{-1}(r/b)\}$$

$$\text{Here, } b^2=4rP/(\pi l E_1) \qquad \text{[Equation 2]}$$

Where,

P: load $E_1$: compression elastic modulus l: sample length to be compressed r: radius of single fiber Device: superior precision material tester Model 15848 produced by Instron Corporation Indentator: plane indentator made of diamond (a square with one side of 500 μm)

Test speed: 50 μm/min

Sampling speed: 0.1 second

Data processing system: "Merlin" produced by Instron Corporation

Atmosphere for measurement: in an atmospheric air with a room temperature (23±2° C., 50±5% RH)

(7) Half Width of Peak at Wide Angle X-Ray Diffraction (Δ2θ):

A fiber was cut out at 4 cm, and 20 mg thereof was weighed to prepare a sample. The measurement was carried out in a direction of an equator line relative to the fiber axis, and the conditions were as follows. At that time, a half width (Δ2θ) of a peak observed at 2θ=18 to 22° was measured.

X-ray generation unit: 4036A2 type produced by Rigaku Denki Corporation

X-ray source: CuKα ray (Ni filter used)

Output: 40 kV-20 mA

Goniometer: 2155D type produced by Rigaku Denki Corporation

Slit: 2 mmϕ-1°-1°

Detector: scintillation counter

Count recorder: RAD-C type produced by Rigaku Denki Corporation

Measurement range: 2θ=5 to 60°

Step: 0.05°

Integrating time: 2 seconds (8) Birefringence (Δn):

Using a poralization microscope (BH-2 produced by Olympus Corporation), measurement was carried out 5 times per one sample by compensator method, and it was determined as an average value.

(9) Abrasion Resistance C Against Ceramic Material:

Both ends of a fiber hung on a ceramic rod guide with a diameter of 4 mm (rod guide produced by Yuasa Itomichi Kogyo Corporation: Material; YM-99C, Hardness; 1800) at a contact angle of 90° were held by a stroke device (a yarn friction holding force tester produced by Toyo Seiki Seisakusyo Corporation), the fiber was scratched at a stroke length of 30 mm and a stroke speed of 100 times/min while a stress of 0.88 cN/dtex was provided to the rod guide (provided in a direction so that a stress of 0.62 cN/dtex was provided to the fiber), and at a condition stopping the operation at each one stroke, the number of strokes recognized with white powder on the rod guide or generation of fibrillation on the fiber surface was measured, and it was determined as an average value of five measurements. Where, the determination of the abrasion resistance C was also carried out for multifilament by a similar test method.

(10) Abrasion Resistance M Against Metal Material:

A fiber applied with a load of 2.45 cN/dtex (2.5 g weight/dtex) was hung vertically, a hard chrome metal rod guide with a satin finish (rod guide produced by Yuasa Itomichi Kogyo Corporation) with a diameter of 3.8 mm was pushed onto the fiber at a contact angle of 2.7° in a direction perpendicular to the fiber, the fiber was scratched by the guide in a fiber axis direction at a stroke length of 30 mm and a stroke speed of 600 times/min, observation by a stereo microscope was carried out, and the time up to a timing, at which white powder or generation of fibrillation on the rod guide or the fiber surface was observed, was measured, and a value as an average value of 5 measurements other than maximum and minimum values among 7 measurements was defined as abrasion resistance M. Where, the determination of the abrasion resistance M was also carried out for multifilament by a similar test method.

(11) Amount of Oil Adhesion, Determination of Adhesion of Polysiloxane Group Compound:

Taking a fiber of 100 mg or more, the weight thereof after drying at 60° C. for 10 minutes was measured (W0), the fiber was dipped in a solution prepared by adding sodium dodecylbenzene sulfonate to water of 100 times or more of the fiber weight at 2.0 wt % relative to the fiber weight, the fiber was served to a ultrasonic wave cleaning for 20 minutes, the fiber after the cleaning was cleaned by water, the weight after drying at 60° C. for 10 minutes was measured (W1), and the amount of oil adhesion was calculated by the following equation.

$$\text{Amount of oil adhesion (wt \%)}=(W0-W1)\times 100/W1$$

Further, as to determination of adhesion of polysiloxane group compound, the solution after the ultrasonic wave cleaning was taken, this was served to IR measurement, and if a peak intensity of 1050 to 1150 $cm^{-1}$ originating from polysiloxane was 0.1 time or more relative to a peak intensity of 1150 to 1250 $cm^{-1}$ originating from sulfonic group of sodium dodecylbenzene sulfonate, it was determined that polysiloxane adhered to the fiber.

(12) Running Tension, Running Stress:

The measurement was carried out using a tension meter produced by Toray Engineering Co., Ltd. (MODEL TTM-101). Further, for a very low tension, a tension meter capable of measuring an accuracy of 0.01 g with a full scale of 5 g, which was modified from the above-described tension meter, was used. The unit of the measured running tension was converted, and by dividing it with a fineness of the fiber after treatment, the running stress was determined as a value with a unit of cN/dtex.

(13) Running Stability:

The running state of the fiber at entrance and exit of a heat treatment apparatus was determined by observation, in case where the yarn swing was small, it was determined to be rank ○, in case where the yarn swing was large, it was determined to be rank Δ, and in case where a yarn breakage and fusion of fibers were generated, it was determined to be rank x.

(14) Weavability, Determination of Fiber Characteristics (Item 1):

Using a polyester monofilament as a warp yarn in a rapier weaving machine, a weft driving test of a liquid crystalline polyester fiber used as a weft yarn was carried out at a condition of weaving density of 100/inch (2.54 cm) for both of warp and weft yarns. At that time, the weavability was determined from the times of machine stopping due to accumulation of fibrils to a yarn supply port in a test weaving at a width of 180 cm and a length of 100 cm, in case of the time of one or less, it was determined to be good (rank ○), and in case of the times of two or more, it was determined to be not good (rank x). Further, quality of a fabric was determined from the number of fibrils mixed into the fabric, in case of two or less per 100 cm length, it was determined to be good (rank ○), and in case of three or more, it was determined to be not good (rank x).

(14) Process Passing-Through Property, Weavability, Determination of Fiber Characteristics (Item 2):

Carrying out a test similar to that in (14) by changing the weaving density and driving speed, a more detailed determination was carried out. The process passing-through property was determined from accumulation of fibrils and scum to the yarn supply port (ceramic guide), the weavability was determined from the times of machine stopping due to yarn breakage, and the quality of fabric was determined from the number of fibrils and scum mixing into the yarn supply port. The respective determination standards are as follows. Where, the thickness of the woven fabric was measured using a dial thickness gauge produced by Peacock Corporation.

<Process Passing-Through Property>

Fibrils and scum are not recognized by observation even after weaving: excellent (◎)

Fibrils and scum are recognized after weaving, but fiber running is not affected: good (○)

Fibrils and scum are recognized after weaving, and fiber running tension increases: not satisfied (Δ)

Fibrils and scum were recognized during weaving, and the test weaving was stopped: not good (x)

<Weavability>

Machine stopping 0 time: excellent (◎)

Machine stopping 1 to 2 times: satisfied (○)

Machine stopping 3 to 5 times: not satisfied (Δ)

Machine stopping 6 times or more: not good (x)

<Quality of Fabric>

(number of mixed fibrils and scum)

0: excellent (◎)

1 to 2: good (○)

3 to 5: not satisfied (Δ)

6 or more: not good (x)

Reference Example 1 p-hydroxy bezoate of 870 parts by weight, 4,4'-dihydroxy biphenyl of 327 parts by weight, hydroquinone of 89 parts by weight, terephthalic acid of 292 parts by weight, isophthalic acid of 157 parts by weight and acetic anhydride of 1433 parts by weight (1.08 equivalent of the sum of phenolic hydride group) were charged into a reaction vessel of 5 L with an agitating blade and a distillation tube, and after the temperature was elevated from a room temperature to 145° C. for 30 minutes while agitated under a nitrogen gas atmosphere, it was reacted at 145° C. for 2 hours. Thereafter, it was elevated to 330° C. for 4 hours.

The polymerization temperature was kept at 330° C., the pressure was reduced down to 133 Pa for 1.5 hours, and further the reaction was continued for 20 minutes, and at the time when the torque reached 15 kg-cm, the condensation polymerization was completed. Next, the inside of the reaction vessel was pressurized at 0.1 MPa, the polymer was discharged as a strand-like material through a die having one circular discharge port with a diameter of 10 mm, and it was pelletized by a cutter.

Reference Example 2 p-hydroxy bezoate of 907 parts by weight, 6-hydroxy-2-naphthoic acid of 457 parts by weight and acetic anhydride of 946 parts by weight (1.03 mol equivalent of the sum of phenolic hydride group) were charged into a reaction vessel of 5 L with an agitating blade and a distillation tube, and after the temperature was elevated from a room temperature to 145° C. for 30 minutes while agitated under a nitrogen gas atmosphere, it was reacted at 145° C. for 2 hours. Thereafter, it was elevated to 325° C. for 4 hours.

The polymerization temperature was kept at 325° C., the pressure was reduced down to 133 Pa for 1.5 hours, and further the reaction was continued for 20 minutes, and at the time when the torque reached 15 kg-cm, the condensation polymerization was completed. Next, the inside of the reaction vessel was pressurized at 0.1 MPa, the polymer was discharged as a strand-like material through a die having one circular discharge port with a diameter of 10 mm, and it was pelletized by a cutter.

Reference Example 3 p-hydroxy bezoate of 808 parts by weight, 4,4'-dihydroxy biphenyl of 411 parts by weight, hydroquinone of 104 parts by weight, terephthalic acid of 314 parts by weight, isophthalic acid of 209 parts by weight and acetic anhydride of 1364 parts by weight (1.10 equivalent of the sum of phenolic hydride group) were charged into a reaction vessel of 5 L with an agitating blade and a distillation tube, and after the temperature was elevated from a room temperature to 145° C. for 30 minutes while agitated under a nitrogen gas atmosphere, it was reacted at 145° C. for 2 hours. Thereafter, it was elevated to 300° C. for 4 hours.

The polymerization temperature was kept at 300° C., the pressure was reduced down to 133 Pa for 1.5 hours, and further the reaction was continued for 20 minutes, and at the time when the torque reached 15 kg-cm, the condensation polymerization was completed. Next, the inside of the reaction vessel was pressurized at 0.1 MPa, the polymer was discharged as a strand-like material through a die having one circular discharge port with a diameter of 10 mm, and it was pelletized by a cutter.

Reference Example 4 p-hydroxy bezoate of 323 parts by weight, 4,4'-dihydroxy biphenyl of 436 parts by weight, hydroquinone of 109 parts by weight, terephthalic acid of 359 parts by weight, isophthalic acid of 194 parts by weight and acetic anhydride of 1011 parts by weight (1.10 equivalent of the sum of phenolic hydride group) were charged into a reaction vessel of 5 L with an agitating blade and a distillation tube, and after the temperature was elevated from a room temperature to 145° C. for 30 minutes while agitated under a nitrogen gas atmosphere, it was reacted at 145° C. for 2 hours. Thereafter, it was elevated to 325° C. for 4 hours.

The polymerization temperature was kept at 325° C., the pressure was reduced down to 133 Pa for 1.5 hours, and further the reaction was continued for 20 minutes, and at the time when the torque reached 15 kg-cm, the condensation polymerization was completed. Next, the inside of the reaction vessel was pressurized at 0.1 MPa, the polymer was discharged as a strand-like material through a die having one circular discharge port with a diameter of 10 mm, and it was pelletized by a cutter.

Reference Example 5 p-hydroxy bezoate of 895 parts by weight, 4,4'-dihydroxy biphenyl of 168 parts by weight, hydroquinone of 40 parts by weight, terephthalic acid of 135 parts by weight, isophthalic acid of 75 parts by weight and acetic anhydride of 1011 parts by weight (1.10 equivalent of the sum of phenolic hydride group) were charged into a reaction vessel of 5 L with an agitating blade and a distillation tube, and after the temperature was elevated from a room temperature to 145° C. for 30 minutes while agitated under a nitrogen gas atmosphere, it was reacted at 145° C. for 2 hours. Thereafter, it was elevated to 365° C. for 4 hours.

The polymerization temperature was kept at 365° C., the pressure was reduced down to 133 Pa for 1.5 hours, and further the reaction was continued for 20 minutes, and at the time when the torque reached 15 kg-cm, the condensation polymerization was completed. Next, the inside of the reaction vessel was pressurized at 0.1 MPa, the polymer was discharged as a strand-like material through a die having one circular discharge port with a diameter of 10 mm, and it was pelletized by a cutter.

Reference Example 6 p-hydroxy bezoate of 671 parts by weight, 4,4'-dihydroxy biphenyl of 235 parts by weight, hydroquinone of 89 parts by weight, terephthalic acid of 224 parts by weight, isophthalic acid of 120 parts by weight and acetic anhydride of 1011 parts by weight (1.10 equivalent of the sum of phenolic hydride group) were charged into a reaction vessel of 5 L with an agitating blade and a distillation tube, and after the temperature was elevated from a room temperature to 145° C. for 30 minutes while agitated under a nitrogen gas atmosphere, it was reacted at 145° C. for 2 hours. Thereafter, it was elevated to 340° C. for 4 hours.

The polymerization temperature was kept at 340° C., the pressure was reduced down to 133 Pa for 1.5 hours, and further the reaction was continued for 20 minutes, and at the time when the torque reached 15 kg-cm, the condensation polymerization was completed. Next, the inside of the reaction vessel was pressurized at 0.1 MPa, the polymer was discharged as a strand-like material through a die having one circular discharge port with a diameter of 10 mm, and it was pelletized by a cutter.

Reference Example 7 p-hydroxy bezoate of 671 parts by weight, 4,4'-dihydroxy biphenyl of 335 parts by weight, hydroquinone of 30 parts by weight, terephthalic acid of 224 parts by weight, isophthalic acid of 120 parts by weight and acetic anhydride of 1011 parts by weight (1.10 equivalent of the sum of phenolic hydride group) were charged into a reaction vessel of 5 L with an agitating blade and a distillation tube, and after the temperature was elevated from a room temperature to 145° C. for 30 minutes while agitated under a nitrogen gas atmosphere, it was reacted at 145° C. for 2 hours. Thereafter, it was elevated to 305° C. for 4 hours.

The polymerization temperature was kept at 305° C., the pressure was reduced down to 133 Pa for 1.5 hours, and further the reaction was continued for 20 minutes, and at the time when the torque reached 15 kg-cm, the condensation polymerization was completed. Next, the inside of the reaction vessel was pressurized at 0.1 MPa, the polymer was discharged as a strand-like material through a die having one circular discharge port with a diameter of 10 mm, and it was pelletized by a cutter.

Reference Example 8 p-hydroxy bezoate of 671 parts by weight, 4,4'-dihydroxy biphenyl of 268 parts by weight, hydroquinone of 69 parts by weight, terephthalic acid of 314 parts by weight, isophthalic acid of 30 parts by weight and acetic anhydride of 1011 parts by weight (1.10 equivalent of the sum of phenolic hydride group) were charged into a reaction vessel of 5 L with an agitating blade and a distillation tube, and after the temperature was elevated from a room temperature to 145° C. for 30 minutes while agitated under a nitrogen gas atmosphere, it was reacted at 145° C. for 2 hours. Thereafter, it was elevated to 355° C. for 4 hours.

The polymerization temperature was kept at 355° C., the pressure was reduced down to 133 Pa for 1.5 hours, and further the reaction was continued for 20 minutes, and at the time when the torque reached 15 kg-cm, the condensation polymerization was completed. Next, the inside of the reaction vessel was pressurized at 0.1 MPa, the polymer was discharged as a strand-like material through a die having one circular discharge port with a diameter of 10 mm, and it was pelletized by a cutter.

Reference Example 9 p-hydroxy bezoate of 671 parts by weight, 4,4'-dihydroxy biphenyl of 268 parts by weight, hydroquinone of 69 parts by weight, terephthalic acid of 150 parts by weight, isophthalic acid of 194 parts by weight and acetic anhydride of 1011 parts by weight (1.10 equivalent of the sum of phenolic hydride group) were charged into a reaction vessel of 5 L with an agitating blade and a distillation tube, and after the temperature was elevated from a room temperature to 145° C. for 30 minutes while agitated under a nitrogen gas atmosphere, it was reacted at 145° C. for 2 hours. Thereafter, it was elevated to 310° C. for 4 hours.

The polymerization temperature was kept at 310° C., the pressure was reduced down to 133 Pa for 1.5 hours, and further the reaction was continued for 20 minutes, and at the time when the torque reached 15 kg-cm, the condensation polymerization was completed. Next, the inside of the reaction vessel was pressurized at 0.1 MPa, the polymer was discharged as a strand-like material through a die having one circular discharge port with a diameter of 10 mm, and it was pelletized by a cutter.

The characteristics of the liquid crystalline polyesters obtained in Reference Examples 1-9 are shown in Table 1. In any resin, when elevated in temperature in a nitrogen atmosphere by a hot stage and observed with a transmitted light of sample under a polarized light, an optical anisotropy (liquid crystallinity) was recognized. Where, the melt viscosity was determined using a drop type flow tester, at conditions of a temperature of melting point (Tm)+10° C. and a shear velocity of 1,000/s.

TABLE 1

| | | | Reference Example 1 | Reference Example 2 | Reference Example 3 | Reference Example 4 | Reference Example 5 | Reference Example 6 | Reference Example 7 | Reference Example 8 | Reference Example 9 |
|---|---|---|---|---|---|---|---|---|---|---|---|
| Structural unit (I) | | (mol %) | 54 | 73 | 48 | 26 | 72 | 54 | 54 | 54 | 54 |
| Structural unit (II) | | (mol %) | 16 | 0 | 18 | 26 | 10 | 14 | 20 | 16 | 16 |
| Structural unit (III) | | (mol %) | 7 | 0 | 8 | 11 | 4 | 9 | 3 | 7 | 7 |
| Structural unit (IV) | | (mol %) | 15 | 0 | 16 | 24 | 9 | 15 | 15 | 21 | 10 |
| Structural unit (V) | | (mol %) | 8 | 0 | 10 | 13 | 5 | 8 | 8 | 2 | 13 |
| Other Structural unit | | (mol %) | 0 | 27 | 0 | 0 | 0 | 0 | 0 | 0 | 0 |
| (I)/((I) + (II) + (III)) × 100 | | (mol %) | 70 | 100 | 65 | 41 | 84 | 70 | 70 | 70 | 70 |
| (II)/((II) + (III)) × 100 | | (mol %) | 70 | — | 69 | 70 | 71 | 61 | 87 | 70 | 70 |
| (IV)/((IV) + (V)) × 100 | | (mol %) | 65 | — | 62 | 65 | 64 | 65 | 65 | 91 | 43 |
| Polymer property | Melting point | (° C.) | 318 | 283 | 290 | 314 | 355 | 329 | 296 | 342 | 298 |
| | Molecular weight | (×10,000) | 9.1 | 23 | 8.9 | 8.6 | 9.3 | 9.0 | 9.0 | 9.6 | 8.6 |
| | Melt viscosity | (Pa · s) | 16 | 32 | 16 | 17 | 16 | 18 | 16 | 17 | 17 |

First, the process for heat treatment of the liquid crystalline polyester fiber, which is the second invention of the present invention, will be explained using Examples 1-23 and Comparative Example 1.

Example 1

Using the liquid crystalline polyester of Reference Example 1, after a vacuum drying was carried out at 160° C. for 12 hours, it was melt extruded by a single-screw extruder of ϕ15 mm produced by Osaka Seiki Kosaku Corporation (heater temperature: 290-340° C.), and the polymer was supplied to a spinning pack while metered by a gear pump. At that time, the spinning temperature from the exit of the extruder to the spinning pack was set at 345° C. In the spinning pack, the polymer was filtered using a metal nonwoven fabric filter (WLF-10, produced by Watanabe Giichi Seisakusyo Corporation), and the polymer was discharged from a die with five holes each having a diameter of 0.13 mm and a land length of 0.26 mm at a discharge amount of 3.0 g/min (0.6 g/min per single hole).

The discharged polymer was cooled and solidified from the outer side of the yarn by an annular cooling air after passing through a heat retaining region of 40 mm, and thereafter, oil whose main constituent was polydimethyl siloxane was provided, and 5 filaments were together wound to a first godet roller with 1200 m/min. The spinning draft at that time was 32. After this was passed through a second godet having the same speed, 4 filaments among the 5 filaments were sucked by a suction gun, and the remaining one filament was wound in a pirn form via a dancer arm using a pirn winder (no contact roller contacting with a wound package). During the winding time of about 100 minutes, yarn breakage did not occur and the fiber formation property was good. Where, the amount of oil adhesion was 1.0 wt %. Spinning conditions and spun fiber characteristics are shown in Table 2.

The fiber was unwound from this spun fiber package in a vertical direction (in a direction perpendicular to the fiber circulating direction), and without through a speed control roller, it was rewound by a winder controlled at a constant speed (a speed control winder ET-685, produced by Kamizu Seisakusyo Corporation). Where, a stainless bobbin with holes and wound thereon with a Kevler felt (weight: 280 g/m$^2$, thickness: 1.5 mm) was used as a core for the rewinding, the tension at the rewinding was 0.05 cN/dtex, and the winding amount was set at 20,000 m. Further, the package formation was controlled as a taper end winding with a taper angle of 20°, and the traverse width was always oscillated by reconstructing the taper width adjusting mechanism. The winding density of the package thus wound was 0.08 g/cm$^3$.

This was elevated in temperature from a room temperature to 240° C. for about 30 minutes using a closed type oven, after it was kept at 240° C. for 3 hours, it was elevated in temperature up to 295° C. at a temperature elevation speed of 4° C./hour, and further, solid phase polymerization was carried out at a condition of keeping at 295° C. for 15 hours. Where, as the atmosphere, dehumidified nitrogen was supplied at a flow rate of 25 NL/min, and it was discharged from an exhaust port so as not to pressurize the inside.

The package carried out with solid phase polymerization thus obtained was attached to a delivery device capable of being rotated by an inverter motor, and the fiber was wound by a winder (ET type speed control winder, produced by Kamizu Seisakusyo Corporation) while the fiber was delivered laterally (in a fiber circulating direction) at a fiber supply speed of about 100 m/min. The characteristics of the obtained liquid crystalline polyester fiber are shown in Table 3. Where, Δn of this liquid crystalline polyester fiber was 0.35, and it had a high orientation.

While this fiber was unwound in a vertical direction (in a direction perpendicular to the fiber circulating direction), using a slit heater with a slit width of 5.6 mm, a heat treatment was carried out while running the fiber at a non-contact condition with the heater, and thereafter, the fiber was wound by a winder (ET type speed control winder, produced by Kamizu Seisakusyo Corporation).

Although the conditions for treatment temperature and treatment speed and the characteristics of the obtained liquid crystalline polyester fiber are shown in Table 4, it is understood that a liquid crystalline polyester fiber high in strength, elastic modulus and thermal resistance (high melting point) and excellent in abrasion resistance can be obtained by carrying out a high-temperature heat treatment at a condition of Tm1 of the fiber+10° C. or higher.

TABLE 2

| | | | Example 1 | Example 10 | Example 11 | Example 12 | Example 13 | Example 14 | Example 15 | Example 17 | Example 18 |
|---|---|---|---|---|---|---|---|---|---|---|---|
| | Resin | | Reference Example 1 | Reference Example 1 | Reference Example 1 | Reference Example 1 | Reference Example 1 | Reference Example 1 | Reference Example 2 | Reference Example 3 | Reference Example 4 |
| Spinning condition | Spinning temperature | ° C. | 345 | 345 | 345 | 345 | 345 | 345 | 325 | 320 | 340 |
| | Amount of discharge | g/min | 3.0 | 2.4 | 3.0 | 4.5 | 6.0 | 21.6 | 3.0 | 3.0 | 3.0 |
| | Hole diameter of die | mm | 0.13 | 0.10 | 0.13 | 0.15 | 0.13 | 0.13 | 0.13 | 0.13 | 0.13 |
| | Land length | mm | 0.26 | 0.20 | 0.26 | 0.30 | 0.26 | 0.26 | 0.26 | 0.26 | 0.26 |
| | L/D | | 2.0 | 2.0 | 2.0 | 2.0 | 2.0 | 2.0 | 2.0 | 2.0 | 2.0 |
| | Number of holes | | 5 | 5 | 5 | 5 | 10 | 36 | 5 | 5 | 5 |
| | Spinning speed | m/min | 1200 | 1200 | 600 | 500 | 1200 | 1200 | 600 | 600 | 600 |
| | Spinning draft | | 32 | 24 | 16 | 12 | 32 | 32 | 16 | 16 | 16 |
| | Fiber formation property | | ◎ | ○ | ◎ | ◎ | ◎ | ◎ | ◎ | ◎ | ◎ |
| Characteristics of spun fiber | Fineness | dtex | 5.0 | 4.0 | 10.0 | 18.0 | 50.1 | 180.5 | 10.0 | 10.0 | 10.0 |
| | Fluctuation rate of fineness | % | 3 | 5 | 3 | 2 | 1 | 1 | 3 | 3 | 3 |
| | Number of filaments | | 1 | 1 | 1 | 1 | 10 | 36 | 1 | 1 | 1 |
| | Fineness of single fiber | dtex | 5.0 | 4.0 | 10.0 | 18.0 | 5.0 | 5.0 | 10.0 | 10.0 | 10.0 |
| | Strength | cN/dtex | 5.9 | 5.1 | 5.6 | 5.5 | 5.6 | 5.3 | 8.8 | 5.1 | 5.3 |
| | Fluctuation rate of tenacity | % | 11 | 11 | 7 | 8 | 11 | 10 | 12 | 14 | 9 |
| | Elongation | % | 1.3 | 1.1 | 1.1 | 1.1 | 1.2 | 1.1 | 2.0 | 1.2 | 1.2 |
| | Elastic modulus | cN/dtex | 511 | 590 | 501 | 491 | 478 | 443 | 565 | 414 | 421 |
| | Tm1 | ° C. | 298 | 298 | 296 | 295 | 297 | 297 | 286 | 278 | 292 |
| | ΔHm1 | J/g | 2.9 | 2.9 | 2.7 | 2.6 | 2.9 | 3.0 | 3.2 | 2.6 | 2.5 |
| | Half width of peak at Tm1 | ° C. | 42 | 40 | 41 | 37 | 40 | 42 | 45 | 39 | 41 |
| | Tc | ° C. | 234 | 238 | 235 | 232 | 235 | 234 | 233 | 226 | 233 |
| | ΔHc | J/g | 1.0 | 1.0 | 1.0 | 1.0 | 1.0 | 1.1 | 5.9 | 1.1 | 1.0 |
| | Tm2 | ° C. | 315 | 314 | 313 | 314 | 315 | 313 | 285 | 288 | 312 |
| | ΔHm2 | J/g | 1.2 | 1.1 | 1.2 | 1.2 | 1.2 | 1.2 | 1.6 | 1.3 | 1.1 |
| | ΔHc/ΔHm2 | | 0.8 | 0.9 | 0.8 | 0.8 | 0.8 | 0.9 | 3.7 | 0.8 | 0.9 |

TABLE 2-continued

| | | | Example 19 | Example 20 | Example 21 | Example 22 | Example 23 | Example 47 | Example 49 | Comparative Example 7 |
|---|---|---|---|---|---|---|---|---|---|---|
| | Resin | | Reference Example 5 | Reference Example 6 | Reference Example 7 | Reference Example 8 | Reference Example 9 | Reference Example 1 | Reference Example 1 | Reference Example 1 |
| Spinning condition | Spinning temperature | ° C. | 375 | 360 | 320 | 370 | 320 | 345 | 345 | 345 |
| | Amount of discharge | g/min | 3.0 | 3.0 | 3.0 | 3.0 | 3.0 | 2.5 | 2.4 | 3.0 |
| | Hole diameter of die | mm | 0.13 | 0.13 | 0.13 | 0.13 | 0.13 | 0.10 | 0.10 | 0.50 |
| | Land length | mm | 0.26 | 0.26 | 0.26 | 0.26 | 0.26 | 0.20 | 0.20 | 0.50 |
| | L/D | | 2.0 | 2.0 | 2.0 | 2.0 | 2.0 | 2.0 | 2.0 | 1.0 |
| | Number of holes | | 5 | 5 | 5 | 5 | 5 | 10 | 5 | 1 |
| | Spinning speed | m/min | 600 | 600 | 600 | 600 | 600 | 1000 | 1200 | 600 |
| | Spinning draft | | 16 | 16 | 16 | 16 | 16 | 31 | 24 | 9 |
| | Fiber formation property | | ○ | ◎ | ◎ | ◎ | ◎ | ○ | ○ | Δ |
| Characteristics of spun fiber | Fineness | dtex | 10.0 | 10.0 | 10.0 | 10.0 | 10.0 | 2.5 | 4.0 | 51.0 |
| | Fluctuation rate of fineness | % | 5 | 3 | 3 | 21 | 12 | 4 | 4 | 31 |
| | Number of filaments | | 1 | 1 | 1 | 1 | 1 | 1 | 1 | 1 |
| | Fineness of single fiber | dtex | 10.0 | 10.0 | 10.0 | 10.0 | 10.0 | 2.5 | 4.0 | 51.0 |
| | Strength | cN/dtex | 4.9 | 5.0 | 5.1 | 5.2 | 5.1 | 5.3 | 5.1 | 6.7 |
| | Fluctuation rate of tenacity | % | 14 | 12 | 14 | 18 | 17 | 12 | 10 | 15 |
| | Elongation | % | 1.1 | 1.2 | 1.2 | 1.2 | 1.2 | 1.0 | 1.1 | 1.3 |
| | Elastic modulus | cN/dtex | 564 | 473 | 453 | 532 | 463 | 482 | 590 | 396 |
| | Tm1 | ° C. | 336 | 307 | 281 | 321 | 283 | 296 | 298 | 298 |
| | ΔHm1 | J/g | 2.4 | 2.6 | 2.7 | 2.4 | 2.6 | 2.6 | 2.9 | 2.9 |
| | Half width of peak at Tm1 | ° C. | 42 | 43 | 42 | 41 | 42 | 42 | 40 | 30 |
| | Tc | ° C. | 277 | 235 | 221 | 265 | 228 | 228 | 238 | 232 |
| | ΔHc | J/g | 1.1 | 1.0 | 1.0 | 1.0 | 1.2 | 1.2 | 1.0 | 1.0 |
| | Tm2 | ° C. | 352 | 328 | 296 | 340 | 295 | 295 | 314 | 315 |
| | ΔHm2 | J/g | 1.1 | 1.1 | 1.2 | 1.2 | 1.3 | 1.3 | 1.1 | 1.2 |
| | ΔHc/ΔHm2 | | 1.0 | 0.9 | 0.8 | 0.8 | 0.9 | 0.9 | 0.9 | 0.8 |

TABLE 3

| | | | Example 1 | Example 10 | Example 11 | Example 12 | Example 13 | Example 14 | Example 15 |
|---|---|---|---|---|---|---|---|---|---|
| Solid phase polymerization | Formation | | Rewinding | Rewinding | Rewinding | Rewinding | Rewinding | Rewinding | Rewinding |
| | Winding density | $g/cm^3$ | 0.08 | 0.12 | 0.06 | 0.06 | 0.08 | 0.08 | 0.08 |
| | Final temperature | ° C. | 295 | 295 | 295 | 295 | 295 | 295 | 295 |
| Fiber characteristics after solid phase polymerization | Fineness | dtex | 5.0 | 4.0 | 10.0 | 18.0 | 50.1 | 180.4 | 10.0 |
| | Fluctuation rate of fineness | % | 4 | 5 | 3 | 2 | 1 | 1 | 3 |
| | Number of filaments | | 1 | 1 | 1 | 1 | 10 | 36 | 1 |
| | Fineness of single fiber | dtex | 5.0 | 4.0 | 10.0 | 18.0 | 5.0 | 5.0 | 10.0 |
| | Strength | cN/dtex | 26.5 | 18.2 | 24.2 | 21.4 | 22.1 | 20.3 | 22.1 |
| | Fluctuation rate of tenacity | % | 8 | 17 | 9 | 14 | 10 | 11 | 11 |
| | Elongation | % | 3.0 | 2.4 | 2.8 | 2.7 | 2.8 | 2.6 | 3.1 |
| | Elastic modulus | cN/dtex | 1002 | 860 | 891 | 844 | 833 | 805 | 853 |
| | Tm1 | ° C. | 332 | 336 | 333 | 330 | 338 | 335 | 326 |
| | ΔHm1 | J/g | 8.4 | 8.8 | 7.2 | 6.9 | 8.8 | 8.1 | 10.1 |
| | Half width of peak at Tm1 | ° C. | 12 | 11 | 12 | 13 | 11 | 12 | 7 |
| | Tc | ° C. | 272 | 273 | 272 | 270 | 274 | 275 | 225 |
| | ΔHc | J/g | 3.5 | 3.6 | 3.4 | 3.3 | 3.5 | 3.6 | 2.7 |
| | Tm2 | ° C. | 328 | 328 | 327 | 325 | 326 | 327 | 318 |
| | ΔHm2 | J/g | 1.3 | 1.2 | 1.9 | 1.8 | 1.3 | 1.3 | 1.1 |
| | ΔHc/ΔHm2 | | 2.7 | 3.0 | 1.8 | 1.8 | 2.7 | 2.8 | 2.5 |
| | Abrasion resistance C | times | 4 | 4 | 5 | 5 | 10 | 9 | 1 |
| | Abrasion resistance M | second | 3 | 4 | 3 | 3 | 13 | 11 | 1 |

| | | | Example 17 | Example 18 | Example 19 | Example 20 | Example 21 | Example 22 | Example 23 |
|---|---|---|---|---|---|---|---|---|---|
| Solid phase polymerization | Formation | | Rewinding | Rewinding | Rewinding | Rewinding | Rewinding | Rewinding | Rewinding |
| | Winding density | $g/cm^3$ | 0.06 | 0.06 | 0.06 | 0.06 | 0.06 | 0.06 | 0.06 |
| | Final temperature | ° C. | 275 | 290 | 325 | 305 | 280 | 320 | 280 |

TABLE 3-continued

| | | | | | | | | | |
|---|---|---|---|---|---|---|---|---|---|
| Fiber characteristics after solid phase polymerization | Fineness | dtex | 10.0 | 10.0 | 10.0 | 10.0 | 10.0 | 10.0 | 10.0 |
| | Fluctuation rate of fineness | % | 3 | 4 | 5 | 3 | 3 | 21 | 12 |
| | Number of filaments | | 1 | 1 | 1 | 1 | 1 | 1 | 1 |
| | Fineness of single fiber | dtex | 10.0 | 10.0 | 10.0 | 10.0 | 10.0 | 10.0 | 10.0 |
| | Strength | cN/dtex | 20.4 | 18.1 | 21.7 | 24.4 | 22.1 | 24.7 | 22.4 |
| | Fluctuation rate of tenacity | % | 14 | 9 | 18 | 14 | 13 | 20 | 19 |
| | Elongation | % | 3.0 | 2.8 | 2.8 | 2.7 | 2.8 | 2.8 | 2.8 |
| | Elastic modulus | cN/dtex | 821 | 684 | 795 | 911 | 854 | 942 | 864 |
| | Tm1 | ° C. | 310 | 328 | 361 | 345 | 308 | 355 | 313 |
| | ΔHm1 | J/g | 7.2 | 7.5 | 9.2 | 8.9 | 7.8 | 8.5 | 7.7 |
| | Half width of peak at Tm1 | ° C. | 11 | 12 | 12 | 12 | 11 | 12 | 11 |
| | Tc | ° C. | 255 | 264 | 300 | 282 | 253 | 294 | 251 |
| | ΔHc | J/g | 3.3 | 3.2 | 3.3 | 3.1 | 3.2 | 3.3 | 3.2 |
| | Tm2 | ° C. | 294 | 313 | 355 | 328 | 295 | 343 | 298 |
| | ΔHm2 | J/g | 1.4 | 1.2 | 1.5 | 1.3 | 1.3 | 1.3 | 1.4 |
| | ΔHc/ΔHm2 | | 2.4 | 2.7 | 2.2 | 2.4 | 2.5 | 2.5 | 2.3 |
| | Abrasion resistance C | times | 5 | 4 | 4 | 4 | 5 | 4 | 5 |
| | Abrasion resistance M | second | 4 | 4 | 3 | 3 | 4 | 3 | 4 |

TABLE 4

| | | | Example 1 | Example 2 | Example 3 | Comparative Example 1 | Example 4 | Example 5 | Example 6 |
|---|---|---|---|---|---|---|---|---|---|
| Fiber served to heat treatment (fiber carried out with solid phase polymerization) | | | Example 1 | Example 1 | Example 1 | Example 1 | Example 1 | Example 1 | Example 1 |
| Heat Treatment | Treatment temperature | ° C. | 450 | 380 | 420 | 310 | 520 | 350 | 500 |
| | Treatment length | mm | 500 | 500 | 500 | 500 | 500 | 500 | 50 |
| | Treatment speed | m/min | 150 | 30 | 30 | 30 | 500 | 10 | 300 |
| | Treatment time | sec | 0.20 | 1.00 | 1.00 | 1.00 | 0.060 | 3.00 | 0.01 |
| | Running tension | gf | 0.80 | 0.80 | 0.60 | 0.90 | 2.00 | 0.50 | 1.70 |
| | Running stress | cN/dtex | 0.16 | 0.16 | 0.12 | 0.18 | 0.39 | 0.10 | 0.33 |
| | Running stability | | ○ | ○ | Δ | ○ | Δ | ○ | Δ |
| Fiber characteristics after heat treatment | Fineness | dtex | 5.0 | 5.0 | 5.0 | 5.0 | 5.0 | 5.0 | 5.0 |
| | Fluctuation rate of fineness | % | 4 | 4 | 4 | 4 | 9 | 4 | 6 |
| | Number of filaments | | 1 | 1 | 1 | 1 | 1 | 1 | 1 |
| | Fineness of single fiber | dtex | 5.0 | 5.0 | 5.0 | 5.0 | 5.0 | 5.0 | 5.0 |
| | Strength | cN/dtex | 18.2 | 20.1 | 15.1 | 23.3 | 14.1 | 19.1 | 16.7 |
| | Fluctuation rate of tenacity | % | 8 | 8 | 8 | 8 | 18 | 8 | 15 |
| | Elongation | % | 3.0 | 3.0 | 3.0 | 3.0 | 2.9 | 3.0 | 3.0 |
| | Elastic modulus | cN/dtex | 722 | 886 | 624 | 924 | 511 | 785 | 642 |
| | Tm1 | ° C. | 319 | 327 | 316 | 330 | 312 | 322 | 317 |
| | ΔHm1 | J/g | 3.1 | 5.6 | 2.7 | 8.0 | 2.4 | 5.4 | 3.1 |
| | Reduction rate of heat of melting | % | 63 | 33 | 68 | 5 | 71 | 36 | 63 |
| | Half width of peak at Tm1 | ° C. | 28 | 15 | 33 | 13 | 42 | 20 | 21 |
| | Tc | ° C. | 275 | 275 | 273 | 272 | 279 | 274 | 277 |
| | ΔHc | J/g | 3.5 | 3.4 | 3.5 | 3.5 | 4.0 | 3.7 | 3.9 |
| | Tm2 | ° C. | 330 | 329 | 329 | 328 | 333 | 330 | 331 |
| | ΔHm2 | J/g | 0.8 | 1.2 | 0.7 | 1.3 | 1.6 | 1.4 | 1.5 |
| | ΔHc/ΔHm2 | | 4.4 | 2.8 | 5.0 | 2.7 | 2.5 | 2.6 | 2.6 |
| | Abrasion resistance C | times | 72 | 12 | 45 | 4 | 75 | 15 | 32 |
| | Abrasion resistance M | second | 84 | 17 | 50 | 6 | 88 | 19 | 41 |

| | | | Example 7 | Example 8 | Example 9 | Example 10 | Example 11 | Example 12 |
|---|---|---|---|---|---|---|---|---|
| Fiber served to heat treatment (fiber carried out with solid phase polymerization) | | | Example 1 | Example 1 | Example 1 | Example 10 | Example 11 | Example 12 |
| Heat Treatment | Treatment temperature | ° C. | 380 | 430 | 430 | 400 | 490 | 420 |
| | Treatment length | mm | 2000 | 500 | 500 | 500 | 500 | 1000 |
| | Treatment speed | m/min | 300 | 150 | 150 | 30 | 200 | 100 |
| | Treatment time | sec | 0.40 | 0.20 | 0.20 | 1.00 | 0.15 | 0.60 |
| | Running tension | gf | 1.80 | 1.00 | 5.50 | 0.70 | 1.30 | 1.00 |
| | Running stress | cN/dtex | 0.35 | 0.20 | 1.15 | 0.17 | 0.13 | 0.05 |
| | Running stability | | Δ | ○ | Δ | ○ | ○ | ○ |
| Fiber characteristics after heat treatment | Fineness | dtex | 5.0 | 4.9 | 4.7 | 4.0 | 10.0 | 18.0 |
| | Fluctuation rate of fineness | % | 5 | 7 | 13 | 5 | 3 | 2 |
| | Number of filaments | | 1 | 1 | 1 | 1 | 1 | 1 |
| | Fineness of single fiber | dtex | 5.0 | 4.9 | 4.7 | 4.0 | 10.0 | 18.0 |
| | Strength | cN/dtex | 14.8 | 19.1 | 20.9 | 16.1 | 16.6 | 16.0 |
| | Fluctuation rate of tenacity | % | 10 | 16 | 28 | 17 | 9 | 14 |
| | Elongation | % | 2.9 | 2.8 | 2.4 | 2.4 | 2.8 | 2.7 |
| | Elastic modulus | cN/dtex | 579 | 796 | 862 | 615 | 688 | 658 |

TABLE 4-continued

| | | | | | | | |
|---|---|---|---|---|---|---|---|
| Tm1 | ° C. | 314 | 322 | 327 | 315 | 314 | 319 |
| ΔHm1 | J/g | 3.0 | 3.8 | 5.9 | 3.1 | 2.8 | 3.9 |
| Reduction rate of heat of melting | % | 64 | 55 | 30 | 65 | 61 | 43 |
| Half width of peak at Tm1 | ° C. | 24 | 24 | 17 | 26 | 29 | 22 |
| Tc | ° C. | 277 | 275 | 274 | 272 | 274 | 271 |
| ΔHc | J/g | 3.9 | 3.7 | 3.6 | 3.3 | 3.1 | 3.5 |
| Tm2 | ° C. | 331 | 330 | 329 | 331 | 327 | 328 |
| ΔHm2 | J/g | 1.6 | 1.5 | 1.4 | 0.9 | 0.9 | 1.2 |
| ΔHc/ΔHm2 | | 2.4 | 2.5 | 2.6 | 3.7 | 3.4 | 2.9 |
| Abrasion resistance C | times | 38 | 29 | 9 | 48 | 42 | 31 |
| Abrasion resistance M | second | 48 | 36 | 11 | 55 | 52 | 39 |

Examples 2-7, Comparative Example 1

Using a fiber after solid phase polymerization obtained by a process similar to that in Example 1, a heat treatment was carried out by a method similar to that in Example 1 other than changing the conditions of treatment temperature, treatment speed and treatment length to those shown in Table 4. In case where the running tension was low (Example 3), in case where the treatment temperature was high (Examples 4, 6) and in case where the treatment length was long (Example 7), although the yarn swing became great, yarn breakage and breakage by fusion did not occur, and the running was stable. The characteristics of the obtained fibers are shown together in Table 4. In Comparative Example 1 where the treatment temperature was Tm1 of the fiber or lower, the abrasion resistance did not increase as compared with that of the fiber before treatment, but in Examples 2-7 each where a high-temperature heat treatment was carried out at a condition of Tm1+10° C. or higher, it is understood that a liquid crystalline polyester fiber high in strength, elastic modulus and thermal resistance (high melting point) and excellent in abrasion resistance can be obtained.

Examples 8, 9

Using a fiber after solid phase polymerization obtained by a process similar to that in Example 1, a heat treatment was carried out by a method similar to that in Example 1 other than changing the treatment temperature to those shown in Table 4 and applying a stretch of 1.03 times or 1.07 times (stretch rate: 3% or 7%) between positions before and after the slit heater. In Example 9 where 1.07 times stretch was applied, although the yarn swing became great, yarn breakage and breakage by fusion did not occur, and the running was stable. The characteristics of the obtained fibers are shown together in Table 4, and it is understood that a liquid crystalline polyester fiber high in strength, elastic modulus and thermal resistance (high melting point) and excellent in abrasion resistance can be obtained, by carrying out a high-temperature heat treatment at a condition of Tm1+10° C. or higher. Further, in Example 8, the reduction rate of heat of melting was great and the effect for increasing the abrasion resistance was also great, as compared with the fiber of Example 9 in that the stretch rate is higher and the running tension is greater than those of Example 8.

Examples 10-12

The melt spinning was carried out by a method similar to that in Example 1 other than changing the discharge amount, the hole diameter of die, the land length and the spinning speed to those shown in Table 2. The fiber was rewound by a method similar to that in Example 1, and solid phase polymerization and unwinding were carried out (Table 3). Further, the heat treatment was carried out by a method similar to that in Example 1 other than changing the heat treatment temperature, treatment length and treatment speed to those shown in Table 4. The yarn swing was little and the running was stable.

The characteristics of the obtained fibers are also shown in Table 4, and it is understood that a liquid crystalline polyester fiber high in strength, elastic modulus and thermal resistance (high melting point) and excellent in abrasion resistance can be obtained, by carrying out a high-temperature heat treatment at a condition of Tm1+10° C. or higher even in case of a fibers having a different single-fiber fineness.

Examples 13, 14

The melt spinning was carried out by a method similar to that in Example 1 other than changing the discharge amount and the number of die holes to those shown in Table 2, 10 filaments were wound together, and spun fiber was obtained (Example 13). Further, the melt spinning was carried out by a method similar to that in Example 1 other than changing the discharge amount and the number of die holes to those shown in Table 2, 36 filaments were wound together, and spun fiber was obtained (Example 14). The fiber was rewound by a method similar to that in Example 1, and solid phase polymerization and unwinding were carried out (Table 3). Furthermore, the heat treatment was carried out by a method similar to that in Example 1 other than changing the heat treatment temperature, treatment length and treatment speed to those shown in Table 5, and a liquid crystalline polyester fiber was obtained. The characteristics of the fibers are shown in Table 5, and it is understood that, even in case of multifilament, a liquid crystalline polyester fiber high in strength, elastic modulus and thermal resistance (high melting point) and excellent in abrasion resistance can be obtained, by carrying out a high-temperature heat treatment at a condition of Tm1+10° C. or higher.

TABLE 5

| | | | Example 13 | Example 14 | Example 15 | Example 16 | Example 17 | Example 18 |
|---|---|---|---|---|---|---|---|---|
| Fiber served to heat treatment (fiber carried out with solid phase polymerization) | | | Example 13 | Example 14 | Example 15 | Example 15 | Example 17 | Example 18 |
| Heat Treatment | Treatment temperature | ° C. | 400 | 400 | 450 | 350 | 450 | 470 |
| | Treatment length | mm | 1000 | 1000 | 500 | 500 | 500 | 500 |

TABLE 5-continued

| | | | | | | | | |
|---|---|---|---|---|---|---|---|---|
| | Treatment speed | m/min | 30 | 30 | 150 | 30 | 150 | 150 |
| | Treatment time | sec | 2.00 | 2.00 | 0.20 | 1.00 | 0.20 | 0.20 |
| | Running tension | gf | 0.80 | 0.70 | 1.00 | 0.70 | 1.20 | 1.20 |
| | Running stress | cN/dtex | 0.02 | 0.004 | 0.098 | 0.07 | 0.12 | 0.12 |
| | Running stability | | ○ | ○ | ○ | ○ | ○ | ○ |
| Fiber char-acteristics after heat treatment | Fineness | dtex | 50.1 | 180.3 | 10.0 | 10.0 | 10.0 | 10.0 |
| | Fluctuation rate of fineness | % | 1 | 1 | 3 | 3 | 3 | 4 |
| | Number of filaments | | 10 | 36 | 1 | 1 | 1 | 1 |
| | Fineness of single fiber | dtex | 5.0 | 5.0 | 10.0 | 10.0 | 10.0 | 10.0 |
| | Strength | cN/dtex | 17.7 | 16.1 | 16.3 | 18.5 | 14.2 | 14.1 |
| | Fluctuation rate of tenacity | % | 10 | 10 | 11 | 11 | 14 | 9 |
| | Elongation | % | 2.8 | 2.5 | 3.1 | 3.1 | 3.0 | 2.8 |
| | Elastic modulus | cN/dtex | 742 | 656 | 633 | 686 | 601 | 571 |
| | Tm1 | ° C. | 325 | 327 | 311 | 322 | 304 | 321 |
| | ΔHm1 | J/g | 4.9 | 4.9 | 3.7 | 7.0 | 2.8 | 1.9 |
| | Reduction rate of heat of melting | % | 44 | 40 | 63 | 31 | 61 | 75 |
| | Half width of peak at Tm1 | ° C. | 20 | 18 | 20 | 15 | 35 | 28 |
| | Tc | ° C. | 273 | 271 | 230 | 227 | 251 | 283 |
| | ΔHc | J/g | 3.0 | 2.9 | 2.7 | 2.7 | 2.6 | 2.8 |
| | Tm2 | ° C. | 328 | 327 | 305 | 310 | 306 | 333 |
| | ΔHm2 | J/g | 1.3 | 1.4 | 2.2 | 2.4 | 0.8 | 0.9 |
| | ΔHc/ΔHm2 | | 2.3 | 2.1 | 1.2 | 1.1 | 3.3 | 3.1 |
| | Abrasion resistance C | times | 21 | 16 | 19 | 6 | 41 | 39 |
| | Abrasion resistance M | second | 26 | 24 | 23 | 9 | 59 | 54 |

| | | | Example 19 | Example 20 | Example 21 | Example 22 | Example 23 |
|---|---|---|---|---|---|---|---|
| Fiber served to heat treatment (fiber carried out with solid phase polymerization) | | | Example 19 | Example 20 | Example 21 | Example 22 | Example 23 |
| Heat Treatment | Treatment temperature | ° C. | 500 | 480 | 450 | 490 | 450 |
| | Treatment length | mm | 500 | 500 | 500 | 500 | 500 |
| | Treatment speed | m/min | 150 | 150 | 150 | 150 | 150 |
| | Treatment time | sec | 0.20 | 0.20 | 0.20 | 0.20 | 0.20 |
| | Running tension | gf | 1.20 | 1.20 | 1.20 | 1.20 | 1.20 |
| | Running stress | cN/dtex | 0.12 | 0.12 | 0.12 | 0.12 | 0.12 |
| | Running stability | | ○ | ○ | ○ | Δ | Δ |
| Fiber characteristics after heat treatment | Fineness | dtex | 10.0 | 10.0 | 10.0 | 10.0 | 10.0 |
| | Fluctuation rate of fineness | % | 4 | 3 | 3 | 21 | 12 |
| | Number of filaments | | 1 | 1 | 1 | 1 | 1 |
| | Fineness of single fiber | dtex | 10.0 | 10.0 | 10.0 | 10.0 | 10.0 |
| | Strength | cN/dtex | 14.1 | 17.0 | 16.1 | 17.2 | 15.9 |
| | Fluctuation rate of tenacity | % | 18 | 14 | 13 | 20 | 19 |
| | Elongation | % | 1.9 | 2.7 | 2.8 | 2.8 | 2.8 |
| | Elastic modulus | cN/dtex | 712 | 642 | 605 | 661 | 614 |
| | Tm1 | ° C. | 353 | 338 | 306 | 343 | 305 |
| | ΔHm1 | J/g | 2.8 | 3.1 | 3.5 | 3.0 | 3.6 |
| | Reduction rate of heat of melting | % | 70 | 65 | 55 | 65 | 53 |
| | Half width of peak at Tm1 | ° C. | 18 | 26 | 38 | 21 | 36 |
| | Tc | ° C. | 310 | 293 | 255 | 301 | 263 |
| | ΔHc | J/g | 3.4 | 3.0 | 2.8 | 3.3 | 2.8 |
| | Tm2 | ° C. | 357 | 347 | 317 | 351 | 312 |
| | ΔHm2 | J/g | 0.9 | 1.0 | 1.1 | 0.9 | 1.0 |
| | ΔHc/ΔHm2 | | 3.8 | 3.0 | 1.1 | 3.7 | 2.8 |
| | Abrasion resistance C | times | 16 | 36 | 22 | 35 | 32 |
| | Abrasion resistance M | second | 25 | 45 | 37 | 42 | 40 |

Examples 15-23

Using the liquid crystalline polyesters of Reference Examples 2-9, melt spinning and rewinding were carried out by methods similar to those in Example 1 other than changing the spinning temperatures to those shown in Table 2. With the temperature and time for solid phase polymerization, the temperature was elevated from a room temperature to 220° C. for about 30 minutes, after keeping at 220° C. for 3 hours, the temperature was elevated up to a final temperature described in Table 3 at a temperature elevation rate of 4° C./hour, and further, the temperature was kept at the final temperature for 15 hours.

Thereafter, the fiber was unwound and carried out with heat treatment by a method similar to that in Example 1 other than changing the treatment temperature and treatment speed to those shown in Table 5. In Examples 22, 23 using the liquid crystalline polyesters of Reference Examples 8 and 9, although the yarn swing became great, yarn breakage and breakage by fusion did not occur, and the running was stable. The characteristics of the obtained fibers are shown in Table 5. In Examples 15, 16 using the liquid crystalline polyester of Reference Example 2, even in case where the abrasion resistance of the fiber served to heat treatment was low, the abrasion resistance was improved by the heat treatment, and even in case of using the liquid crystalline polyesters of Reference Examples 2-9, it is understood that a liquid crystalline polyester fiber high in strength, elastic modulus and thermal resistance (high melting point) and excellent in abrasion resistance can be obtained by carrying out a high-temperature heat treatment at a condition of Tm1+10° C. or higher.

Next, the liquid crystalline polyester fiber particularly excellent in abrasion resistance, which is the first invention of the present invention, will be explained using Examples 24-38 and Comparative Examples 2-4.

Example 24

The determination of test weaving was carried out using the fiber after heat treatment obtained in Example 1. The conditions therefor were set as described in the aforementioned items of weavability and determination of fiber characteristics (Item 1). The result of determination is shown in Table 6, and in the fiber according to the present invention wherein the half width of peak at Tm1 is 15° C. or more and the strength is 12.0 cN/dtex or more, it is understood that the value of the times of machine stopping is zero and the weavability is good, and the number of fibrils is one and the quality of the fabric is also good.

TABLE 6

| | | | Example 24 | Example 25 | Example 26 | Comparative Example 2 | Example 27 |
|---|---|---|---|---|---|---|---|
| Fiber served to heat treatment (fiber carried out with solid phase polymerization) | | | Fiber after heat treatment in Example 1 | Fiber after heat treatment in Example 2 | Fiber after heat treatment in Example 3 | Fiber after heat treatment in Comparative Example 1 | Fiber after heat treatment in Example 10 |
| Heat Treatment | Treatment temperature | ° C. | | | | | |
| | Treatment length | mm | | | | | |
| | Treatment speed | m/min | | | | | |
| | Treatment time | sec | | | | | |
| | Running tension | gf | | | | | |
| | Running stress | cN/dtex | | | | | |
| | Running stability | | | | | | |
| Fiber characteristics served to test weaving | Fineness | dtex | 5.0 | 5.0 | 5.0 | 5.0 | 4.0 |
| | Fluctuation rate of fineness | % | 4 | 4 | 4 | 4 | 5 |
| | Number of filaments | | 1 | 1 | 1 | 1 | 1 |
| | Fineness of single fiber | dtex | 5.0 | 5.0 | 5.0 | 5.0 | 4.0 |
| | Strength | cN/dtex | 18.2 | 20.1 | 15.1 | 23.3 | 16.1 |
| | Fluctuation rate of tenacity | % | 8 | 8 | 8 | 8 | 17 |
| | Elongation | % | 3.0 | 3.0 | 3.0 | 3.0 | 2.4 |
| | Elastic modulus | cN/dtex | 772 | 886 | 624 | 924 | 615 |
| | Tm1 | ° C. | 319 | 327 | 316 | 330 | 315 |
| | ΔHm1 | J/g | 3.1 | 5.6 | 2.7 | 8.0 | 3.1 |
| | Reduction rate of heat of melting | % | 63 | 33 | 68 | 5 | 65 |
| | Half width of peak at Tm1 | ° C. | 28 | 15 | 33 | 13 | 26 |
| | Tc | ° C. | 275 | 275 | 273 | 272 | 272 |
| | ΔHc | J/g | 3.5 | 3.4 | 3.5 | 3.5 | 3.3 |
| | Tm2 | ° C. | 330 | 329 | 329 | 328 | 331 |
| | ΔHm2 | J/g | 0.8 | 1.2 | 0.7 | 1.3 | 0.9 |
| | ΔHc/ΔHm2 | | 4.4 | 2.8 | 5.0 | 2.7 | 3.7 |
| | Abrasion resistance C | times | 72 | 12 | 45 | 4 | 48 |
| | Abrasion resistance M | second | 84 | 17 | 50 | 6 | 55 |
| Weaving | Weavability (times of machine stopping) | | ○ (0 time) | ○ (1 time) | ○ (0 time) | X (2 times) | ○ (0 time) |
| | Quality of fabric (number of fibril) | | ○ (one) | ○ (two) | ○ (one) | X (four) | ○ (one) |

| | | | Example 28 | Example 29 | Example 30 | Example 31 |
|---|---|---|---|---|---|---|
| Fiber served to heat treatment (fiber carried out with solid phase polymerization) | | | Fiber after heat treatment in Example 11 | Fiber after heat treatment in Example 12 | Fiber after heat treatment in Example 13 | Fiber after heat treatment in Example 14 |
| Heat Treatment | Treatment temperature | ° C. | | | | |
| | Treatment length | mm | | | | |
| | Treatment speed | m/min | | | | |
| | Treatment time | sec | | | | |
| | Running tension | gf | | | | |
| | Running stress | cN/dtex | | | | |
| | Running stability | | | | | |
| Fiber characteristics served to test weaving | Fineness | dtex | 10.0 | 18.0 | 50.1 | 180.3 |
| | Fluctuation rate of fineness | % | 3 | 2 | 1 | 1 |
| | Number of filaments | | 1 | 1 | 10 | 36 |
| | Fineness of single fiber | dtex | 10.0 | 18.0 | 5.0 | 5.0 |
| | Strength | cN/dtex | 16.6 | 16.0 | 17.7 | 16.1 |
| | Fluctuation rate of tenacity | % | 9 | 14 | 10 | 10 |
| | Elongation | % | 2.8 | 2.7 | 2.8 | 2.5 |
| | Elastic modulus | cN/dtex | 688 | 658 | 742 | 656 |
| | Tm1 | ° C. | 314 | 319 | 325 | 327 |
| | ΔHm1 | J/g | 2.8 | 3.9 | 4.9 | 4.9 |
| | Reduction rate of heat of melting | % | 61 | 43 | 44 | 40 |
| | Half width of peak at Tm1 | ° C. | 29 | 22 | 20 | 18 |
| | Tc | ° C. | 274 | 271 | 273 | 271 |
| | ΔHc | J/g | 3.1 | 3.5 | 3.0 | 2.9 |
| | Tm2 | ° C. | 327 | 328 | 328 | 327 |
| | ΔHm2 | J/g | 0.9 | 1.2 | 1.3 | 1.4 |
| | ΔHc/ΔHm2 | | 3.4 | 2.9 | 2.3 | 2.1 |
| | Abrasion resistance C | times | 42 | 31 | 21 | 16 |
| | Abrasion resistance M | second | 52 | 39 | 26 | 24 |

TABLE 6-continued

| | | | | | |
|---|---|---|---|---|---|
| Weaving | Weavability (times of machine stopping) | ○ (0 time) | ○ (0 time) | ○ (1 time) | ○ (1 time) |
| | Quality of fabric (number of fibril) | ○ (one) | ○ (one) | ○ (two) | ○ (two) |

Examples 25-31, Comparative Example 2

As shown in Table 6, the determination of test weaving similar to that in Example 24 was carried out using the fibers after heat treatment obtained in Examples 2, 3, Comparative Example 1 and Examples 10-14. The result is shown in Table 6. It is understood that the weavability and the quality of fabric were both good in Examples 25-31 where the half width of peak at Tm1 was 15° C. or more and the strength was 12.0 cN/dtex or more, but the weavability and the quality of fabric were not good in Comparative Example 2 where the half width of peak at Tm1 was 13° C. and the abrasion resistance was poor.

Comparative Example 3

Using the fiber after solid phase polymerization obtained in Example 15, the heat treatment was carried out by a method similar to that in Example 1 other than changing the treatment temperature and the treatment speed to those described in Table 7. The characteristics of the obtained fiber is described in Table 7. Although the result of the determination of test weaving carried out similarly to in Example 24 using this liquid crystalline polyester fiber is also shown in Table 7, it is understood that the half width of peak at Tm1 was 13° C. and the abrasion resistance was poor, and therefore, the weavability and the quality of fabric were not good. Where, in Table 7 of the original Japanese character specification, an abbreviated term is used for "solid phase polymerization", but in this translation, such an abbreviated term is not used.

Comparative Example 4

The fiber after solid phase polymerization obtained in Example 1 was determined as a liquid crystalline polyester fiber at a condition where the heat treatment was not carried out. The characteristics of the fiber is shown in Table 7, it is understood that the polymer composition was equal to that of Example 1, and although high strength, elastic modulus and melting point could be obtained by carrying out solid phase polymerization, because the half width of peak at Tm1 was less than 15° C. and the completion of crystallinity was high, the abrasion resistance C was poor to be 4 times.

The result of the determination of test weaving carried out similarly to that in Example 24 using this liquid crystalline polyester fiber is shown in Table 7. It is understood that the weavability and the quality of fabric were not good because the abrasion resistance was poor.

Comparative Example 5

The spun fiber obtained in Example 1 was determined as a liquid crystalline polyester fiber at a condition where the solid phase polymerization and the heat treatment were not carried out. The characteristics of the fiber is shown in Table 7, it is understood that the polymer composition was equal to that of Example 1, and although the half width of peak at Tm1 was 15° C. or higher and the completion of crystallinity was low, because the solid phase polymerization was not carried out, not only the degree of crystallization was low and high strength, elastic modulus and melting point could not be obtained, but also the abrasion resistance was also poor because the fiber structure was not developed.

The result of the determination of test weaving carried out similarly to that in Example 24 using this liquid crystalline polyester fiber is shown in Table 7. It is understood that the weavability and the quality of fabric were not good because the abrasion resistance was poor.

Examples 32-38

The determination of test weaving similar to that in Example 24 was carried out using the fibers after heat treatment obtained in Examples 17-23. The result is shown in Table 7, and It is understood that the weavability and the quality of fabric were both good also in Examples 32-38 where the half width of peak at Tm1 was 15° C. or more and the strength was 12.0 cN/dtex or more.

TABLE 7

| | | | Comparative Example 3 | Comparative Example 4 | Comparative Example 5 | Example 32 | Example 33 |
|---|---|---|---|---|---|---|---|
| Fiber served to heat treatment (fiber carried out with solid phase polymerization) | | | Example 15 | Fiber after solid phase in Example 1 polymerization (heat treatment not carried out) | Spun fiber in Example 1 (solid phase polymerization and heat treatment not carried out) | Fiber after heat treatment in Example 17 | Fiber after heat treatment in Example 18 |
| Heat Treatment | Treatment temperature | ° C. | 340 | | | | |
| | Treatment length | mm | 500 | | | | |
| | Treatment speed | m/min | 30 | | | | |
| | Treatment time | sec | 1.00 | | | | |
| | Running tension | gf | 0.70 | | | | |
| | Running stress | cN/dtex | 0.07 | | | | |
| | Running stability | | ○ | | | | |
| Fiber characteristics served to test weaving | Fineness | dtex | 10.0 | 5.0 | 5.0 | 10.0 | 10.0 |
| | Fluctuation rate of fineness | % | 3 | 4 | 3 | 3 | 4 |
| | Number of filaments | | 1 | 1 | 1 | 1 | 1 |
| | Fineness of single fiber | dtex | 10.0 | 5.0 | 5.0 | 10.0 | 10.0 |
| | Strength | cN/dtex | 19.2 | 26.5 | 5.9 | 14.2 | 14.1 |
| | Fluctuation rate of tenacity | % | 11 | 8 | 11 | 14 | 9 |
| | Elongation | % | 3.0 | 3.0 | 1.3 | 3.0 | 2.8 |
| | Elastic modulus | cN/dtex | 703 | 1002 | 511 | 601 | 571 |
| | Tm1 | ° C. | 325 | 332 | 298 | 304 | 321 |

TABLE 7-continued

| | | | | | | | |
|---|---|---|---|---|---|---|---|
| | ΔHm1 | J/g | 8.1 | 8.4 | 2.9 | 2.8 | 1.9 |
| | Reduction rate of heat of melting | % | 20 | — | — | 61 | 75 |
| | Half width of peak at Tm1 | ° C. | 13 | 12 | 42 | 35 | 28 |
| | Tc | ° C. | 224 | 272 | 234 | 251 | 283 |
| | ΔHc | J/g | 2.6 | 3.5 | 1.0 | 2.6 | 2.8 |
| | Tm2 | ° C. | 317 | 328 | 315 | 306 | 333 |
| | ΔHm2 | J/g | 1.2 | 1.3 | 1.2 | 0.8 | 0.9 |
| | ΔHc/ΔHm2 | | 2.2 | 2.7 | 0.8 | 3.3 | 3.1 |
| | Abrasion resistance C | times | 4 | 4 | 1 | 41 | 39 |
| | Abrasion resistance M | second | 4 | 3 | 1 | 59 | 54 |
| Weaving | Weavability (times of machine stopping) | | X (2 times) | X (2 times) | X (4 times) | ○ (0 time) | ○ (0 time) |
| | Quality of fabric (number of fibril) | | X (four) | X (four) | X (four) | ○ (one) | ○ (one) |

| | | | Example 34 | Example 35 | Example 36 | Example 37 | Example 38 |
|---|---|---|---|---|---|---|---|
| Fiber served to heat treatment (fiber carried out with solid phase polymerization) | | | Fiber after heat treatment in Example 19 | Fiber after heat treatment in Example 20 | Fiber after heat treatment in Example 21 | Fiber after heat treatment in Example 22 | Fiber after heat treatment in Example 23 |
| Heat Treatment | Treatment temperature | ° C. | | | | | |
| | Treatment length | mm | | | | | |
| | Treatment speed | m/min | | | | | |
| | Treatment time | sec | | | | | |
| | Running tension | gf | | | | | |
| | Running stress | cN/dtex | | | | | |
| | Running stability | | | | | | |
| Fiber characteristics served to test weaving | Fineness | dtex | 10.0 | 10.0 | 10.0 | 10.0 | 10.0 |
| | Fluctuation rate of fineness | % | 4 | 3 | 3 | 21 | 12 |
| | Number of filaments | | 1 | 1 | 1 | 1 | 1 |
| | Fineness of single fiber | dtex | 10.0 | 10.0 | 10.0 | 10.0 | 10.0 |
| | Strength | cN/dtex | 14.1 | 17.0 | 16.1 | 17.2 | 15.9 |
| | Fluctuation rate of tenacity | % | 18 | 14 | 13 | 20 | 19 |
| | Elongation | % | 1.9 | 2.7 | 2.8 | 2.8 | 2.8 |
| | Elastic modulus | cN/dtex | 712 | 642 | 605 | 661 | 614 |
| | Tm1 | ° C. | 353 | 338 | 306 | 343 | 305 |
| | ΔHm1 | J/g | 2.8 | 3.1 | 3.5 | 3.0 | 3.6 |
| | Reduction rate of heat of melting | % | 70 | 65 | 55 | 65 | 53 |
| | Half width of peak at Tm1 | ° C. | 18 | 26 | 38 | 21 | 36 |
| | Tc | ° C. | 310 | 293 | 255 | 301 | 263 |
| | ΔHc | J/g | 3.4 | 3.0 | 2.8 | 3.3 | 2.8 |
| | Tm2 | ° C. | 357 | 347 | 317 | 351 | 312 |
| | ΔHm2 | J/g | 0.9 | 1.0 | 1.1 | 0.9 | 1.0 |
| | ΔHc/ΔHm2 | | 3.8 | 3.0 | 1.1 | 3.7 | 2.8 |
| | Abrasion resistance C | times | 16 | 36 | 22 | 35 | 32 |
| | Abrasion resistance M | second | 25 | 45 | 37 | 42 | 40 |
| Weaving | Weavability (times of machine stopping) | | ○ (0 time) | ○ (0 time) | ○ (0 time) | ○ (0 time) | ○ (0 time) |
| | Quality of fabric (number of fibril) | | ○ (one) | ○ (one) | ○ (one) | ○ (one) | ○ (one) |

Next, the process for solid phase polymerization of the liquid crystalline polyester fiber, which is the fourth invention of the present invention, will be explained using Examples 39-47 and Comparative Examples 4-6.

Example 39

The melt spinning was carried out by a method similar to that in Example 1, the fiber was unwound from the obtained spun fiber package in a vertical direction (in a direction perpendicular to the fiber circulating direction), and without through a speed control roller, it was rewound by a winder controlled at a constant speed (a speed control winder ET-68S, produced by Kamizu Seisakusyo Corporation) at a speed of 100 m/min. Where, a stainless bobbin with holes and wound thereon with a Kevler felt (weight: 280 g/m$^2$, thickness: 1.5 mm) was used as a core for the rewinding, the tension at the rewinding was set at 0.05 cN/dtex, and the winding amount was set at 60,000 m, namely, 0.03 kg. Further, the package formation was controlled as a taper end winding with a taper angle of 20°, and the traverse width was always oscillated by reconstructing the taper width adjusting mechanism, and without using a contact roller, the contact point between the traverse guide and the fiber was set at 5 mm from the fiber package. Where, the number of winding was set at 5.1. The winding density of the package thus wound was 0.08 g/cc, and the amount of oil adhesion was 1.0 wt %.

This was elevated in temperature from a room temperature to 240° C. for about 30 minutes using a closed type oven, after it was kept at 240° C. for 3 hours, it was elevated in temperature up to 295° C. at a temperature elevation speed of 4° C./hour, and further, solid phase polymerization was carried out at a condition of keeping at 295° C. for 15 hours. Where, as the atmosphere, dehumidified nitrogen was supplied at a flow rate of 25 NL/min, and it was discharged from an exhaust port so as not to pressurize the inside.

The package carried out with solid phase polymerization thus obtained was attached to a delivery device capable of being rotated by an inverter motor, and the fiber was wound by a winder (ET type speed control winder, produced by Kamizu Seisakusyo Corporation) while the fiber was delivered laterally (in a fiber circulating direction) at a fiber supply speed of about 200 m/min, and as a result, the whole amount could be unwound without yarn breakage. The characteristics of the obtained fiber are shown in Table 8, and it is understood that high molecular weight, high strength, high elastic modulus, high melting point and high ΔHm1, which were features of a liquid crystalline polyester fiber carried out with solid phase polymerization, were provided and the fluctuation rate of fineness and the fluctuation rate of tenacity were small even in a small fiber fineness of 5.0 dtex, and the uniformity in the lengthwise direction was also excellent. Where, Δn of this fiber was 0.35, and it had a high orientation, and the coefficient of thermal expansion was −7 ppm/° C. and it had an excellent thermal dimensional stability. Where, "OR" in Table 8 and Tables 9 and 10 described later indicates an oiling roller, "PDMS" indicates dimethyl polysiloxane, and "Mixture" indicates a mixture oil of dimethyl polysiloxane and hydrophilic smectite.

TABLE 8

| | | | Example 39 | Example 40 | Example 41 | Comparative Example 4 | Comparative Example 5 | Example 42 |
|---|---|---|---|---|---|---|---|---|
| | Spun fiber | | Example 1 | Example 1 | Example 1 | Example 1 | Example 1 | Example 12 |
| Rewinding before solid phase polymerization | Formation | | Rewinding | Rewinding | Rewinding | Rewinding | Rewinding | Rewinding |
| | Winding tension | cN/dtex | 0.05 | 0.03 | 0.14 | 0.17 | 0.11 | 0.02 |
| | Contact/non-contact | | Non-contact | Non-contact | Non-contact | Non-contact | Contact | Non-contact |
| | Rewinding speed | | 100 | 100 | 400 | 500 | 100 | 100 |
| | Taper angle | | 20 | 20 | 20 | 20 | 20 | 20 |
| | Winding number | | 5.1 | 5.1 | 12.2 | 14.1 | 5.1 | 5.1 |
| | Winding amount | kg | 0.03 | 0.03 | 0.03 | 0.03 | 0.03 | 0.11 |
| | Winding amount | 10,000 m | 6 | 6 | 6 | 6 | 6 | 6 |
| | Method for adding oil | | none | none | none | none | none | none |
| | Component | | none | none | none | none | none | none |
| | Amount of adhesion | wt % | 1.0 | 1.0 | 1.0 | 1.0 | 1.0 | 1.0 |
| | Winding density | g/cm$^3$ | 0.08 | 0.03 | 0.25 | 0.33 | 0.35 | 0.06 |
| Solid phase polymerization | Total time of solid phase polymerization | hr | 32 | 32 | 32 | 32 | 32 | 32 |
| | Final temperature | ° C. | 295 | 295 | 295 | 295 | 295 | 295 |
| Unwinding | Unwinding speed | | 200 | 200 | 50 | 50 | 50 | 200 |
| | Number of times of breakage of unwound yarn | times/10,000 m | 0 | 0 | 0.17 | X | X | 0 |
| Fiber characteristics after solid phase polymerization | Molecular weight | ×10000 | 42.0 | 42.1 | 42.0 | 42.0 | 42.0 | 40.4 |
| | Fineness | dtex | 5.0 | 5.0 | 5.0 | 5.0 | 5.0 | 18.0 |
| | Fluctuation rate of fineness | % | 4 | 4 | 4 | 5 | 6 | 2 |
| | Number of filaments | | 1 | 1 | 1 | 1 | 1 | 1 |
| | Fineness of single fiber | dtex | 5.0 | 5.0 | 5.0 | 5.0 | 5.0 | 18.0 |
| | Strength | cN/dtex | 26.5 | 26.7 | 22.5 | 19.2 | 17.6 | 21.4 |
| | Fluctuation rate of tenacity | % | 8 | 8 | 13 | 19 | 21 | 14 |
| | Elongation | % | 3.0 | 3.0 | 2.5 | 2.3 | 2.0 | 2.7 |
| | Elastic modulus | cN/dtex | 1002 | 1011 | 965 | 883 | 834 | 844 |
| | Compression elastic modulus | GPa | 0.29 | 0.28 | 0.30 | 0.31 | 0.31 | 0.32 |
| | Δ2θ | ° | 1.3 | 1.3 | 1.3 | 1.3 | 1.3 | 1.4 |
| | Tm1 | ° C. | 332 | 333 | 330 | 329 | 329 | 330 |
| | Exothermic peak | J/g | none | none | none | none | none | none |
| | ΔHm1 | J/g | 8.4 | 8.5 | 8.2 | 8.2 | 8.2 | 6.9 |
| | Half width of peak at Tm1 | ° C. | 12 | 11 | 13 | 13 | 13 | 13 |
| | Tc | ° C. | 272 | 274 | 271 | 271 | 270 | 270 |
| | ΔHc | J/g | 3.5 | 3.5 | 3.4 | 3.3 | 3.3 | 3.3 |
| | Tm2 | ° C. | 328 | 330 | 328 | 328 | 328 | 325 |
| | ΔHm2 | J/g | 1.3 | 1.2 | 1.2 | 1.3 | 1.2 | 1.8 |
| | ΔHm1/ΔHm2 | | 6.5 | 7.1 | 6.8 | 6.3 | 6.8 | 3.8 |
| | Amount of oil adhesion | wt % | 1.0 | 1.0 | 1.0 | 1.0 | 1.0 | 1.0 |
| | Adhesion of polysiloxane | | present | present | present | present | present | present |
| | Abrasion resistance M | second | 3 | 3 | 3 | 3 | 3 | 3 |

| | | | Example 43 | Comparative Example 6 | Example 44 | Example 45 | Example 46 | Example 47 |
|---|---|---|---|---|---|---|---|---|
| | Spun fiber | | Example 15 | Example 1 | Example 13 | Example 14 | Example 1 | Example 47 |
| Rewinding before solid phase polymerization | Formation | | Rewinding | Winding at spinning | Rewinding | Rewinding | Rewinding | Rewinding |
| | Winding tension | cN/dtex | 0.05 | 0.18 | 0.09 | 0.03 | 0.10 | 0.13 |
| | Contact/non-contact | | Non-contact | Non-contact | Non-contact | Non-contact | Non-contact | Non-contact |
| | Rewinding speed | | 100 | none | 200 | 200 | 200 | 200 |
| | Taper angle | | 20 | 10 | 45 | 45 | 30 | 30 |
| | Winding number | | 5.1 | 46.8 | 14.1 | 14.1 | 9.0 | 2.3 |
| | Winding amount | kg | 0.06 | 0.03 | 0.3 | 1.08 | 0.06 | 0.02 |
| | Winding amount | 10,000 m | 6 | 6 | 6 | 6 | 12 | 6 |
| | Method for adding oil | | none | none | none | none | OR | OR |
| | Component | | none | none | none | none | PDMS | Mixture |
| | Amount of adhesion | wt % | 1.0 | 1.0 | 1.2 | 1.2 | 4.4 | 7.8 |
| | Winding density | g/cm$^3$ | 0.08 | 0.91 | 0.27 | 0.28 | 0.14 | 0.26 |
| Solid phase polymerization | Total time of solid phase polymerization | hr | 32 | 32 | 32 | 32 | 32 | 32 |
| | Final temperature | ° C. | 295 | 295 | 295 | 295 | 295 | 295 |
| Unwinding | Unwinding speed | | 200 | 50 | 200 | 200 | 200 | 50 |
| | Number of times of breakage of unwound yarn | times/10,000 m | 0 | X | 0 | 0 | 0 | 0.33 |

TABLE 8-continued

| | | | | | | | | |
|---|---|---|---|---|---|---|---|---|
| Fiber characteristics after solid phase polymerization | Molecular weight | ×10000 | 66.9 | 41.9 | 42.0 | 42.0 | 42.0 | 42.3 |
| | Fineness | dtex | 10.0 | 5.0 | 49.9 | 180.4 | 5.1 | 2.5 |
| | Fluctuation rate of fineness | % | 3 | 11 | 1 | 1 | 3 | 10 |
| | Number of filaments | | 1 | 1 | 10 | 36 | 1 | 1 |
| | Fineness of single fiber | dtex | 10.0 | 5.0 | 5.0 | 5.0 | 5.1 | 2.5 |
| | Strength | cN/dtex | 22.1 | 12.9 | 22.1 | 20.3 | 26.7 | 20.8 |
| | Fluctuation rate of tenacity | % | 11 | 32 | 10 | 11 | 6 | 11 |
| | Elongation | % | 3.1 | 1.6 | 2.8 | 2.6 | 3.1 | 2.8 |
| | Elastic modulus | cN/dtex | 853 | 783 | 833 | 805 | 1013 | 916 |
| | Compression elastic modulus | GPa | 1.12 | 0.31 | 0.29 | 0.29 | 0.29 | 0.29 |
| | Δ2θ | ° | 1.4 | 1.3 | 1.3 | 1.3 | 1.3 | 1.2 |
| | Tm1 | ° C. | 326 | 328 | 338 | 335 | 332 | 335 |
| | Exothermic peak | J/g | none | none | none | none | none | none |
| | ΔHm1 | J/g | 10.1 | 7.9 | 8.8 | 8.1 | 8.4 | 8.7 |
| | Half width of peak at Tm1 | ° C. | 7 | 13 | 11 | 12 | 12 | 10 |
| | Tc | ° C. | 225 | 269 | 274 | 275 | 271 | 274 |
| | ΔHc | J/g | 2.7 | 3.2 | 3.5 | 3.6 | 3.5 | 3.5 |
| | Tm2 | ° C. | 318 | 326 | 326 | 327 | 329 | 330 |
| | ΔHm2 | J/g | 1.1 | 1.3 | 1.3 | 1.3 | 1.2 | 1.3 |
| | ΔHm1/ΔHm2 | | 9.2 | 6.1 | 6.8 | 6.2 | 7.0 | 6.7 |
| | Amount of oil adhesion | wt % | 1.0 | 1.0 | 1.2 | 1.2 | 4.4 | 7.8 |
| | Adhesion of polysiloxane | | present | present | present | present | present | present |
| | Abrasion resistance M | second | 1 | 1 | 13 | 11 | 12 | 5 |

Examples 40, 41, Comparative Examples 4, 5

The melt spinning was carried out by a method similar to that in Example 1, and using the spun fiber obtained, rewinding was carried out by a method similar to that in Example 39 other than changing the rewinding speed and the number of winding to those described in Table 8. Where, in Comparative Example 5, the winding was carried out by contacting a contact roller of a winder used for the rewinding. The winding tension and the winding density at that time are shown in Table 8. It was carried out with solid phase polymerization by a method similar to that in Example 39, and the obtained package was unwound by a method similar to that in Example 39. Although rewinding of the whole amount was possible in Example 40, because yarn breakage occurred at 200 m/min in Example 41, by reducing the unwinding speed down to 50 m/min, yarn breakage once occurred but rewinding of the whole amount was possible. In Comparative Examples 4, 5, yarn breakage occurred many times at an unwinding speed of 200 m/min, and because yarn breakage occurred many times even at 50 m/min, unwinding of the whole amount was impossible.

The characteristics of the obtained fiber are shown in Table 8, and it is understood that the features of the liquid crystalline polyester fiber carried out with solid phase polymerization such as high molecular weight, high melting point, high ΔHm1, etc. were exhibited, but by fusion at the time of solid phase polymerization, the fluctuation rate of fineness slightly increased, the fluctuation rate of tenacity increased and the uniformity in the lengthwise direction deteriorated, and the values of strength and elastic modulus were decreased.

Examples 42, 43

In Example 42, the melt spinning was carried out by a method similar to that in Example 12, and in Example 43, the melt spinning was carried out by a method similar to that in Example 15. Using the fibers obtained, rewinding was carried out by a method similar to that in Example 39. The winding tension, the winding density and the amount of oil adhesion were as shown in Table 8. These were carried out with solid phase polymerization by a method similar to that in Example 39. When the obtained package was unwound by a method similar to that in Example 39, unwinding of the whole amount was possible without yarn breakage. Further, the characteristics of the obtained fiber are also shown in Table 8, and it is understood that the features of the liquid crystalline polyester fiber carried out with solid phase polymerization, which were high molecular weight, high strength, high elastic modulus, high melting point and high ΔHm1, were exhibited even at a single-fiber fineness of 18.0 dtex (Example 42) and even at a different liquid crystalline polyester composition (Example 43), and the fluctuation rate of fineness and the fluctuation rate of tenacity were small and the uniformity in the lengthwise direction was excellent.

Comparative Example 6

When the melt spinning was carried out in a manner similar to that in Example 1, a stainless bobbin with holes was used as a bobbin for winding, and the fiber was wound directly thereonto by 60,000 m. The taper angle, number of winding, winding tension and winding density are shown in Table 8. This was carried out with solid phase polymerization by a method similar to that in Example 39 without being rewound. When the obtained package carried out with solid phase polymerization was unwound by a method similar to that in Example 39, yarn breakage occurred many times at an unwinding speed of 200 m/min, and because yarn breakage occurred many times even at 50 m/min, unwinding of the whole amount was impossible.

The characteristics of the obtained fiber are shown in Table 8, and it is understood that the features of the liquid crystalline polyester fiber carried out with solid phase polymerization such as high molecular weight, high melting point, high ΔHm1, etc. were exhibited, but by fusion at the time of solid phase polymerization, the fluctuation rate of fineness increased, the fluctuation rate of tenacity greatly increased and the uniformity in the lengthwise direction deteriorated, and the values of strength and elastic modulus were decreased.

Examples 44, 45

In Example 44, the melt spinning was carried out by a method similar to that in Example 13, and in Example 45, the melt spinning was carried out by a method similar to that in Example 14. Rewinding thereof was carried out by a method similar to that in Example 39 other than changing the winding speed, taper angle, winding number and winding amount to those described in Table 8. At that time, the winding tension, the winding density and the amount of oil adhesion were as shown in Table 8. These were carried out with solid phase polymerization by a method similar to that in Example 39. When the obtained package was unwound by a method similar to that in Example 39, unwinding of the whole amount was possible without yarn breakage. Further, the characteristics of the obtained fiber are also shown in Table 8, and it is understood that the features of the liquid crystalline polyester fiber carried out with solid phase polymerization, which were high molecular weight, high strength, high elastic modulus, high melting point and high ΔHm1, were exhibited even in case of multifilament, and the fluctuation rate of fineness and the fluctuation rate of tenacity were small and the uniformity in the lengthwise direction was excellent.

Example 46

Using the spun fiber obtained in Example 1, rewinding was carried out by a method similar to that in Example 39 other than changing the rewinding speed, the taper angle, the winding number and the winding amount to those described in Table 8, and further, using water emulsion with 5.0 wt % polydimethyl siloxane (SH200, produced by Dow Corning Toray Co., Ltd.) as the oil and supplying oil by using a stainless roller with a satin finish before the winder. The winding tension, the winding density and the amount of oil adhesion at that time are as shown in Table 8. It was carried out with solid phase polymerization by a method similar to that in Example 39. When the obtained package carried out with solid phase polymerization was unwound by a method similar to that in Example 39, oil adhered to a guide, and although a fluctuation of the running tension was feared, unwinding of the whole amount was possible without yarn breakage. Further, the characteristics of the obtained fiber are also shown in Table 8, and it is understood that the effect for suppressing fusion was further improved by adhesion of oil containing polysiloxane before solid phase polymerization, the features of the liquid crystalline polyester fiber carried out with solid phase polymerization, which were high molecular weight, high strength, high elastic modulus, high melting point and high ΔHm1, were exhibited even in case of increasing the winding amount, and the fluctuation rate of fineness and the fluctuation rate of tenacity were further small and the uniformity in the lengthwise direction was excellent, and the abrasion resistance M was more increased as compared with that in Example 39.

Example 47

Using the resin of Reference Example 1, the spinning was carried out by a method similar to that in Example 1 other than changing the amount of discharge, the hole diameter of die, the land length, the number of die holes and the spinning speed to those described in Table 2, further, providing a heating tube (heat insulating region: 100 mm) under the die, and setting the temperature thereof at 200° C. During the winding for about 100 minutes, although yarn breakage once occurred, the fiber formation property was good. The characteristics of the obtained fiber are shown in Table 2.

Using this spun fiber, rewinding was carried out by a method similar to that in Example 46 other than changing the winding number and the winding amount to those described in Table 8, and further, using water emulsion with 4.0 wt % polydimethyl siloxane (SH200, produced by Dow Corning Toray Co., Ltd.) and 0.2 wt % of hydrophilic smectite ("lusentite" (registered trade mark) SWN, produced by CO-OP Chemical Co., Ltd.) as an additional oil used at the time of rewinding. The winding tension, the winding density and the amount of oil adhesion at that time are as shown in Table 8. It was carried out with solid phase polymerization by a method similar to that in Example 39. When the obtained package carried out with solid phase polymerization was unwound by a method similar to that in Example 1, because yarn breakage occurred at 200 m/min, the speed was reduced down to 50 m/min, and although scum was accumulated on a guide and yarn breakage occurred twice, rewinding of the whole amount was possible. The characteristics of the obtained fiber are shown in Table 8, and it is understood that the features of the liquid crystalline polyester fiber carried out with solid phase polymerization, which were high molecular weight, high strength, high elastic modulus, high melting point and high ΔHm1, were provided, and even in case of very small fiber fineness of 2.5 dtex, the fluctuation rate of fineness and the fluctuation rate of tenacity were small and the uniformity in the lengthwise direction was excellent.

Next, the liquid crystalline polyester fiber carried out with solid phase polymerization, which is the third invention of the present invention, will be explained using Examples 48-60 and Comparative Examples 7-10.

Example 48

The melt spinning, the rewinding before solid phase polymerization, and the unwinding were carried out by a method similar to that in Example 46. While this fiber was unwound, it was passed through a cleaning device at a speed of 100 m/min, which was prepared by storing water with a room temperature (25° C.) in a water bath with a bath length of 1000 mm and bubbling the inside of the water bath using a bubble generation device mounted in the water bath. Further, successively thereafter, using a smoothing agent whose main constituent was polyether compound and a water emulsion of an emulsifier whose main constituent was lauryl alcohol (emulsion concentration: 4 wt %) as finishing oil, the oil supply was carried out before the winder using a stainless roller with a satin finish. The characteristics of the obtained fiber (characteristics of the fiber served to test weaving) are shown in Table 9. Where, the Δn of this fiber was 0.35 and it exhibited a high orientation, and the coefficient of thermal expansion was −7 ppm/° C. and it had an excellent thermal dimensional stability.

Using this fiber, the weft driving test was carried out at a condition of weaving density of 100/inch (2.54 cm) for both of warps and wefts and a weft driving speed of 100 times/min. The result thereof is also described in Table 9, and the process passing-through property and the weavability were good, and a fabric small in gauze thickness could be obtained. Although one fibril was recognized in the fabric, the quality was good. Thus, it is understood that, if the fiber is a fiber carried out with solid phase polymerization comprising a liquid crystalline polyester with a specified composition and formed at a small fineness according to the present invention, the process passing-through property, the weavability and the quality of fabric become excellent.

TABLE 9

| | | | Example 48 | Example 49 | Example 50 | Example 51 | Comparative Example 7 |
|---|---|---|---|---|---|---|---|
| | Spun fiber | | Example 1 | Example 49 | Example 11 | Example 12 | Comparative Example 7 |
| Rewinding before solid phase polymerization | Formation | | Example 46 | Rewinding | Rewinding | Rewinding | Rewinding |
| | Winding tension | cN/dtex | | 0.10 | 0.05 | 0.03 | 0.05 |
| | Contact/non-contact | | | Non-contact | Non-contact | Non-contact | Non-contact |
| | Rewinding speed | | | 100 | 200 | 200 | 200 |
| | Taper angle | | | 20 | 20 | 20 | 20 |
| | Winding number | | | 9.0 | 9.0 | 9.0 | 9.0 |
| | Winding amount | kg | | 0.02 | 0.06 | 0.11 | 0.15 |
| | Winding amount | 10,000 m | | 6 | 6 | 6 | 3 |
| | Method for adding oil | | | OR | OR | OR | OR |
| | Component | | | PDMS | PDMS | PDMS | PDMS |
| | Amount of adhesion | wt % | | 4.2 | 3.8 | 3.6 | 1.6 |
| | Winding density | g/cm$^3$ | | 0.14 | 0.10 | 0.08 | 0.10 |
| Solid phase polymerization | Total time of solid phase polymerization | hr | | 32 | 32 | 32 | 62 |
| | Final temperature | ° C. | | 295 | 295 | 295 | 295 |
| Unwinding | Unwinding speed | | | 200 | 200 | 200 | 200 |
| | Number of times of breakage of unwound yarn | times/10,000 m | | 0.17 | 0 | 0 | 1.33 |
| Cleaning | Form for cleaning | | Bubble in water bath | Bubble in water bath | Bubble in water bath | Bubble in water bath | Bubble in water bath |
| | Amount of oil adhesion after cleaning | wt % | 1.8 | 1.6 | 1.4 | 1.3 | 0.7 |
| | Oil addition | | present | present | present | present | present |
| Fiber characteristics served to test weaving | Molecular weight | ×10000 | 42.0 | 42.1 | 41.0 | 40.4 | 38.4 |
| | Fineness | dtex | 5.1 | 4.0 | 10.0 | 18.0 | 51.0 |
| | Fluctuation rate of fineness | % | 3 | 5 | 3 | 2 | 31 |
| | Number of filaments | | 1 | 1 | 1 | 1 | 1 |
| | Fineness of single fiber | dtex | 5.1 | 4.0 | 10.0 | 18.0 | 51.0 |
| | Strength | cN/dtex | 26.7 | 21.2 | 24.2 | 21.6 | 19.5 |
| | Fluctuation rate of tenacity | % | 6 | 9 | 9 | 13 | 22 |
| | Elongation | % | 3.1 | 2.4 | 2.8 | 2.7 | 2.6 |
| | Elastic modulus | cN/dtex | 1013 | 964 | 891 | 865 | 848 |
| | Compression elastic modulus | GPa | 0.29 | 0.28 | 0.30 | 0.32 | 0.35 |
| | Δ2θ | ° | 1.3 | 1.3 | 1.3 | 1.4 | 1.4 |
| | Tm1 | ° C. | 332 | 336 | 331 | 330 | 320 |
| | Exothermic peak | J/g | none | none | none | none | none |
| | ΔHm1 | J/g | 8.4 | 8.8 | 7.2 | 6.9 | 6.4 |
| | Half width of peak at Tm1 | ° C. | 12 | 11 | 12 | 13 | 18 |
| | Tc | ° C. | 271 | 273 | 272 | 270 | 270 |
| | ΔHc | J/g | 3.5 | 3.6 | 3.4 | 3.2 | 3.1 |
| | Tm2 | ° C. | 329 | 328 | 327 | 326 | 316 |
| | ΔHm2 | J/g | 1.2 | 1.2 | 1.9 | 1.8 | 1.2 |
| | ΔHm1/ΔHm2 | | 7.0 | 7.3 | 3.8 | 3.8 | 5.3 |
| | Amount of oil adhesion | wt % | 1.9 | 1.7 | 1.5 | 1.4 | 0.8 |
| | Adhesion of polysiloxane | | present | present | present | present | present |
| | Abrasion resistance M | second | 12 | 7 | 10 | 12 | 8 |
| Weaving | Process passing-through property | | ◎ | ○ | ◎ | ◎ | Δ |
| | Weavability | | ◎ | ○ | ◎ | ◎ | Δ |
| | Gauze thickness | μm | 52 | 48 | 65 | 71 | 103 |
| | Quality of fabric | | ○ | ○ | ○ | ○ | Δ |

| | | | Example 52 | Example 53 | Comparative Example 8 |
|---|---|---|---|---|---|
| | Spun fiber | | Example 13 | Example 14 | Example 15 |
| Rewinding before solid phase polymerization | Formation | | Rewinding | Rewinding | Rewinding |
| | Winding tension | cN/dtex | 0.07 | 0.02 | 0.05 |
| | Contact/non-contact | | Non-contact | Non-contact | Non-contact |
| | Rewinding speed | | 200 | 200 | 200 |
| | Taper angle | | 20 | 20 | 20 |
| | Winding number | | 9.0 | 9.0 | 9.0 |
| | Winding amount | kg | 0.15 | 0.54 | 0.06 |
| | Winding amount | 10,000 m | 3 | 3 | 6 |
| | Method for adding oil | | OR | OR | OR |
| | Component | | PDMS | PDMS | PDMS |
| | Amount of adhesion | wt % | 3.1 | 3.1 | 3.8 |
| | Winding density | g/cm$^3$ | 0.22 | 0.24 | 0.10 |
| Solid phase polymerization | Total time of solid phase polymerization | hr | 32 | 32 | 32 |
| | Final temperature | ° C. | 295 | 295 | 295 |
| Unwinding | Unwinding speed | | 200 | 200 | 200 |
| | Number of times of breakage of unwound yarn | times/10,000 m | 0 | 0 | 0 |
| Cleaning | Form for cleaning | | Package cleaning + water bath | Package cleaning + water bath | Bubble in water bath |
| | Amount of oil adhesion after cleaning | wt % | 1.5 | 1.5 | 1.8 |
| | Oil addition | | present | present | present |

TABLE 9-continued

| | | | | | |
|---|---|---|---|---|---|
| Fiber characteristics served to test weaving | Molecular weight | ×10000 | 42.0 | 42.0 | 66.9 |
| | Fineness | dtex | 49.9 | 180.4 | 10.0 |
| | Fluctuation rate of fineness | % | 1 | 1 | 3 |
| | Number of filaments | | 10 | 36 | 1 |
| | Fineness of single fiber | dtex | 5.0 | 5.0 | 10.0 |
| | Strength | cN/dtex | 22.2 | 20.2 | 22.2 |
| | Fluctuation rate of tenacity | % | 10 | 10 | 10 |
| | Elongation | % | 2.8 | 2.6 | 3.1 |
| | Elastic modulus | cN/dtex | 839 | 801 | 861 |
| | Compression elastic modulus | GPa | 0.29 | 0.29 | 1.12 |
| | Δ2θ | ° | 1.3 | 1.3 | 1.4 |
| | Tm1 | ° C. | 338 | 335 | 326 |
| | Exothermic peak | J/g | none | none | none |
| | ΔHm1 | J/g | 8.8 | 8.1 | 10.1 |
| | Half width of peak at Tm1 | ° C. | 11 | 12 | 7 |
| | Tc | ° C. | 274 | 275 | 225 |
| | ΔHc | J/g | 3.5 | 3.6 | 2.7 |
| | Tm2 | ° C. | 326 | 327 | 318 |
| | ΔHm2 | J/g | 1.3 | 1.3 | 1.1 |
| | ΔHm1/ΔHm2 | | 6.8 | 6.2 | 9.2 |
| | Amount of oil adhesion | wt % | 1.5 | 1.5 | 1.9 |
| | Adhesion of polysiloxane | | present | present | present |
| | Abrasion resistance M | second | 13 | 11 | 2 |
| Weaving | Process passing-through property | | ◎ | ◎ | X |
| | Weavability | | ◎ | ◎ | X |
| | Gauze thickness | μm | 72 | 98 | 64 |
| | Quality of fabric | | ○ | ○ | X |

Examples 49-51, Comparative Example 7

The melt spinning was carried out by a method similar to that in Example 10 other than providing a heating tube (heat insulating region: 100 mm) under the die and setting the temperature thereof at 200° C. (example 49). In Examples 50, 51, the melt spinnings were carried out by methods similar to the respective methods in Examples 11, 12. The melt spinning was carried out by a method similar to that in Example 1 other than changing the amount of discharge, the hole diameter of die, the land length, the number of die holes and the spinning speed to those described in Table 2, and a fiber with a fineness of single fiber of 51 dtex was obtained (Comparative Example 7). In Comparative Example 7, because of the great single-fiber fineness which may be considered as the reason, the weavability was not good and yarn breakage occurred three times. The characteristics of the obtained fibers are also shown in Table 2. In Comparative Example 7, the fluctuation rate of fineness and the fluctuation rate of tenacity were great. Where, in Example 49, by the effect due to the heating tube, the fluctuation rate of fineness and the fluctuation rate of tenacity were improved a little as compared with those in Example 10.

These were rewound by a method similar to that in Example 46 other than changing the rewinding speed, the taper angle and the winding amount to those described in Table 9. The winding tension, the winding density and the amount of oil adhesion are at that time are as shown in Table 9. This was carried out with solid phase polymerization by a method similar to that in Example 1. Where, in Comparative Example 7, because it was recognized that the strength was not increased enough at this condition for solid phase polymerization about 16 cN/dtex), it was treated at the maximum reaching temperature for 45 hours. The results the obtained packages carried out with solid phase polymerization were unwound by a method similar to that in Example 1 are also described in Table 9, and although yarn breakage once occurred in Example 49, yarn breakage occurred four times in Comparative Example 7. Further, the fiber after being unwound was carried out with cleaning and providing of finishing oil by a method similar to that in Example 48. The characteristics of the fibers thus obtained are shown in Table 9.

Using these fibers, the test weaving was carried out by a method similar to that in Example 48. The results thereof are also described in Table 9, in Example 49, although fibrils were accumulated near the yarn supply port, the process passing-through property was good, further, although machine stopping once occurred during the weaving, the weavability was good, although two fibrils were present in the fabric, the quality of fabric was also good, and in Examples 50, 51, the process passing-through property and the weavability were both excellent, the fibril present in the fabric was only one, and the quality of fabric was also good. On the other hand, in Comparative Example 7, fibrils were accumulated near the yarn supply port, the tension increased, and even in the weaving, machine stopping occurred four times. Further, five fibrils were recognized also in the fabric, it was not satisfied.

Thus, it is understood that even in case of a fiber carried out with solid phase polymerization comprising a liquid crystalline polyester with a specified composition according to the present invention, in case where the fineness of single fiber is great, it is difficult to improve the uniformity in the lengthwise direction, and the process passing-through property, the weavability and the quality of fabric are poor.

Examples 52, 53

The melt spinning was carried out by a method similar to that in Example 13, 14, the rewinding was carried out by a method similar to that in Example 46 other than obtaining a multifilament spun fiber and the taper angle and the winding amount to those described in Table 9. At that time, the winding tension, the winding density and the amount of oil adhesion were as shown in Table 9. These were carried out with solid phase polymerization and unwinding by a method similar to that in Example 1. Next, the whole of the package after unwinding was dipped in a ultrasonic wave cleaner filled with a solution prepared by adding 0.05 vol % of surfactant to hot water of 40° C., and the ultrasonic wave cleaning for 15 minutes was carried out 6 times. Thereafter, while the fiber was unwound at a state where the package was not dried, cleaning and providing of finishing oil were carried out by a method similar to that in Example 48. The characteristics of fibers thus obtained are shown in Table 9.

Using these fibers, the test weaving was carried out by a method similar to that in Example 48. The result thereof are also described in Table 9, the process passing-through property and the weavability were both excellent, the fibril present in the fabric was only two, and the quality of fabric was also excellent.

Thus, it is understood that as long as the fiber is a fiber carried out with solid phase polymerization comprising a liquid crystalline polyester with a specified composition according to the present invention, even in case of multifilament, the process passing-through property, the weavability and the quality of fabric are excellent.

Comparative Example 8

Using the spun fiber obtained in Example 15, the rewinding was carried out by a method similar to that in Example 50. At that time, the winding tension, the winding density and the amount of oil adhesion were as shown in Table 9. These were carried out with solid phase polymerization and unwinding by a method similar to that in Example 15, and the cleaning and the providing of finishing oil were carried out by a method similar to that in Example 48. The characteristics of the fiber thus obtained are shown in Table 9.

Using these fibers, the test weaving was carried out by a method similar to that in Example 48. The result thereof are also described in Table 9, fibrils were accumulated on the yarn supply port, and further, machine stopping occurred 6 times during the weaving, and therefore, the test weaving was stopped in the middle thereof. Although the test weaving could be carried out only at a weaving length of about 30 cm, fibrils of 10 or more were present in it, and the quality of fabric was not good.

Thus, it is understood that in a fiber carried out with solid phase polymerization comprising a liquid crystalline polyester which does not satisfy the composition according to the present invention, by the poor abrasion resistance that may be considered to be the reason, the process passing-through property, the weavability and the quality of fabric are poor.

Comparative Examples 9, 10

Using the fiber obtained in Example 1 as it was, the test weaving was carried out by a method similar to that in Example 48. However, at the timing entering into the weaving machine, yarn breakage occurred, and the weaving was impossible. Even in case of the liquid crystalline polyester with a specified composition according to the present invention, if solid phase polymerization has not been carried out, because the strength and the elongation are low, weaving is difficult.

Using the fiber carried out with solid phase polymerization after unwinding which was obtained in Comparative Example 6, the test weaving was carried out by a method similar to that in Example 48. The result thereof is described in Table 10, fibrils were accumulated on the yarn supply port, and further, machine stopping occurred 6 times during the weaving, and therefore, the test weaving was stopped in the middle thereof. Although the test weaving could be carried out only at a weaving length of about 5 cm, fibrils of 10 or more were present in it, and the quality of fabric was not good.

Thus, it is understood that even in a fiber carried out with solid phase polymerization comprising a liquid crystalline polyester which satisfies the composition according to the present invention, in case where the uniformity in the lengthwise direction is poor, because the strength is low and the abrasion resistance is poor, the process passing-through property, the weavability and the quality of fabric are poor.

TABLE 10

| | | | Comparative Example 9 | Comparative Example 10 | Example 54 | Example 55 | Example 56 |
|---|---|---|---|---|---|---|---|
| | Spun fiber | | Example 1 | Example 1 | Example 17 | Example 18 | Example 19 |
| Rewinding before solid phase polymerization | Formation | | Solid phase polymerization not carried out | Comparative Example 6 | Rewinding | Rewinding | Rewinding |
| | Winding tension | cN/dtex | | | 0.10 | 0.10 | 0.10 |
| | Contact/non-contact | | | | Non-contact | Non-contact | Non-contact |
| | Rewinding speed | | | | 200 | 200 | 200 |
| | Taper angle | | | | 20 | 20 | 20 |
| | Winding number | | | | 9.0 | 9.0 | 9.0 |
| | Winding amount | kg | | | 0.06 | 0.06 | 0.06 |
| | Winding amount | 10,000 m | | | 6 | 6 | 6 |
| | Method for adding oil | | | | OR | OR | OR |
| | Component | | | | PDMS | PDMS | PDMS |
| | Amount of adhesion | wt % | | | 4.4 | 4.4 | 4.4 |
| | Winding density | g/cm$^3$ | | | 0.14 | 0.14 | 0.14 |
| Solid phase polymerization | Total time of solid phase polymerization | hr | | 32 | 32 | 31 | 40 |
| | Final temperature | ° C. | | 295 | 295 | 290 | 325 |
| Unwinding | Unwinding speed | | | 50 | 200 | 200 | 200 |
| | Number of times of breakage of unwound yarn | times/10,000 m | | X | 0 | 0 | 0 |
| Cleaning | Form for cleaning | | | none | Bubble in water bath | Bubble in water bath | Bubble in water bath |
| | Amount of oil adhesion after cleaning | wt % | | 1 | 1.8 | 1.8 | 1.8 |
| | Oil addition | | | none | present | present | present |
| Fiber characteristics served to test weaving | Molecular weight | ×10000 | 9.1 | 41.9 | 41.1 | 40.3 | 42.8 |
| | Fineness | dtex | 5.0 | 5.0 | 10.0 | 10.0 | 10.0 |
| | Fluctuation rate of fineness | % | 3 | 11 | 3 | 4 | 5 |
| | Number of filaments | | 1 | 1 | 1 | 1 | 1 |
| | Fineness of single fiber | dtex | 5.0 | 5.0 | 10.0 | 10.0 | 10.0 |
| | Strength | cN/dtex | 5.9 | 12.9 | 20.4 | 18.1 | 21.7 |
| | Fluctuation rate of tenacity | % | 11 | 32 | 14 | 9 | 18 |

TABLE 10-continued

| | | | | | | | |
|---|---|---|---|---|---|---|---|
| | Elongation | % | 1.3 | 1.6 | 3.0 | 2.8 | 2.8 |
| | Elastic modulus | cN/dtex | 511 | 783 | 821 | 684 | 795 |
| | Compression elastic modulus | GPa | 0.50 | 0.31 | 0.27 | 0.26 | 0.33 |
| | Δ2θ | ° | 1.5 | 1.3 | 1.4 | 1.4 | 1.3 |
| | Tm1 | ° C. | 298 | 328 | 310 | 328 | 361 |
| | Exothermic peak | J/g | none | none | none | none | none |
| | ΔHm1 | J/g | 2.9 | 7.9 | 7.2 | 7.5 | 9.2 |
| | Half width of peak at Tm1 | ° C. | 42 | 13 | 11 | 12 | 12 |
| | Tc | ° C. | 234 | 269 | 255 | 264 | 300 |
| | ΔHc | J/g | 1 | 3.2 | 3.3 | 3.2 | 3.3 |
| | Tm2 | ° C. | 315 | 326 | 294 | 313 | 355 |
| | ΔHm2 | J/g | 1.2 | 1.3 | 1.4 | 1.2 | 1.5 |
| | ΔHm1/ΔHm2 | | 2.4 | 6.1 | 5.1 | 6.3 | 6.1 |
| | Amount of oil adhesion | wt % | 1.0 | 1.0 | 1.9 | 1.9 | 1.9 |
| | Adhesion of polysiloxane | | present | present | present | present | present |
| | Abrasion resistance M | second | 1 | 1 | 10 | 7 | 6 |
| Weaving | Process passing-through property | | impossible to weave | X | ◎ | ○ | ○ |
| | Weavability | | | X | ◎ | ○ | ○ |
| | Gauze thickness | μm | | 52 | 66 | 65 | 63 |
| | Quality of fabric | | | X | ○ | ○ | ○ |

| | | | | Example 57 | Example 58 | Example 59 | Example 60 |
|---|---|---|---|---|---|---|---|
| | | Spun fiber | | Example 20 | Example 21 | Example 22 | Example 23 |
| | Rewinding before solid phase polymerization | Formation | | Rewinding | Rewinding | Rewinding | Rewinding |
| | | Winding tension | cN/dtex | 0.10 | 0.10 | 0.10 | 0.10 |
| | | Contact/non-contact | | Non-contact | Non-contact | Non-contact | Non-contact |
| | | Rewinding speed | | 200 | 200 | 200 | 200 |
| | | Taper angle | | 20 | 20 | 20 | 20 |
| | | Winding number | | 9.0 | 9.0 | 9.0 | 9.0 |
| | | Winding amount | kg | 0.06 | 0.06 | 0.06 | 0.06 |
| | | Winding amount | 10,000 m | 6 | 6 | 6 | 6 |
| | | Method for adding oil | | OR | OR | OR | OR |
| | | Component | | PDMS | PDMS | PDMS | PDMS |
| | | Amount of adhesion | wt % | 4.4 | 4.4 | 4.4 | 4.4 |
| | | Winding density | $g/cm^3$ | 0.14 | 0.14 | 0.14 | 0.14 |
| | Solid phase polymerization | Total time of solid phase polymerization | hr | 35 | 29 | 39 | 29 |
| | | Final temperature | ° C. | 305 | 280 | 320 | 280 |
| | Unwinding | Unwinding speed | | 200 | 200 | 200 | 200 |
| | | Number of times of breakage of unwound yarn | times/10,000 m | 0 | 0 | 0 | 0 |
| | Cleaning | Form for cleaning | | Bubble in water bath | Bubble in water bath | Bubble in water bath | Bubble in water bath |
| | | Amount of oil adhesion after cleaning | wt % | 1.8 | 1.8 | 1.8 | 1.8 |
| | | Oil addition | | present | present | present | present |
| | Fiber characteristics served to test weaving | Molecular weight | ×10000 | 42.0 | 41.9 | 43.1 | 40.2 |
| | | Fineness | dtex | 10.0 | 10.0 | 10.0 | 10.0 |
| | | Fluctuation rate of fineness | % | 3 | 3 | 21 | 12 |
| | | Number of filaments | | 1 | 1 | 1 | 1 |
| | | Fineness of single fiber | dtex | 10.0 | 10.0 | 10.0 | 10.0 |
| | | Strength | cN/dtex | 24.4 | 22.1 | 24.7 | 22.4 |
| | | Fluctuation rate of tenacity | % | 14 | 13 | 20 | 19 |
| | | Elongation | % | 2.7 | 2.8 | 2.8 | 2.8 |
| | | Elastic modulus | cN/dtex | 911 | 854 | 942 | 864 |
| | | Compression elastic modulus | GPa | 0.28 | 0.27 | 0.31 | 0.28 |
| | | Δ2θ | ° | 1.3 | 1.2 | 1.3 | 1.4 |
| | | Tm1 | ° C. | 345 | 308 | 355 | 313 |
| | | Exothermic peak | J/g | none | none | none | none |
| | | ΔHm1 | J/g | 8.9 | 7.8 | 8.5 | 7.7 |
| | | Half width of peak at Tm1 | ° C. | 12 | 11 | 12 | 11 |
| | | Tc | ° C. | 282 | 253 | 294 | 251 |
| | | ΔHc | J/g | 3.1 | 3.2 | 3.3 | 3.2 |
| | | Tm2 | ° C. | 328 | 295 | 343 | 298 |
| | | ΔHm2 | J/g | 1.3 | 1.3 | 1.3 | 1.4 |
| | | ΔHm1/ΔHm2 | | 6.8 | 6.0 | 6.5 | 5.5 |
| | | Amount of oil adhesion | wt % | 1.9 | 1.9 | 1.9 | 1.9 |
| | | Adhesion of polysiloxane | | present | present | present | present |
| | | Abrasion resistance M | second | 10 | 8 | 6 | 11 |
| | Weaving | Process passing-through property | | ○ | ○ | ○ | ◎ |
| | | Weavability | | ◎ | ○ | ○ | ◎ |
| | | Gauze thickness | μm | 66 | 68 | 64 | 65 |
| | | Quality of fabric | | ○ | ○ | ○ | ○ |

Examples 54-60

The melt spinning was carried out by a method similar to that in each of Examples 17-23. These fibers were rewound by a method similar to that in Example 49 other than changing the rewinding speeds to those described in Table 10, and the solid phase polymerization and the unwinding were carried out by a method similar to that in Example 1 other than changing the maximum reaching temperatures to those described in Table 10. At the time of unwinding, yarn breakage did not occur. Thereafter, cleaning and providing of finishing oil were carried out by a method similar to that in Example 48.

Using these fibers, the test weaving was carried out by a method similar to that in Example 48. The result thereof are also described in Table 10, the process passing-through property, the weavability and the quality of fabric were all good.

Thus, it is understood that as long as the fiber is a fiber carried out with solid phase polymerization comprising a liquid crystalline polyester with a specified composition according to the present invention, even in case of a different composition ratio, the process passing-through property, the weavability and the quality of fabric are excellent.

Next, with respect to the heat treatment process which is the second invention, a process for further increasing the effect will be explained using Examples 61-82 and Comparative Example 11.

Example 61

Using the fiber carried out with solid phase polymerization after unwinding and cleaning obtained in Example 48, while unwinding it, using a slit heater with a slit width of 5.6 mm, the heat treatment was carried out while being run at a non-contact condition with the heater, and thereafter, successively, using a smoothing agent whose main constituent was polyether compound and a water emulsion of an emulsifier whose main constituent was lauryl alcohol (emulsion concentration: 4 wt %) as finishing oil, the oil supply was carried out before the winder using a stainless roller with a satin finish, and it was wound by the winder (ET type speed control winder, produced by Kamizu Seisakusyo Corporation).

Although the conditions for treatment temperature and treatment speed and the characteristics of the obtained liquid crystalline polyester fiber are shown in Table 11, it is understood that a liquid crystalline polyester fiber reduced greatly in ΔHm1 and high in strength, elastic modulus and thermal resistance (high melting point) and excellent particularly in abrasion resistance can be obtained by carrying out a high-temperature heat treatment at a condition of Tm1 of the fiber+10° C. or higher.

When, the Δn of the obtained liquid crystalline polyester fiber after the heat treatment was 0.35, it had a high orientation which was not changed from the value before the heat treatment, and the coefficient of thermal expansion was −10 ppm/° C., and it had an excellent thermal dimensional stability.

TABLE 11

| | | | Example 61 | Example 62 | Example 63 | Example 64 | Comparative Example 11 | Example 65 | Example 66 |
|---|---|---|---|---|---|---|---|---|---|
| Fiber served to heat treatment (fiber carried out with solid phase polymerization) | | | Example 48 | Example 48 | Example 48 | Example 48 | Example 48 | Example 48 | Example 48 |
| Heat Treatment | Treatment temperature | ° C. | 470 | 430 | 390 | 430 | 310 | 520 | 360 |
| | Treatment length | mm | 500 | 500 | 500 | 500 | 500 | 500 | 500 |
| | Treatment speed | m/min | 150 | 150 | 150 | 30 | 30 | 500 | 10 |
| | Treatment time | sec | 0.20 | 0.20 | 0.20 | 1.00 | 1.00 | 0.06 | 3.00 |
| | Running tension | gf | 0.60 | 0.70 | 0.80 | 0.50 | 0.90 | 2.00 | 0.50 |
| | Running stress | cN/dtex | 0.12 | 0.13 | 0.15 | 0.10 | 0.17 | 0.38 | 0.10 |
| | Running stability | | ○ | ○ | ○ | ○ | ○ | Δ | ○ |
| Fiber characteristics after heat treatment (Fiber characteristics served to test weaving) | Molecular weight | ×10000 | 42.0 | 42.0 | 42.0 | 42.0 | 42.0 | 42.0 | 42.0 |
| | Fineness | dtex | 5.1 | 5.1 | 5.1 | 5.1 | 5.1 | 5.1 | 5.1 |
| | Fluctuation rate of fineness | % | 3 | 3 | 3 | 3 | 3 | 8 | 3 |
| | Number of filaments | | 1 | 1 | 1 | 1 | 1 | 1 | 1 |
| | Fineness of single fiber | dtex | 5.1 | 5.1 | 5.1 | 5.1 | 5.1 | 5.1 | 5.1 |
| | Strength | cN/dtex | 17.4 | 18.7 | 19.8 | 15.0 | 23.4 | 14.2 | 18.5 |
| | Fluctuation rate of tenacity | % | 5 | 7 | 6 | 10 | 7 | 16 | 7 |
| | Elongation | % | 3.1 | 3.0 | 3.0 | 3.0 | 3.0 | 2.9 | 3.0 |
| | Elastic modulus | cN/dtex | 723 | 785 | 831 | 623 | 933 | 524 | 775 |
| | Compression elastic modulus | GPa | 0.19 | 0.22 | 0.23 | 0.17 | 0.26 | 0.17 | 0.22 |
| | Δ2θ | ° | 2.9 | 2.4 | 1.9 | 3.0 | 1.6 | 3.1 | 2.5 |
| | Tm1 | ° C. | 317 | 321 | 324 | 314 | 330 | 312 | 320 |
| | Exothermic peak | J/g | none | none | none | none | none | none | none |
| | ΔHm1 | J/g | 1.7 | 2.9 | 4.9 | 2.3 | 8.0 | 2.4 | 4.8 |
| | Half width of peak at Tm1 | ° C. | 29 | 25 | 21 | 35 | 13 | 42 | 22 |
| | Tc | ° C. | 277 | 275 | 274 | 278 | 272 | 279 | 275 |
| | ΔHc | J/g | 3.9 | 3.7 | 3.6 | 3.9 | 3.5 | 4.0 | 3.8 |
| | Tm2 | ° C. | 331 | 330 | 329 | 332 | 328 | 333 | 330 |
| | ΔHm2 | J/g | 1.5 | 1.5 | 1.4 | 1.7 | 1.3 | 1.6 | 1.4 |
| | ΔHm1/ΔHm2 | | 2.6 | 2.5 | 2.6 | 2.3 | 2.7 | 2.5 | 2.7 |
| | Amount of oil adhesion | wt % | 2.0 | 2.0 | 2.0 | 2.0 | 2.0 | 2.0 | 2.0 |
| | Adhesion of polysiloxane | | present | present | present | present | present | present | present |

TABLE 11-continued

| | | | | | | | | | |
|---|---|---|---|---|---|---|---|---|---|
| | Abrasion resistance M | second | 98 | 67 | 26 | 65 | 11 | 105 | 18 |
| Weaving | Process passing-through property | | ◎ | ◎ | ◎ | ◎ | Δ | ◎ | ○ |
| | Weavability | | ◎ | ◎ | ○ | ◎ | X | ○ | ○ |
| | Quality of fabric | | ◎ | ○ | ○ | ○ | X | ◎ | ○ |

| | | | Example 67 | Example 68 | Example 69 | Example 70 | Example 71 | Example 72 |
|---|---|---|---|---|---|---|---|---|
| | Fiber served to heat treatment (fiber carried out with solid phase polymerization) | | Example 48 | Example 48 | Example 49 | Example 50 | Example 51 | Example 47 |
| Heat Treatment | Treatment temperature | ° C. | 500 | 400 | 450 | 490 | 520 | 440 |
| | Treatment length | mm | 50 | 2000 | 500 | 500 | 500 | 500 |
| | Treatment speed | m/min | 300 | 300 | 150 | 150 | 150 | 150 |
| | Treatment time | sec | 0.01 | 0.40 | 0.20 | 0.20 | 0.20 | 0.20 |
| | Running tension | gf | 1.70 | 1.50 | 0.60 | 0.50 | 0.50 | 0.50 |
| | Running stress | cN/dtex | 0.33 | 0.29 | 0.15 | 0.05 | 0.03 | 0.20 |
| | Running stability | | Δ | Δ | ○ | ○ | ○ | Δ |
| Fiber characteristics after heat treatment (Fiber characteristics served to test weaving) | Molecular weight | ×10000 | 42.0 | 42.0 | 42.1 | 41.0 | 40.4 | 42.3 |
| | Fineness | dtex | 5.1 | 5.1 | 4.0 | 10.0 | 18.0 | 2.5 |
| | Fluctuation rate of fineness | % | 5 | 4 | 5 | 3 | 2 | 9 |
| | Number of filaments | | 1 | 1 | 1 | 1 | 1 | 1 |
| | Fineness of single fiber | dtex | 5.1 | 5.1 | 4.0 | 10.0 | 18.0 | 2.5 |
| | Strength | cN/dtex | 16.9 | 14.5 | 15.3 | 16.9 | 16.1 | 14.6 |
| | Fluctuation rate of tenacity | % | 13 | 9 | 13 | 10 | 16 | 10 |
| | Elongation | % | 3.0 | 2.9 | 2.4 | 2.8 | 2.7 | 2.6 |
| | Elastic modulus | cN/dtex | 658 | 547 | 713 | 705 | 694 | 702 |
| | Compression elastic modulus | GPa | 0.18 | 0.17 | 0.18 | 0.20 | 0.22 | 0.18 |
| | Δ2θ | ° | 2.9 | 3.1 | 2.9 | 2.5 | 2.4 | 2.9 |
| | Tm1 | ° C. | 317 | 313 | 317 | 314 | 313 | 318 |
| | Exothermic peak | J/g | none | none | none | none | none | none |
| | ΔHm1 | J/g | 3.1 | 2.6 | 2.1 | 2.5 | 2.8 | 1.8 |
| | Half width of peak at Tm1 | ° C. | 21 | 27 | 24 | 28 | 19 | 27 |
| | Tc | ° C. | 277 | 279 | 276 | 276 | 275 | 276 |
| | ΔHc | J/g | 3.9 | 4.0 | 3.9 | 3.7 | 3.6 | 4.0 |
| | Tm2 | ° C. | 331 | 332 | 332 | 331 | 330 | 332 |
| | ΔHm2 | J/g | 1.5 | 1.7 | 1.5 | 1.5 | 1.5 | 1.6 |
| | ΔHm1/ΔHm2 | | 2.6 | 2.4 | 2.6 | 2.5 | 2.4 | 2.5 |
| | Amount of oil adhesion | wt % | 2.0 | 2.0 | 1.8 | 1.6 | 1.5 | 4.0 |
| | Adhesion of polysiloxane | | present | present | present | present | present | present |
| | Abrasion resistance M | second | 54 | 63 | 81 | 77 | 59 | 42 |
| Weaving | Process passing-through property | | ◎ | ◎ | ◎ | ◎ | ◎ | ○ |
| | Weavability | | ○ | ◎ | ◎ | ◎ | ○ | ○ |
| | Quality of fabric | | ○ | ○ | ◎ | ○ | ○ | ○ |

Examples 62, 63

Using the fiber carried out with solid phase polymerization after unwinding and cleaning obtained in Example 48, the heat treatment was carried out by a method similar to that in Example 61 other than changing the treatment temperature to that shown in Table 11. Although the characteristics of the obtained fiber are described in Table 11, it is understood that a liquid crystalline polyester fiber high in strength, elastic modulus and thermal resistance (high melting point) and excellent in abrasion resistance can be obtained by carrying out a high-temperature heat treatment at a condition of Tm1+10° C. or higher. Further, it is understood that, at the same treatment length and treatment speed, in case where the treatment temperature is higher, the degree of crystallization and the completion of crystallinity are more decreased, and the effect for improving the abrasion resistance is higher.

Examples 64-68, Comparative Example 11

Using the fiber carried out with solid phase polymerization after unwinding and cleaning obtained in Example 48, the heat treatment was carried out by a method similar to that in Example 61 other than changing the treatment temperature, the treatment length and the treatment speed to those shown in Table 11. In case where the treatment temperature was high (Examples 65, 67) and in case where the treatment length was great (Example 68), although the yarn swing became greater, yarn breakage and breakage by fusion did not occur, and the running was stable. The characteristics of the obtained fibers are also shown in Table 11. It is understood that in Comparative Example 11 where the treatment temperature was Tm1 of the fiber or lower, the abrasion resistance was not improved as compared with that of the fiber before the treatment, but in each of Examples 64-68 where a high-temperature heat treatment was carried out at a condition of Tm1+10° C. or higher, a liquid crystalline polyester fiber high in strength, elastic modulus and thermal resistance (high melting point) and excellent particularly in abrasion resistance can be obtained.

Examples 69-72

Using the fibers carried out with solid phase polymerization after unwinding and cleaning obtained in Examples 49, 50 and 51, the heat treatment was carried out by a method similar to that in Example 61 other than changing the treatment temperature to those shown in Table 11 (Examples 69-71). Further, using a fiber package carried out with solid phase polymerization obtained by a method similar to that in Example 47, after being carried out with unwinding and cleaning similar to those in Example 5, the heat treatment was carried out by a method similar to that in Example 61 other than changing the treatment temperature to that described in Table 11 (Example 72). In case where the fineness of single fiber was small to be 2.5 dtex (Example 72), although the yarn swing became great, yarn breakage and breakage by fusion did not occur and the running was stable. Further, in the other cases, the yarn swing was small and the running was stable. Although the characteristics of the obtained fibers are also described in Table 11, it is understood that, even in case of a different single-fiber fineness, in particular, in case of a fiber with a small fiber fineness, a liquid crystalline polyester fiber high in strength, elastic modulus and thermal resistance (high melting point) and excellent in abrasion resistance can be obtained by carrying out a high-temperature heat treatment at a condition of Tm1+10° C. or higher.

Examples 73, 74

Using the fibers carried out with solid phase polymerization after unwinding and cleaning obtained in Examples 52 and 53, the heat treatment was carried out by a method similar to that in Example 61 other than changing the treatment temperature, the treatment length and the treatment speed to those shown in Table 12. The yarn swing was small and the running was stable. Although the characteristics of the obtained fibers are shown in Table 12, it is understood that, even in case of multifilament, a liquid crystalline polyester fiber high in strength, elastic modulus and thermal resistance (high melting point) and excellent in abrasion resistance can be obtained by carrying out a high-temperature heat treatment at a condition of Tm1+10° C. or higher.

TABLE 12

| | | | Example 73 | Example 74 | Example 75 | Example 76 | Example 77 |
|---|---|---|---|---|---|---|---|
| | Fiber served to heat treatment (fiber carried out with solid phase polymerization) | | Example 52 | Example 53 | Comparative Example 8 | Example 54 | Example 55 |
| Heat Treatment | Treatment temperature | ° C. | 400 | 400 | 450 | 450 | 470 |
| | Treatment length | mm | 1000 | 1000 | 500 | 500 | 500 |
| | Treatment speed | m/min | 30 | 30 | 150 | 150 | 150 |
| | Treatment time | sec | 2.00 | 2.00 | 0.20 | 0.20 | 0.20 |
| | Running tension | gf | 0.80 | 0.70 | 0.70 | 1.20 | 1.20 |
| | Running stress | cN/dtex | 0.02 | 0.004 | 0.07 | 0.12 | 0.12 |
| | Running stability | | ○ | ○ | ○ | ○ | ○ |
| Fiber characteristics after heat treatment(Fiber characteristics served to test weaving) | Molecular weight | ×10000 | 42.0 | 42.0 | 66.9 | 41.0 | 40.3 |
| | Fineness | dtex | 49.9 | 180.4 | 10.0 | 10.0 | 10.0 |
| | Fluctuation rate of fineness | % | 1 | 1 | 3 | 3 | 4 |
| | Number of filaments | | 10 | 36 | 1 | 1 | 1 |
| | Fineness of single fiber | dtex | 5.0 | 5.0 | 10.0 | 10.0 | 10.0 |
| | Strength | cN/dtex | 17.7 | 16.1 | 16.4 | 14.2 | 14.1 |
| | Fluctuation rate of tenacity | % | 10 | 10 | 11 | 14 | 9 |
| | Elongation | % | 2.8 | 2.5 | 3.1 | 3.0 | 2.8 |
| | Elastic modulus | cN/dtex | 747 | 660 | 638 | 601 | 571 |
| | Compression elastic modulus | GPa | 0.23 | 0.23 | 0.81 | 0.18 | 0.18 |
| | Δ2θ | ° | 2.0 | 1.9 | 2.9 | 3.0 | 3.0 |
| | Tm1 | ° C. | 325 | 327 | 311 | 304 | 321 |
| | Exothermic peak | J/g | none | none | none | none | none |
| | ΔHm1 | J/g | 4.9 | 4.9 | 3.7 | 2.8 | 1.9 |
| | Half width of peak at Tm1 | ° C. | 20 | 18 | 20 | 35 | 28 |
| | Tc | ° C. | 273 | 271 | 230 | 251 | 283 |
| | ΔHc | J/g | 3.0 | 2.9 | 2.7 | 2.6 | 2.8 |
| | Tm2 | ° C. | 328 | 327 | 305 | 306 | 333 |
| | ΔHm2 | J/g | 1.3 | 1.4 | 2.2 | 0.8 | 0.9 |
| | ΔHm1/ΔHm2 | | 2.3 | 2.1 | 1.2 | 3.3 | 3.1 |
| | Amount of oil adhesion | wt % | 1.6 | 1.6 | 2.0 | 2.0 | 2.0 |
| | Adhesion of polysiloxane | | present | present | present | present | present |
| | Abrasion resistance M | second | 26 | 23 | 18 | 62 | 48 |
| Weaving | Process passing-through property | | ○ | ○ | ○ | ◎ | ◎ |
| | Weavability | | ◎ | ◎ | ○ | ◎ | ○ |
| | Quality of fabric | | ○ | ○ | ○ | ○ | ○ |

| | | | Example 78 | Example 79 | Example 80 | Example 81 | Example 82 |
|---|---|---|---|---|---|---|---|
| | Fiber served to heat treatment (fiber carried out with solid phase polymerization) | | Example 56 | Example 57 | Example 58 | Example 59 | Example 60 |
| Heat Treatment | Treatment temperature | ° C. | 500 | 480 | 450 | 490 | 450 |
| | Treatment length | mm | 500 | 500 | 500 | 500 | 500 |
| | Treatment speed | m/min | 150 | 150 | 150 | 150 | 150 |
| | Treatment time | sec | 0.20 | 0.20 | 0.20 | 0.20 | 0.20 |
| | Running tension | gf | 1.20 | 1.20 | 1.20 | 1.20 | 1.20 |
| | Running stress | cN/dtex | 0.12 | 0.12 | 0.12 | 0.12 | 0.12 |
| | Running stability | | ○ | ○ | ○ | Δ | Δ |

TABLE 12-continued

| | | | | | | | |
|---|---|---|---|---|---|---|---|
| Fiber characteristics after heat treatment(Fiber characteristics served to test weaving) | Molecular weight | ×10000 | 42.8 | 41.9 | 41.9 | 43.0 | 40.2 |
| | Fineness | dtex | 10.0 | 10.0 | 10.0 | 10.0 | 10.0 |
| | Fluctuation rate of fineness | % | 4 | 3 | 3 | 21 | 12 |
| | Number of filaments | | 1 | 1 | 1 | 1 | 1 |
| | Fineness of single fiber | dtex | 10.0 | 10.0 | 10.0 | 10.0 | 10.0 |
| | Strength | cN/dtex | 14.1 | 17.0 | 16.1 | 17.2 | 15.9 |
| | Fluctuation rate of tenacity | % | 18 | 14 | 13 | 20 | 19 |
| | Elongation | % | 1.9 | 2.7 | 2.8 | 2.8 | 2.8 |
| | Elastic modulus | cN/dtex | 712 | 642 | 605 | 661 | 614 |
| | Compression elastic modulus | GPa | 0.22 | 0.20 | 0.19 | 0.20 | 0.19 |
| | Δ2θ | ° | 2.9 | 2.8 | 2.6 | 2.7 | 2.8 |
| | Tm1 | ° C. | 353 | 338 | 306 | 343 | 305 |
| | Exothermic peak | J/g | none | none | none | none | none |
| | ΔHm1 | J/g | 2.8 | 3.1 | 3.5 | 3.0 | 3.6 |
| | Half width of peak at Tm1 | ° C. | 18 | 26 | 38 | 21 | 36 |
| | Tc | ° C. | 310 | 293 | 255 | 301 | 263 |
| | ΔHc | J/g | 3.4 | 3.0 | 2.8 | 3.3 | 2.8 |
| | Tm2 | ° C. | 357 | 347 | 317 | 351 | 312 |
| | ΔHm2 | J/g | 0.9 | 1.0 | 1.1 | 0.9 | 1.0 |
| | ΔHm1/ΔHm2 | | 3.8 | 3.0 | 1.1 | 3.7 | 2.8 |
| | Amount of oil adhesion | wt % | 2.0 | 2.0 | 2.0 | 2.0 | 2.0 |
| | Adhesion of polysiloxane | | present | present | present | present | present |
| | Abrasion resistance M | second | 27 | 53 | 38 | 51 | 47 |
| Weaving | Process passing-through property | | ○ | ◎ | ○ | ○ | ◎ |
| | Weavability | | ○ | ○ | ○ | ○ | ○ |
| | Quality of fabric | | ○ | ○ | ○ | ○ | ○ |

Example 75

Using the fiber carried out with solid phase polymerization after unwinding and cleaning obtained in Comparative Example 8, the heat treatment was carried out by a method similar to that in Example 61 other than changing the treatment temperature to that shown in Table 12. The yarn swing was small and the running was stable. Although the characteristics of the obtained fibers are shown in Table 12, it is understood that, even in case where the abrasion resistance M of the fiber served to the heat treatment is low to be 2 seconds, by optimizing the condition for heat treatment, thereby decreasing the degree of crystallization and the crystallinity, the abrasion resistance is improved, and a liquid crystalline polyester fiber high in strength, elastic modulus and thermal resistance (high melting point) and excellent in abrasion resistance can be obtained.

Examples 76-82

Using the fibers carried out with solid phase polymerization after unwinding and cleaning obtained in Examples 54-60, the heat treatment was carried out by a method similar to that in Example 61 other than changing the treatment temperature to those shown in Table 12. In Examples 81 and 82 where the fibers carried out with solid phase polymerization obtained in Examples 59 and 60 were used, although the yarn swing became great, yarn breakage and breakage by fusion did not occur and the running was stable. The characteristics of the obtained fibers are shown in Table 12. It is understood that, even in case of using liquid crystalline polyesters of Reference Examples 3-9, a liquid crystalline polyester fiber high in strength, elastic modulus and thermal resistance (high melting point) and excellent in abrasion resistance can be obtained by carrying out a high-temperature heat treatment at a condition of Tm1+10° C. or higher.

Finally, with respect to the liquid crystalline polyester fiber particularly excellent in abrasion resistance, which is the first invention, a process for further enhancing the effect will be explained using Examples 61-82 and Comparative Example 11.

Using the liquid crystalline polyester fibers obtained in Examples 61-82 and Comparative Example 11, the weft driving test was carried out at a condition of weaving density of 250/inch (2.54 cm) for both of warps and wefts and a weft driving speed of 200 times/min. The test weaving was carried out at higher weaving density and higher speed than the conditions of the test weaving aforementioned for the fiber carried out with solid phase polymerization, and therefore, the load to the fiber became higher, and because the weaving density was higher, the fiber length used for the same weaving length became greater.

The results of the test weaving are shown in Tables 11 and 12. In Comparative Example 11 where the factors of the present invention were not satisfied, fibrils were accumulated on the yarn supply port and the running tension increased, and further, because machine stopping occurred 6 times during the weaving, in the middle thereof the test weaving was stopped. Although the test weaving could be carried out only for the weaving length of about 40 cm, in it 10 or more fibrils were present, and the quality of the fabric was not good. On the other hand, in Examples 61-82, the process passing-through property, the weavability and the quality of fabric were all good or excellent, it is understood that, in the liquid crystalline polyester fiber satisfying the factors of the present invention particularly excellent in abrasion resistance, even if the weaving density is set high, the process passing-through property, the weavability and the quality of fabric can become excellent.

INDUSTRIAL APPLICATIONS OF THE INVENTION

The liquid crystalline polyester and the process for production of the same according to the present invention are suitable particularly for uses of filters and screen gauzes required with high mesh fabrics.

The invention claimed is:

1. A liquid crystalline polyester fiber, wherein said fiber exhibits a half width of an endothermic peak (Tm1) of 15° C. or above when measured under a condition of heating from 50° C. at a temperature elevation rate of 20° C./min in differential calorimetry, said fiber has a strength of 12.0 cN/dtex or more, and said fiber substantially does not exhibit an exothermic peak when measured in differential calorimetry under a condition of heating from 50° C. at a temperature elevation rate of 20° C./min.

2. The liquid crystalline polyester fiber according to claim 1, wherein said fiber has a heat of melting (ΔHm1) at said endothermic peak (Tm1) of 6.0 J/g or less.

3. The liquid crystalline polyester fiber according to claim 1, wherein the liquid crystalline polyester comprises the following structural units (I), (II), (III), (IV) and (V):

(I)

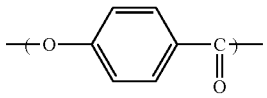

(II)

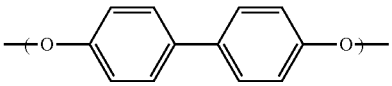

(III)

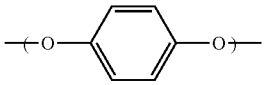

(IV)

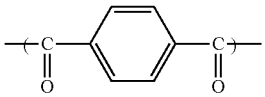

(V)

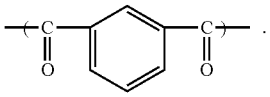

4. The liquid crystalline polyester fiber according to claim 1, wherein said fiber has an elastic modulus of 500 cN/dtex or more.

5. The liquid crystalline polyester fiber according to claim 1, wherein said fiber has a single-fiber fineness of 18.0 dtex or less.

6. The liquid crystalline polyester fiber according to claim 1, wherein said fiber exhibits a heat of crystallization (ΔHc) at an exothermic peak (Tc) when once cooled down to 50° C. under a condition of a temperature lowering rate of 20° C./min after being maintained for five minutes at a temperature of Tm1±20° C. after observation of Tm1 is 1.0 times or more relative to a heat of melting (ΔHm2) at an endothermic peak (Tm2) observed when measured under a condition of heating again at a temperature elevation rate of 20° C./min after being cooled down to 50° C.

7. The liquid crystalline polyester fiber according to claim 3, wherein said structural unit (I) is present at 40 to 85 mol % relative to the sum of said structural units (I), (II) and (III), said structural unit (II) is present at 60 to 90 mol % relative to the sum of said structural units (II) and (III), and said structural unit (IV) is present at 40 to 95 mol % relative to the sum of said structural units (IV) and (V).

8. A process for producing a liquid crystalline polyester fiber, wherein said fiber exhibits a half width of an endothermic peak (Tm1) of 15° C. or above when measured under a condition of heating from 50° C. at a temperature elevation rate of 20° C./min in differential calorimetry, said fiber has a strength of 12.0 cN/dtex or more, and said fiber substantially does not exhibit an exothermic peak when measured in differential calorimetry under a condition of heating from 50° C. at a temperature elevation rate of 20° C./min., wherein said process comprises heat treating a liquid crystalline polyester fiber at the temperature of the endothermic peak (Tm1)+10° C. or more.

9. The process for producing a liquid crystalline polyester fiber according to claim 8, wherein a liquid crystalline polyester comprises the following structural units (I), (II), (III), (IV) and (V):

(I)

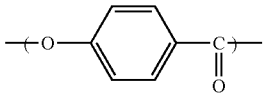

(II)

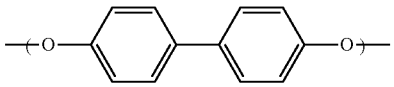

(III)

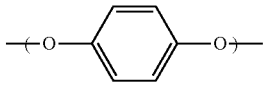

(IV)

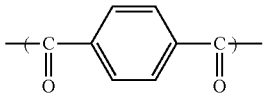

(V)

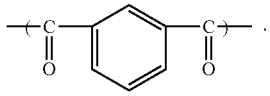

* * * * *